US010964148B2

(12) United States Patent
Rasmussen et al.

(10) Patent No.: US 10,964,148 B2
(45) Date of Patent: Mar. 30, 2021

(54) COIN SORTING SYSTEM COIN CHUTE

(71) Applicant: Cummins-Allison Corp., Mt. Prospect, IL (US)

(72) Inventors: James M. Rasmussen, Chicago, IL (US); John R. Blake, St. Charles, IL (US); David J. Wendell, Darien, IL (US)

(73) Assignee: Cummins-Allison Corp., Mt. Prospect (IL)

( * ) Notice: Subject to any disclaimer, the term of this patent is extended or adjusted under 35 U.S.C. 154(b) by 86 days.

(21) Appl. No.: 16/226,020

(22) Filed: Dec. 19, 2018

(65) Prior Publication Data

US 2019/0139348 A1 May 9, 2019

Related U.S. Application Data

(62) Division of application No. 15/782,343, filed on Oct. 12, 2017, now Pat. No. 10,181,234.
(Continued)

(51) Int. Cl.

| | |
|---|---|
| ***G07D 3/12*** | (2006.01) |
| *G07D 5/02* | (2006.01) |
| *G07D 9/00* | (2006.01) |

(52) U.S. Cl.
CPC ..... *G07D 3/128* (2013.01); *G07D 3/121* (2013.01); *G07D 5/02* (2013.01); *G07D 9/008* (2013.01)

(58) Field of Classification Search
CPC ..... G07D 3/128; G07D 3/121; G07D 5/02; G07D 9/008; G07D 3/16; G07D 3/125;
(Continued)

(56) References Cited

U.S. PATENT DOCUMENTS 1,099,706 A 6/1914 Lindeen ..... 141/298
2,570,920 A 10/1951 Clough et al. ..... 232/16
(Continued)

FOREIGN PATENT DOCUMENTS

CA 2235925 C 11/1995 ..... G07D 9/00
CA 2189330 C 12/2000 ..... G07F 17/42
(Continued)

OTHER PUBLICATIONS

CA App. No. 2,982,329 Examiner's Report (dated Aug. 22, 2019)—4 pages.

(Continued)

*Primary Examiner* — Jeffrey A Shapiro

(57) ABSTRACT

According to some embodiments, a coin chute for receiving coins exiting from a coin sorting system comprising a rotatable disc for imparting motion to the plurality of coins, a stationary sorting head having a lower surface generally parallel to and spaced slightly away from the resilient pad, the lower surface forming a coin path for directing the movement of each of the coins, and a reject slot, wherein coins exiting the reject slot travel in a first generally horizontal direction is provided. The coin chute comprises a lower tapered surface having a generally funnel shape having a larger perimeter at its top than near its bottom; and an upper generally vertical wall having an angled portion at an angle from the first horizontal direction coins exit the reject slot, the portion being positioned such that coins exiting the reject slot contact the angled portion and are directed in a generally horizontal second direction.

19 Claims, 26 Drawing Sheets

Related U.S. Application Data

(60) Provisional application No. 62/409,656, filed on Oct. 18, 2016.

(58) Field of Classification Search
CPC ..... G07D 3/126; G07D 11/14; G07F 1/00; G07F 1/02; G07F 1/04
USPC ..... 193/DIG. 1; 194/203, 344, 346, 351; 453/6, 10, 12, 13, 33–35, 49, 57
See application file for complete search history.

(56) References Cited

U.S. PATENT DOCUMENTS 2,669,998 A 2/1954 Buchholz ..... 133/8
2,750,949 A 6/1956 Kulo et al. ..... 133/8
2,835,260 A 5/1958 Buchholz ..... 133/8
2,865,561 A 12/1958 Rosapepe ..... 232/7
3,095,084 A 6/1963 Byron ..... G07D 9/00
3,132,654 A 5/1964 Adams ..... 133/1
3,376,970 A 4/1968 Roseberg ..... 198/40
3,457,695 A 7/1969 Mccolough et al. ... B65B 9/213
3,603,327 A 9/1971 Buchholz ..... G07D 9/00
3,771,583 A 11/1973 Bottemiller ..... 160/327
3,778,595 A 12/1973 Hatanaka et al. ..... 235/61.7 B
3,851,755 A 12/1974 Hull et al. ..... 206/0.82
3,916,922 A 11/1975 Prumm ..... 133/3 R
3,998,237 A 12/1976 Kressin ..... 133/3 A
3,998,379 A 12/1976 Myers et al. ..... 229/33
4,050,218 A 9/1977 Call ..... 53/167
4,059,122 A 11/1977 Kinoshita ..... 133/3 D
4,075,460 A 2/1978 Gorgens ..... 235/420
4,124,111 A 11/1978 Hayashi ..... 194/102
4,150,740 A 4/1979 Douno ..... 194/4 C
4,166,945 A 9/1979 Inoyama et al. ..... 235/379
4,172,462 A 10/1979 Uchida et al. ..... 133/3 A
4,173,232 A 11/1979 Asami ..... G07D 3/00
4,179,685 A 12/1979 O'Maley ..... 340/146.3 H
4,179,723 A 12/1979 Spencer ..... 361/384
4,184,366 A 1/1980 Butler ..... 73/163
4,197,986 A 4/1980 Nagata ..... 235/379
4,208,549 A 6/1980 Polillo et al. ..... 179/6.3 R
4,228,812 A 10/1980 Marti ..... 133/3 F
4,232,295 A 11/1980 McConnell ..... 340/152 R
4,234,003 A 11/1980 Ristvedt et al. ..... 133/3
4,249,552 A 2/1981 Margolin et al. ..... 133/1 R
4,251,867 A 2/1981 Uchida et al. ..... 364/408
4,286,703 A 9/1981 Schuller et al. ..... 194/100 A
RE30,773 E 10/1981 Glaser et al. ..... 235/379
4,310,885 A 1/1982 Azcua et al. ..... 364/405
4,317,957 A 3/1982 Sendrow ..... 178/22.08
4,341,951 A 7/1982 Benton ..... 235/379
4,355,369 A 10/1982 Garvin ..... 364/900
4,360,034 A 11/1982 Davila et al. ..... 133/3 D
4,369,442 A 1/1983 Werth et al. ..... 340/825.35
4,380,316 A 4/1983 Glinka et al. ..... 232/16
4,383,540 A 5/1983 DeMeyer et al. ..... 133/3 H
4,385,285 A 5/1983 Horst et al. ..... 382/3
4,412,292 A 10/1983 Sedam et al. ..... 364/479
4,416,299 A 11/1983 Bergman ..... 133/1 R
4,417,136 A 11/1983 Rushby et al. ..... 235/379
4,423,316 A 12/1983 Sano et al. ..... 235/379
4,434,359 A 2/1984 Watanabe ..... 235/379
4,436,103 A 3/1984 Dick ..... 133/3 D
4,454,414 A 6/1984 Benton ..... 235/379
4,474,197 A 10/1984 Kinoshita et al. ..... 133/4 A
4,488,116 A 12/1984 Plesko ..... 324/236
4,531,531 A 7/1985 Johnson et al. ..... 133/3
4,543,969 A 10/1985 Rasmussen ..... 133/3
4,549,561 A 10/1985 Johnson et al. ..... 133/3
4,556,140 A 12/1985 Okada ..... 194/4 C
4,558,711 A 12/1985 Yoshiaki et al. ..... 133/3 F
4,564,036 A 1/1986 Ristvedt ..... 133/3
4,570,655 A 2/1986 Raterman ..... 133/3
4,594,664 A 6/1986 Hashimoto ..... 364/405
4,602,332 A 7/1986 Hirose et al. ..... 364/408
4,607,649 A 8/1986 Taipale et al. ..... 133/3 C
4,620,559 A 11/1986 Childers et al. ..... 133/3 R
4,641,239 A 2/1987 Takesako ..... 364/408
4,674,260 A 6/1987 Rasmussen et al. ..... 53/212
4,681,128 A 7/1987 Ristvedt et al. ..... 453/6
4,705,154 A 11/1987 Masho et al. ..... 194/319
4,718,218 A 1/1988 Ristvedt ..... 133/3
4,731,043 A 3/1988 Ristvedt et al. ..... 453/6
4,733,765 A 3/1988 Watanabe ..... 194/206
4,749,074 A 6/1988 Ueki et al. ..... 194/317
4,753,624 A 6/1988 Adams et al. ..... 453/10
4,753,625 A 6/1988 Okada ..... 453/32
4,765,464 A 8/1988 Ristvedt ..... 206/0.82
4,766,548 A 8/1988 Cedrone et al. ..... 364/479
4,767,090 A 8/1988 Hartman et al. ..... F16M 11/16
4,775,353 A 10/1988 Childers et al. ..... 453/6
4,775,354 A 10/1988 Rasmussen et al. ..... 453/10
4,778,983 A 10/1988 Ushikubo ..... 235/381
4,803,347 A 2/1989 Sugahara et al. ..... 235/379
4,804,830 A 2/1989 Miyagisima et al. ..... 235/379
4,812,629 A 3/1989 O'Neil et al. ..... 235/383
4,839,505 A 6/1989 Bradt et al. ..... 235/381
4,840,290 A 6/1989 Nakamura et al. ..... 221/10
4,844,369 A 7/1989 Kanayachi ..... 242/56 R
4,848,556 A 7/1989 Shah et al. ..... 194/212
4,863,414 A 9/1989 Ristvedt et al. ..... 453/6
4,883,158 A 11/1989 Kobayashi et al. ..... 194/217
4,884,212 A 11/1989 Stutsman ..... 364/479
4,900,909 A 2/1990 Nagashima et al. ..... 235/487
4,908,516 A 3/1990 West ..... 250/556
4,921,463 A 5/1990 Primdahl et al. ..... 453/3
4,936,435 A 6/1990 Griner ..... 194/317
4,953,086 A 8/1990 Fukatsu ..... 364/408
4,954,697 A 9/1990 Kokubun et al. ..... 235/381
4,964,495 A 10/1990 Rasmussen ..... 194/344
4,966,570 A 10/1990 Ristvedt et al. ..... 453/6
4,970,655 A 11/1990 Winn et al. ..... 364/479
4,971,187 A 11/1990 Furuya et al. ..... 194/318
4,971,188 A * 11/1990 Deters ..... G07D 3/14 194/337
4,988,849 A 1/1991 Sasaki et al. ..... 235/379
4,992,647 A 2/1991 Konishi et al. ..... 235/379
4,995,848 A 2/1991 Goh ..... 453/3
5,009,627 A 4/1991 Rasmussen ..... 453/10
5,010,238 A 4/1991 Kadono et al. ..... 235/379
5,010,485 A 4/1991 Bigari ..... 364/408
5,011,455 A 4/1991 Rasmussen ..... 453/10
5,022,889 A 6/1991 Ristvedt et al. ..... 453/6
5,025,139 A 6/1991 Halliburton, Jr. ..... 235/379
5,026,320 A 6/1991 Rasmussen ..... 453/6
5,031,098 A 7/1991 Miller et al. ..... 364/405
5,033,602 A 7/1991 Saarinen et al. ..... 194/334
5,039,848 A 8/1991 Stoken ..... 235/381
5,055,086 A 10/1991 Raterman et al. ..... 453/10
5,055,657 A 10/1991 Miller et al. ..... 235/381
5,056,643 A 10/1991 Kirberg ..... 194/202
5,064,999 A 11/1991 Okamoto et al. ..... 235/379
5,067,928 A 11/1991 Harris ..... 453/17
5,080,633 A 1/1992 Ristvedt et al. ..... 435/6
5,091,713 A 2/1992 Horne et al. ..... 340/541
5,104,353 A 4/1992 Ristvedt et al. ..... 453/6
5,105,601 A 4/1992 Horiguchi et al. ..... 53/465
5,106,338 A 4/1992 Rasmussen et al. ..... 453/10
5,111,927 A 5/1992 Schulze ..... 194/209
5,114,381 A 5/1992 Ueda et al. ..... 453/57
5,120,945 A 6/1992 Nishibe et al. ..... 235/379
5,123,873 A 6/1992 Rasmussen ..... 453/10
5,129,205 A 7/1992 Rasmussen ..... 53/52
5,135,435 A 8/1992 Rasmussen ..... 453/56
5,140,517 A 8/1992 Nagata et al. ..... 364/408
5,141,443 A 8/1992 Rasmussen et al. ..... 453/10
5,141,472 A 8/1992 Todd et al. ..... 453/10
5,145,455 A 9/1992 Todd ..... 453/6
5,146,067 A 9/1992 Sloan et al. ..... 235/381
5,154,272 A 10/1992 Nishiumi et al. ..... 194/318
5,163,866 A 11/1992 Rasmussen ..... 453/10
5,163,867 A 11/1992 Rasmussen ..... 453/10
5,163,868 A 11/1992 Adams et al. ..... 453/11
5,167,313 A 12/1992 Dobbins et al. ..... 194/317

(56) References Cited

U.S. PATENT DOCUMENTS

| | | | | |
|---|---|---|---|---|
| 5,167,571 | A | 12/1992 | Waller | G07D 9/00 |
| 5,175,416 | A | 12/1992 | Mansvelt et al. | 235/379 |
| 5,176,565 | A | 1/1993 | Ristvedt et al. | 453/6 |
| 5,179,517 | A | 1/1993 | Salbin et al. | 364/410 |
| 5,183,142 | A | 2/1993 | Latchinian et al. | 194/206 |
| 5,184,709 | A | 2/1993 | Nishiumi et al. | 194/318 |
| 5,194,037 | A | 3/1993 | Jones et al. | 453/10 |
| 5,197,919 | A | 3/1993 | Geib et al. | 453/10 |
| 5,205,780 | A | 4/1993 | Rasmussen | 453/10 |
| 5,207,784 | A | 5/1993 | Schwartzendruber | 221/6 |
| 5,209,696 | A | 5/1993 | Rasmussen et al. | 453/10 |
| 5,236,071 | A | 8/1993 | Lee | 194/200 |
| 5,243,174 | A | 9/1993 | Veeneman et al. | 235/381 |
| 5,251,738 | A | 10/1993 | Dabrowski | 194/206 |
| 5,252,811 | A | 10/1993 | Henochowicz et al. | 235/379 |
| 5,253,167 | A | 10/1993 | Yoshida et al. | 364/408 |
| 5,259,491 | A | 11/1993 | Ward, II | 194/350 |
| 5,263,566 | A | 11/1993 | Nara et al. | 194/318 |
| 5,265,874 | A | 11/1993 | Dickinson et al. | 273/138 A |
| 5,268,561 | A | 12/1993 | Kimura et al. | 235/384 |
| 5,277,651 | A | 1/1994 | Rasmussen et al. | 453/10 |
| 5,282,127 | A | 1/1994 | Mii | 364/130 |
| 5,286,226 | A | 2/1994 | Rasmussen | 453/10 |
| 5,286,954 | A | 2/1994 | Sato et al. | 235/379 |
| 5,291,003 | A | 3/1994 | Avnet et al. | 235/381 |
| 5,291,560 | A | 3/1994 | Daugman | 382/2 |
| 5,293,981 | A | 3/1994 | Abe et al. | 194/345 |
| 5,297,030 | A | 3/1994 | Vassigh et al. | 364/405 |
| 5,297,598 | A | 3/1994 | Rasmussen | 141/314 |
| 5,297,986 | A | 3/1994 | Ristvedt et al. | 453/6 |
| 5,299,977 | A | 4/1994 | Mazur et al. | 453/10 |
| 5,302,811 | A | 4/1994 | Fukatsu | 235/381 |
| 5,324,922 | A | 6/1994 | Roberts | 235/375 |
| 5,326,104 | A | 7/1994 | Pease et al. | 273/138 A |
| 5,370,575 | A | 12/1994 | Geib et al. | 453/3 |
| 5,372,542 | A | 12/1994 | Geib et al. | 453/10 |
| 5,374,814 | A | 12/1994 | Kako et al. | 235/379 |
| 5,379,344 | A | 1/1995 | Larson et al. | 380/23 |
| 5,379,875 | A | 1/1995 | Shames et al. | 194/317 |
| 5,382,191 | A | 1/1995 | Rasmussen | 453/11 |
| 5,390,776 | A | 2/1995 | Thompson | 194/346 |
| 5,401,211 | A | 3/1995 | Geib et al. | 453/10 |
| 5,404,986 | A | 4/1995 | Hossfield et al. | 194/317 |
| 5,410,590 | A | 4/1995 | Blood et al. | 379/147 |
| RE34,934 | E | 5/1995 | Raterman et al. | 453/10 |
| 5,425,669 | A | 6/1995 | Geib et al. | 453/10 |
| 5,429,550 | A | 7/1995 | Mazur et al. | 453/10 |
| 5,440,108 | A | 8/1995 | Tran et al. | 235/381 |
| 5,443,419 | A | 8/1995 | Adams et al. | 453/17 |
| 5,450,938 | A | 9/1995 | Rademacher | 194/206 |
| 5,453,047 | A | 9/1995 | Mazur et al. | 453/10 |
| 5,458,285 | A | 10/1995 | Remien | 232/15 |
| 5,468,182 | A | 11/1995 | Geib | 453/10 |
| 5,470,079 | A | 11/1995 | LeStrange et al. | 273/138 A |
| 5,472,381 | A | 12/1995 | Ayre, Jr. | A63D 1/04 |
| 5,474,495 | A | 12/1995 | Geib et al. | 453/3 |
| 5,474,497 | A | 12/1995 | Jones et al. | 453/17 |
| 5,480,348 | A | 1/1996 | Mazur et al. | 453/10 |
| 5,481,790 | A | 1/1996 | Koreis et al. | B01J 3/00 |
| 5,489,237 | A | 2/1996 | Geib et al. | 453/12 |
| 5,500,514 | A | 3/1996 | Veeneman et al. | 235/381 |
| 5,501,631 | A * | 3/1996 | Mennie | G07F 13/025 453/3 |
| 5,507,379 | A | 4/1996 | Mazur et al. | 194/318 |
| 5,514,034 | A | 5/1996 | Jones et al. | 453/10 |
| 5,520,577 | A | 5/1996 | Rasmussen | 453/56 |
| 5,531,309 | A | 7/1996 | Kloss et al. | 194/202 |
| 5,531,640 | A * | 7/1996 | Inoue | G07D 1/02 453/17 |
| 5,538,468 | A | 7/1996 | Ristvedt et al. | 453/3 |
| 5,542,880 | A | 8/1996 | Geib et al. | 453/10 |
| 5,542,881 | A | 8/1996 | Geib | 453/10 |
| 5,553,320 | A | 9/1996 | Matsuura et al. | 235/379 |
| 5,559,887 | A | 9/1996 | Davis et al. | 380/24 |
| 5,564,546 | A | 10/1996 | Molbak et al. | 194/216 |
| 5,564,974 | A | 10/1996 | Mazur et al. | 453/10 |
| 5,564,978 | A | 10/1996 | Jones et al. | 453/17 |
| 5,570,465 | A | 10/1996 | Tsakanikas | 395/114 |
| 5,573,457 | A | 11/1996 | Watts et al. | 453/31 |
| 5,584,758 | A | 12/1996 | Geib | 453/10 |
| 5,592,377 | A | 1/1997 | Lipkin | 395/242 |
| 5,602,933 | A | 2/1997 | Blackwell et al. | 382/116 |
| 5,615,625 | A | 4/1997 | Cassidy et al. | 109/45 |
| 5,620,079 | A | 4/1997 | Molbak | 194/217 |
| 5,623,547 | A | 4/1997 | Jones et al. | 380/24 |
| 5,625,562 | A | 4/1997 | Veeneman et al. | 364/479.05 |
| 5,630,494 | A | 5/1997 | Strauts | 194/317 |
| 5,641,050 | A | 6/1997 | Smith et al. | 194/210 |
| 5,650,605 | A | 7/1997 | Morioka et al. | 235/379 |
| 5,650,761 | A | 7/1997 | Gomm et al. | 235/381 |
| 5,652,421 | A | 7/1997 | Veeneman et al. | 235/381 |
| 5,665,952 | A | 9/1997 | Ziarno | 235/380 |
| 5,679,070 | A | 10/1997 | Ishida et al. | 453/41 |
| 5,684,597 | A | 11/1997 | Hossfield et al. | 356/384 |
| 5,696,366 | A | 12/1997 | Ziarno | 235/380 |
| 5,743,373 | A | 4/1998 | Strauts | 194/318 |
| 5,746,299 | A | 5/1998 | Molbak et al. | 194/200 |
| 5,774,874 | A | 6/1998 | Veeneman et al. | 705/27 |
| 5,782,686 | A | 7/1998 | Geib et al. | 453/10 |
| 5,799,767 | A | 9/1998 | Molbak | 194/217 |
| 5,813,510 | A | 9/1998 | Rademacher | 194/206 |
| 5,823,315 | A | 10/1998 | Hoffman et al. | 194/203 |
| 5,830,054 | A | 11/1998 | Petri | 453/5 |
| 5,838,812 | A | 11/1998 | Pare, Jr. et al. | 382/115 |
| 5,842,188 | A | 11/1998 | Ramsey et al. | 705/416 |
| 5,842,916 | A | 12/1998 | Gerrity et al. | 453/57 |
| 5,850,076 | A | 12/1998 | Morioka et al. | 235/379 |
| 5,854,581 | A | 12/1998 | Mori et al. | 235/379 |
| 5,865,673 | A | 2/1999 | Geib et al. | 453/10 |
| 5,875,879 | A | 3/1999 | Hawthorn | 194/350 |
| 5,880,444 | A | 3/1999 | Shibata et al. | 235/379 |
| 5,892,211 | A | 4/1999 | Davis et al. | 235/380 |
| 5,892,827 | A | 4/1999 | Beach et al. | 380/24 |
| 5,909,793 | A | 6/1999 | Beach et al. | 194/210 |
| 5,909,794 | A | 6/1999 | Molbak et al. | 194/216 |
| 5,913,399 | A | 6/1999 | Takemoto et al. | 194/200 |
| 5,918,748 | A | 7/1999 | Clark et al. | 209/534 |
| 5,940,623 | A | 8/1999 | Watts et al. | 395/712 |
| 5,941,364 | A | 8/1999 | Wei | 194/350 |
| 5,944,162 | A | 8/1999 | Filiberti | 194/204 |
| 5,944,600 | A | 8/1999 | Zimmermann | 435/10 |
| 5,944,601 | A | 8/1999 | Hayashi et al. | 453/61 |
| 5,951,476 | A | 9/1999 | Beach et al. | 600/437 |
| 5,957,262 | A | 9/1999 | Molbak et al. | 194/200 |
| 5,988,348 | A | 11/1999 | Martin et al. | 194/317 |
| 5,995,949 | A | 11/1999 | Morioka et al. | 705/43 |
| 5,997,395 | A | 12/1999 | Geib et al. | 453/10 |
| 6,017,270 | A | 1/2000 | Ristvedt et al. | 453/5 |
| 6,021,883 | A | 2/2000 | Casanova et al. | 194/217 |
| 6,032,859 | A | 3/2000 | Muehlberger et al. | 235/449 |
| 6,039,644 | A | 3/2000 | Geib et al. | 453/10 |
| 6,039,645 | A | 3/2000 | Mazur | 453/10 |
| 6,042,470 | A | 3/2000 | Geib et al. | 453/10 |
| 6,047,807 | A | 4/2000 | Molbak | 194/217 |
| 6,047,808 | A | 4/2000 | Neubarth et al. | 194/317 |
| 6,056,104 | A | 5/2000 | Neubarth et al. | 194/317 |
| 6,068,194 | A | 5/2000 | Mazur | 235/492 |
| 6,080,056 | A | 6/2000 | Karlsson | 453/3 |
| 6,082,519 | A | 7/2000 | Martin et al. | 194/350 |
| 6,086,471 | A | 7/2000 | Zimmermann | 453/3 |
| 6,095,313 | A | 8/2000 | Molbak et al. | 194/344 |
| 6,116,402 | A | 9/2000 | Beach et al. | 194/216 |
| 6,131,625 | A | 10/2000 | Casanova et al. | 141/314 |
| 6,139,418 | A | 10/2000 | Geib et al. | 453/10 |
| 6,142,285 | A | 11/2000 | Panzeri et al. | 194/328 |
| 6,145,738 | A | 11/2000 | Stinson et al. | 235/379 |
| 6,154,879 | A | 11/2000 | Pare, Jr. et al. | 902/3 |
| 6,168,001 | B1 | 1/2001 | Davis | 194/200 |
| 6,171,182 | B1 | 1/2001 | Geib et al. | 453/10 |
| 6,174,230 | B1 | 1/2001 | Gerrity et al. | 453/57 |
| 6,196,371 | B1 | 3/2001 | Martin et al. | 194/317 |
| 6,196,913 | B1 | 3/2001 | Geib et al. | 453/10 |
| 6,202,006 | B1 | 3/2001 | Scott | 700/231 |
| 6,213,277 | B1 | 4/2001 | Blad et al. | 194/350 |

(56) References Cited

U.S. PATENT DOCUMENTS 6,230,928 B1 5/2001 Hanna et al. ..... 221/13
6,264,545 B1 7/2001 Magee et al. ..... 453/3
6,302,294 B1 10/2001 Collier et al. ..... G07D 1/00
6,308,887 B1 10/2001 Korman et al. ..... 235/379
6,318,536 B1 11/2001 Korman et al. ..... 194/217
6,318,537 B1 11/2001 Jones et al. ..... 194/346
6,340,082 B1 1/2002 House et al. ..... G07D 5/02
6,349,972 B1 2/2002 Geiger et al. ..... 283/67
6,386,323 B1 5/2002 Ramachandran et al. ..... 186/36
6,412,620 B1 7/2002 Imura ..... 194/317
6,431,342 B1 8/2002 Schwartz ..... 194/346
6,438,230 B1 8/2002 Moore ..... 380/42
6,456,928 B1 9/2002 Johnson ..... 701/114
6,471,030 B1 10/2002 Neubarth et al. ..... 194/317
6,474,548 B1 11/2002 Montross et al. ..... 235/379
6,484,863 B1 11/2002 Molbak ..... 194/216
6,484,884 B1 11/2002 Gerrity et al. ..... 209/233
6,494,776 B1 12/2002 Molbak ..... 453/32
6,499,277 B1 12/2002 Warner et al. ..... 53/447
6,503,138 B2 1/2003 Spoehr et al. ..... 453/10
6,520,308 B1 2/2003 Martin et al. ..... 194/317
6,522,772 B1 2/2003 Morrison et al. ..... 382/124
6,547,131 B1 4/2003 Foodman et al. ..... 235/380
6,552,781 B1 4/2003 Rompel et al. ..... 256/71
6,554,185 B1 4/2003 Montross et al. ..... 235/379
6,569,006 B1 * 5/2003 Kurosawa ..... G07D 9/008 453/13
6,579,165 B2 6/2003 Kuhlin et al. ..... 453/3
6,581,042 B2 6/2003 Pare, Jr. et al. ..... 705/40
6,602,125 B2 8/2003 Martin ..... 453/12
6,609,604 B1 8/2003 Jones et al. ..... 194/302
6,612,921 B2 9/2003 Geib et al. ..... 453/13
6,637,576 B1 10/2003 Jones et al. ..... 194/216
6,640,956 B1 11/2003 Zwieg et al. ..... 194/328
6,644,696 B2 11/2003 Brown et al. ..... 283/67
6,652,380 B1 11/2003 Luciano ..... 463/25
6,655,585 B2 12/2003 Shinn ..... 235/382
6,659,259 B2 12/2003 Knox et al. ..... 194/217
6,662,166 B2 12/2003 Pare, Jr. et al. ..... 705/39
6,663,675 B2 12/2003 Blake et al. ..... 753/63
6,666,318 B2 12/2003 Gerrity et al. ..... 194/347
6,719,121 B2 4/2004 Alexander et al. ..... 194/350
6,755,730 B2 6/2004 Geib et al. ..... 453/3
6,758,316 B2 7/2004 Molbak ..... 194/200
6,761,308 B1 7/2004 Hanna et al. ..... 235/379
6,766,892 B2 7/2004 Martin et al. ..... 194/317
6,783,452 B2 8/2004 Hino et al. ..... 453/3
6,786,398 B1 9/2004 Stinson et al. ..... 235/379
6,854,581 B2 2/2005 Molbak ..... 194/344
6,854,640 B2 2/2005 Peklo ..... 235/100
6,863,168 B1 3/2005 Gerrity et al. ..... 194/347
6,892,871 B2 5/2005 Strauts et al. ..... 194/302
6,896,118 B2 5/2005 Jones et al. ..... 194/217
6,928,546 B1 8/2005 Nanavati et al. ..... 713/186
6,950,810 B2 9/2005 Lapsley et al. ..... 705/78
6,953,150 B2 10/2005 Shepley et al. ..... 235/379
6,957,746 B2 10/2005 Martin et al. ..... 221/131
6,966,417 B2 11/2005 Peklo et al. ..... 194/344
6,976,570 B2 12/2005 Molbak ..... 194/215
6,977,096 B2 12/2005 Leclaire ..... C23C 4/02
6,988,606 B2 1/2006 Geib et al. ..... 194/334
6,991,530 B2 1/2006 Hino et al. ..... 453/3
7,004,831 B2 2/2006 Hino et al. ..... 453/5
7,014,029 B2 3/2006 Winters ..... 194/302
7,014,108 B2 3/2006 Sorenson et al. ..... 235/381
7,017,729 B2 3/2006 Gerrity et al. ..... 194/347
7,018,286 B2 3/2006 Blake et al. ..... 453/61
7,028,827 B1 4/2006 Molbak et al. ..... 194/346
7,036,651 B2 5/2006 Tam et al. ..... 194/217
7,083,036 B2 8/2006 Adams ..... 194/223
7,111,754 B1 9/2006 Siemens ..... G07F 11/04
7,113,929 B1 9/2006 Beach et al. ..... 705/65
7,131,580 B2 11/2006 Molbak ..... 235/379
7,149,336 B2 12/2006 Jones et al. ..... 382/135
7,152,727 B2 12/2006 Waechter ..... 194/317
7,158,662 B2 1/2007 Chiles ..... 382/135
7,188,720 B2 3/2007 Geib et al. ..... 194/302
7,213,697 B2 5/2007 Martin et al. ..... 194/317
7,243,773 B2 7/2007 Bochonok et al. ..... 194/350
7,269,279 B2 9/2007 Chiles ..... 382/135
7,303,119 B2 12/2007 Molbak ..... 235/379
7,331,521 B2 2/2008 Sorenson et al. ..... 235/381
7,337,890 B2 3/2008 Bochonok et al. ..... 194/353
7,427,230 B2 9/2008 Blake et al. ..... 453/63
7,438,172 B2 10/2008 Long et al. ..... 194/347
7,464,802 B2 12/2008 Gerrity et al. ..... 194/347
7,500,568 B2 3/2009 Cousin ..... 209/534
7,520,374 B2 4/2009 Martin et al. ..... 194/317
7,551,764 B2 6/2009 Chiles et al. ..... 382/135
7,552,810 B2 6/2009 Mecklenburg ..... 194/317
7,580,859 B2 8/2009 Economy ..... 705/16
7,604,107 B2 10/2009 Richard et al. ..... 194/351
7,654,450 B2 2/2010 Mateen et al. ..... 235/379
7,658,270 B2 2/2010 Bochonok et al. ..... 194/350
7,735,125 B1 6/2010 Alvarez et al. ..... 726/9
7,743,902 B2 6/2010 Wendell et al. ..... 194/302
7,778,456 B2 8/2010 Jones et al. ..... 382/135
7,819,308 B2 10/2010 Osterberg et al. ..... 235/379
7,874,478 B2 1/2011 Molbak ..... 235/379
7,886,890 B2 2/2011 Blake et al. ..... 194/347
7,931,304 B2 4/2011 Brown et al. ..... 283/57
7,946,406 B2 5/2011 Blake et al. ..... 194/200
7,949,582 B2 5/2011 Mennie et al. ..... 705/35
7,963,382 B2 6/2011 Wendell et al. ..... 194/302
7,980,378 B2 7/2011 Jones et al. ..... 194/217
8,023,715 B2 9/2011 Jones et al. ..... 382/135
8,042,732 B2 10/2011 Blake et al. ..... 235/375
8,229,821 B2 7/2012 Mennie et al. ..... 232/16
8,346,610 B2 1/2013 Mennie et al. ..... 705/16
8,352,322 B2 1/2013 Mennie et al. ..... 705/16
8,393,455 B2 3/2013 Blake et al. ..... 194/350
8,443,958 B2 5/2013 Jones et al. ..... 194/215
RE44,252 E 6/2013 Jones et al. ..... 194/217
8,523,641 B2 9/2013 Kuykendall et al. ..... 194/217
8,545,295 B2 10/2013 Blake et al. ..... 453/4
8,602,200 B2 12/2013 Blake ..... 194/216
8,607,957 B2 12/2013 Blake et al. ..... 194/344
8,616,359 B2 12/2013 Bochonok et al. ..... 194/202
RE44,689 E 1/2014 Wendell et al. ..... 194/302
8,684,159 B2 4/2014 Blake ..... 194/216
8,684,160 B2 4/2014 Hallowell et al. ..... 194/344
8,701,860 B1 4/2014 Blake et al. ..... 194/350
8,950,566 B2 2/2015 Hallowell et al. ..... 194/206
8,959,029 B2 2/2015 Jones et al. ..... 705/18
9,092,924 B1 7/2015 Rasmussen et al. ..... 453/3
9,330,515 B1 5/2016 Rasmussen et al. ..... 453/3
9,384,614 B2 7/2016 Tatsuo et al. ..... G07D 1/00
9,430,893 B1 8/2016 Blake et al. ..... G07D 3/16
9,437,069 B1 9/2016 Blake et al. ..... G07D 13/00
9,501,885 B1 11/2016 Yacoubian et al. ..... G07D 3/14
9,508,208 B1 11/2016 Jagielinski et al. ..... G07D 3/14
9,633,500 B1 4/2017 Blake et al. ..... G07D 3/16
9,830,762 B1 11/2017 Blake et al. ..... G07D 3/16
9,870,668 B1 1/2018 Jagielinski et al. ..... G07D 5/08
9,875,593 B1 1/2018 Adams et al. ..... G07D 3/06
9,916,713 B1 3/2018 Yacoubian et al. ..... G07D 11/0036
9,934,640 B2 4/2018 Blake et al. ..... G07D 9/00
10,043,333 B1 8/2018 Adams et al. ..... G07D 3/06
10,049,521 B1 8/2018 Blake et al. ..... G07D 3/00
10,068,406 B1 9/2018 Jagielinski et al. ..... G07D 5/08
10,089,812 B1 10/2018 Blake et al. ..... G07D 9/008
10,181,234 B2 1/2019 Rasmussen et al. ... G07D 3/128
2001/0015310 A1 8/2001 Cole ..... G07D 9/00
2001/0034203 A1 10/2001 Geib et al. ..... 453/3
2001/0048025 A1 12/2001 Shinn ..... 235/382
2002/0000543 A1 1/2002 Arthur ..... E01F 15/04
2002/0001393 A1 1/2002 Jones et al. ..... G06K 9/00
2002/0035515 A1 3/2002 Moreno ..... A47G 29/14
2002/0065033 A1 5/2002 Geib et al. ..... 453/3
2002/0069104 A1 6/2002 Beach et al. ..... 705/14
2002/0074209 A1 6/2002 Karlsson ..... 194/330
2002/0077937 A1 6/2002 Lyons et al. ..... G06Q 10/00
2002/0085745 A1 7/2002 Jones et al. ..... 382/135

(56) References Cited

U.S. PATENT DOCUMENTS

2002/0095587 A1 7/2002 Doyle et al. ..... 713/186
2002/0107738 A1 8/2002 Beach et al. ..... 705/14
2002/0116887 A1 8/2002 Niday et al. ..... E04C 5/16
2002/0126885 A1 9/2002 Mennie et al. ..... 382/135
2002/0130011 A1 9/2002 Casanova et al. ..... 194/344
2002/0147588 A1 10/2002 Davis et al. ..... 704/246
2002/0151267 A1 10/2002 Kuhlin et al. ..... 453/3
2002/0162724 A1 11/2002 Hino et al. ..... G06M 1/00
2002/0174348 A1 11/2002 Ting ..... 713/186
2002/0179401 A1 12/2002 Knox et al. ..... 194/217
2003/0004878 A1 1/2003 Akutsu et al. ..... 705/43
2003/0013403 A1 1/2003 Blake et al. ..... 453/60
2003/0042110 A1 3/2003 Wilfong ..... 194/302
2003/0081824 A1 5/2003 Mennie et al. ..... 382/135
2003/0124966 A1 7/2003 Hino et al. ..... G07D 3/00
2003/0127299 A1 7/2003 Jones et al. ..... 194/217
2003/0168309 A1 9/2003 Geib et al. ..... 194/302
2003/0168310 A1 9/2003 Strauts et al. ..... 194/302
2003/0182217 A1 9/2003 Chiles ..... 705/35
2003/0190882 A1 10/2003 Blake et al. ..... 453/63
2003/0230464 A1 12/2003 Deaville et al. ..... 194/302
2003/0234153 A1 12/2003 Blake et al. ..... 194/347
2004/0016796 A1 1/2004 Hanna et al. ..... G07D 1/00
2004/0021898 A1 2/2004 Ashizaki ..... 358/1.15
2004/0055902 A1 3/2004 Peklo ..... 206/0.815
2004/0092222 A1 5/2004 Kowalczyk et al. ..... 453/12
2004/0116063 A1* 6/2004 Takamisawa ..... B65G 47/145 453/55
2004/0153207 A1 8/2004 Peck ..... B65G 1/137
2004/0153406 A1 8/2004 Alarcon-Luther et al. ..... 705/41
2004/0153421 A1 8/2004 Robinson ..... 705/75
2004/0154899 A1 8/2004 Peklo et al. ..... 193/33
2004/0167821 A1 8/2004 Baumgartner ..... G06Q 20/20
2004/0173432 A1 9/2004 Jones ..... 194/216
2004/0188221 A1 9/2004 Carter ..... 194/215
2004/0193310 A1 9/2004 Clark ..... C12Q 1/68
2004/0195302 A1 10/2004 Washington et al. ..... 232/15
2004/0199924 A1 10/2004 Ganesh et al. ..... 719/313
2004/0200691 A1 10/2004 Geib et al. ..... 194/302
2004/0231956 A1 11/2004 Adams et al. ..... G07D 3/00
2004/0238319 A1 12/2004 Hand et al. ..... 194/207
2004/0238614 A1 12/2004 Yoshioka et al. ..... 232/7
2004/0254861 A1 12/2004 Pentel ..... G06Q 20/10
2004/0256197 A1 12/2004 Blake et al. ..... 194/350
2004/0259490 A1 12/2004 Hino et al. ..... G07D 3/00
2005/0006197 A1 1/2005 Wendell et al. ..... 194/302
2005/0035140 A1 2/2005 Carter ..... 221/195
2005/0040007 A1 2/2005 Geib et al. ..... 194/302
2005/0040225 A1 2/2005 Csulits et al. ..... 235/379
2005/0045450 A1 3/2005 Geib et al. ..... 194/318
2005/0067305 A1 3/2005 Bochonok et al. ..... 206/8
2005/0068178 A1 3/2005 Lee et al. ..... G06Q 10/00
2005/0077142 A1 4/2005 Tam et al. ..... 194/217
2005/0086140 A1 4/2005 Ireland et al. ..... 705/35
2005/0087425 A1 4/2005 Peklo ..... 194/350
2005/0091161 A1 4/2005 Gustin et al. ..... G06Q 20/04
2005/0096986 A1 5/2005 Taylor et al. ..... 705/16
2005/0098625 A1 5/2005 Walker et al. ..... 235/381
2005/0108165 A1 5/2005 Jones et al. ..... 705/43
2005/0109836 A1 5/2005 Ben-Aissa ..... 235/380
2005/0121507 A1 6/2005 Brown et al. ..... 235/379
2005/0124407 A1 6/2005 Rowe ..... 463/25
2005/0150740 A1 7/2005 Finkenzeller et al. ..... 194/207
2005/0156318 A1 7/2005 Douglas ..... 257/761
2005/0205654 A1 9/2005 Carter ..... 235/7 R
2005/0205655 A1 9/2005 Carter ..... 235/7 R
2005/0228717 A1 10/2005 Gusler et al. ..... 705/14
2005/0233684 A1 10/2005 Abe et al. ..... A63F 5/04
2005/0256792 A1 11/2005 Shimizu et al. ..... 705/35
2006/0037835 A1 2/2006 Doran et al. ..... 194/302
2006/0054455 A1 3/2006 Kuykendall et al. ..... 194/217
2006/0054457 A1 3/2006 Long et al. ..... 194/347
2006/0060363 A2 3/2006 Carter ..... 172/111
2006/0064379 A1 3/2006 Doran et al. ..... 705/42
2006/0065717 A1 3/2006 Hurwitz et al. ..... 235/381
2006/0069654 A1 3/2006 Beach et al. ..... 705/65
2006/0112007 A1 5/2006 Hurwitz et al. ..... G06Q 40/00
2006/0146839 A1 7/2006 Hurwitz et al. ..... 370/401
2006/0148394 A1 7/2006 Blake et al. ..... 453/12
2006/0149415 A1 7/2006 Richards ..... 700/236
2006/0151285 A1 7/2006 String ..... 194/350
2006/0154589 A1 7/2006 String ..... 453/11
2006/0163029 A1 7/2006 Wollny ..... G07D 5/00
2006/0175176 A1 8/2006 Blake ..... 194/216
2006/0182330 A1 8/2006 Chiles ..... 382/135
2006/0196754 A1 9/2006 Bochonok et al. ..... 194/347
2006/0205481 A1 9/2006 Dominelli ..... 463/25
2006/0207856 A1 9/2006 Dean et al. ..... 194/302
2006/0219519 A1 10/2006 Molbak et al. ..... 194/346
2006/0253332 A1 11/2006 Dobbins ..... 705/21
2006/0283685 A1 12/2006 Cousin ..... 194/217
2007/0051582 A1 3/2007 Bochonok et al. ..... 194/202
2007/0071302 A1 3/2007 Jones et al. ..... 382/135
2007/0108015 A1 5/2007 Bochonok et al. ..... 194/350
2007/0108267 A1 5/2007 Jonsson et al. ..... G07F 19/00
2007/0119681 A1 5/2007 Blake et al. ..... 194/215
2007/0181676 A1 8/2007 Mateen et al. ..... 235/381
2007/0187494 A1 8/2007 Hanna ..... 235/383
2007/0221470 A1 9/2007 Mennie et al. ..... 194/216
2007/0251800 A1 11/2007 Castleberry ..... 194/219
2007/0269097 A1 11/2007 Chiles et al. ..... 382/135
2007/0270997 A1 11/2007 Brumfield et al. ..... 700/214
2008/0033829 A1 2/2008 Mennie et al. ..... 705/16
2008/0044077 A1 2/2008 Mennie et al. ..... 382/135
2008/0135608 A1 6/2008 Ireland et al. ..... 232/1 D
2008/0220707 A1 9/2008 Jones et al. ..... 453/2
2008/0223930 A1 9/2008 Rolland et al. ..... 235/385
2009/0018959 A1 1/2009 Doran et al. ..... 705/44
2009/0236200 A1 9/2009 Hallowell et al. ..... 194/215
2009/0236201 A1 9/2009 Blake et al. ..... 194/215
2009/0239459 A1 9/2009 Watts et al. ..... 453/18
2009/0242626 A1 10/2009 Jones et al. ..... 235/379
2009/0320106 A1 12/2009 Jones et al. ..... 726/5
2010/0017017 A1 1/2010 Adams et al. ..... G06F 7/00
2010/0038419 A1 2/2010 Blake et al. ..... 235/379
2010/0041289 A1 2/2010 Spencer et al. ..... B63B 22/00
2010/0065623 A1 3/2010 Sauter ..... 232/1 D
2010/0155193 A1 6/2010 Gunst et al. ..... G07F 9/10
2010/0198726 A1 8/2010 Doran et al. ..... 705/41
2010/0234985 A1 9/2010 Shuren et al. ..... 700/223
2010/0261421 A1* 10/2010 Wendell ..... G07D 3/16 453/4
2010/0276485 A1 11/2010 Jones et al. ..... 235/379
2010/0327005 A1 12/2010 Martin et al. ..... 221/98
2011/0098845 A1 4/2011 Mennie et al. ..... 700/223
2011/0099105 A1 4/2011 Mennie et al. ..... 705/41
2011/0189932 A1 8/2011 Adams et al. ..... G07D 3/00
2011/0259961 A1 10/2011 Fold et al. ..... 235/385
2011/0270695 A1 11/2011 Jones et al. ..... 705/43
2012/0067950 A1 3/2012 Blake ..... 235/381
2012/0156976 A1 6/2012 Blake et al. ..... 453/4
2012/0301009 A1 11/2012 Dabic ..... G06K 9/62
2013/0178139 A1 7/2013 Hallowell et al. ..... 453/15
2013/0199890 A1 8/2013 Blake ..... 194/216
2013/0205723 A1 8/2013 Blake et al. ..... 53/473
2014/0335770 A1 11/2014 Martin ..... G07D 3/00
2015/0302678 A1 10/2015 Blake et al.
2017/0221292 A1* 8/2017 Watanabe ..... G07G 1/0036
2018/0108198 A1 4/2018 Rasmussen et al. ... G07D 3/128
2018/0108199 A1 4/2018 Blake et al. ..... G07D 9/06

FOREIGN PATENT DOCUMENTS

CA 2143943 C 3/2003 ..... G07D 3/16
CA 2660418 A1 9/2009 ..... G07D 9/04
DE 06 60 354 5/1938 ..... G06F 17/26
DE 30 21 327 A1 12/1981 ..... G07D 3/06
EP 0 351 217 A2 1/1990 ..... G06F 9/04
EP 0 667 973 B1 1/1997 ..... G07D 3/14
EP 0 926 634 A2 6/1999 ..... G07D 3/14
EP 1 104 920 A1 6/2001 ..... G07D 5/08
EP 1 209 639 A2 5/2002 ..... G07F 19/00
EP 1 528 513 A1 5/2005 ..... G07F 7/08
FR 2042254 2/1971 ..... G07B 11/00

(56) References Cited

FOREIGN PATENT DOCUMENTS

| | | | | |
|---|---|---|---|---|
| GB | 2035642 | A | 6/1980 | G07F 7/10 |
| GB | 2175427 | A | 11/1986 | G07F 17/42 |
| GB | 2198274 | A | 6/1988 | G07D 3/00 |
| GB | 2458387 | A | 9/2009 | G07D 11/00 |
| GB | 2468783 | A | 9/2010 | C07D 9/00 |
| GB | 2514241 | A | 11/2014 | G07D 9/00 |
| GB | 2553928 | A | 3/2018 | G07D 9/00 |
| JP | 49-058899 | | 6/1974 | |
| JP | 52-014495 | | 2/1977 | G07F 5/10 |
| JP | 52-071300 | A | 6/1977 | G07F 5/22 |
| JP | 56-040992 | A | 4/1981 | G07F 5/18 |
| JP | 57-117080 | A | 7/1982 | G07D 3/16 |
| JP | 59-079392 | A | 5/1984 | G07D 3/16 |
| JP | 60-016271 | U | 2/1985 | G07F 7/02 |
| JP | 62-134168 | U | 8/1987 | G07B 1/00 |
| JP | 62-182995 | A | 8/1987 | G07F 7/08 |
| JP | 62-221773 | A | 9/1987 | G06F 15/30 |
| JP | 62-166562 | U | 10/1987 | G07B 1/00 |
| JP | 64-035683 | A | 2/1989 | G07D 9/00 |
| JP | 64-042789 | A | 2/1989 | G07F 9/00 |
| JP | 64-067698 | A | 3/1989 | G07F 7/08 |
| JP | 01-118995 | A | 5/1989 | G07G 1/00 |
| JP | 01-307891 | A | 12/1989 | G07D 9/00 |
| JP | 02-050793 | A | 2/1990 | G07D 9/00 |
| JP | 02-252096 | A | 10/1990 | G07D 9/00 |
| JP | 03-012776 | A | 1/1991 | G06F 15/30 |
| JP | 03-063795 | A | 3/1991 | G07D 3/00 |
| JP | 03-092994 | A | 4/1991 | G07D 9/00 |
| JP | 03-156673 | A | 7/1991 | G06F 15/30 |
| JP | 04-085695 | A | 3/1992 | G07F 11/72 |
| JP | 04-175993 | A | 6/1992 | G07F 5/22 |
| JP | H04-303292 | A | 10/1992 | G07D 3/02 |
| JP | 05-046839 | A | 2/1993 | G07D 5/02 |
| JP | 05-217048 | A | 8/1993 | G07D 3/16 |
| JP | 05-274527 | A | 10/1993 | G07D 9/00 |
| JP | 06-035946 | A | 2/1994 | G06F 15/30 |
| JP | 06-103285 | A | 4/1994 | G06F 15/21 |
| JP | 09-251566 | A | 9/1997 | G06F 7/08 |
| JP | 2002-117439 | A | 4/2002 | G07D 9/00 |
| JP | 2003-242287 | A | 8/2003 | G06F 17/60 |
| JP | 2004-213188 | A | 7/2004 | G06F 17/60 |
| SE | 44 244 | | 9/1988 | 19/2 |
| SU | 503265 | A1 | 2/1976 | |
| WO | WO 85/00909 | A1 | 2/1985 | G07D 5/02 |
| WO | WO 91/06927 | A1 | 5/1991 | G07D 3/16 |
| WO | WO 91/08952 | A1 | 6/1991 | B65B 11/04 |
| WO | WO 91/12594 | A1 | 8/1991 | G07D 3/16 |
| WO | WO 91/18371 | A1 | 11/1991 | G07D 3/16 |
| WO | WO 92/08212 | A1 | 5/1992 | G07D 3/16 |
| WO | WO 92/20043 | A1 | 11/1992 | G07D 3/00 |
| WO | WO 92/20044 | A1 | 11/1992 | G07D 3/16 |
| WO | WO 92/22044 | A1 | 12/1992 | G07D 3/00 |
| WO | WO 93/00660 | A1 | 1/1993 | G07D 3/00 |
| WO | WO 93/09621 | A1 | 5/1993 | H04L 9/32 |
| WO | WO 94/06101 | A1 | 3/1994 | G07D 3/16 |
| WO | WO 94/08319 | A1 | 4/1994 | G07D 3/16 |
| WO | WO 94/23397 | A1 | 10/1994 | G07D 3/00 |
| WO | WO 95/02226 | A1 | 1/1995 | G07D 3/00 |
| WO | WO 95/04978 | A1 | 2/1995 | G07D 3/06 |
| WO | WO 95/06920 | A1 | 3/1995 | G07D 3/16 |
| WO | WO 95/09406 | A1 | 4/1995 | G07D 3/16 |
| WO | WO 95/13596 | A1 | 5/1995 | G07D 3/14 |
| WO | WO 95/19017 | A1 | 7/1995 | G07D 1/00 |
| WO | WO 95/23387 | A1 | 8/1995 | G07D 3/16 |
| WO | WO 95/30215 | A1 | 11/1995 | G06F 17/42 |
| WO | WO 96/07163 | A1 | 3/1996 | G07D 3/06 |
| WO | WO 96/07990 | A1 | 3/1996 | G07D 3/16 |
| WO | WO 96/12253 | A1 | 4/1996 | G07D 3/00 |
| WO | WO 96/27525 | A1 | 9/1996 | B65B 11/02 |
| WO | WO 96/27859 | A1 | 9/1996 | G07D 5/08 |
| WO | WO 97/22919 | A1 | 6/1997 | G06F 7/08 |
| WO | WO 97/25692 | A1 | 7/1997 | G07D 3/06 |
| WO | WO 98/24041 | A1 | 6/1998 | G06F 17/60 |
| WO | WO 98/24067 | A1 | 6/1998 | G07D 3/14 |
| WO | WO 98/48383 | A2 | 10/1998 | G07D 1/00 |
| WO | WO 98/48384 | A2 | 10/1998 | G07D 1/00 |
| WO | WO 98/48385 | A2 | 10/1998 | G07D 1/00 |
| WO | WO 98/51082 | A1 | 11/1998 | H04N 7/18 |
| WO | WO 98/59323 | A1 | 12/1998 | G07D 3/00 |
| WO | WO 99/00776 | A1 | 1/1999 | G07F 9/06 |
| WO | WO 99/06937 | A1 | 2/1999 | G06F 19/00 |
| WO | WO 99/16027 | A2 | 4/1999 | G07F 7/02 |
| WO | WO 99/33030 | A1 | 7/1999 | G07D 3/00 |
| WO | WO 99/41695 | A1 | 8/1999 | G06K 5/00 |
| WO | WO 99/48057 | A1 | 9/1999 | G07D 3/06 |
| WO | WO 99/48058 | A1 | 9/1999 | G07D 3/06 |
| WO | WO 00/48911 | A1 | 8/2000 | B65B 67/12 |
| WO | WO 00/65546 | A1 | 11/2000 | G07F 1/04 |
| WO | WO 01/63565 | A2 | 8/2001 | G07D 9/00 |
| WO | WO 02/071343 | A1 | 9/2002 | G07D 3/00 |
| WO | WO 03/052700 | A2 | 6/2003 | |
| WO | WO 03/079300 | A1 | 9/2003 | G07D 7/00 |
| WO | WO 03/085610 | A1 | 10/2003 | G07D 9/06 |
| WO | WO 03/107280 | A2 | 12/2003 | |
| WO | WO 04/044853 | A1 | 5/2004 | G07D 3/12 |
| WO | WO 04/109464 | A2 | 12/2004 | |
| WO | WO 05/041134 | A2 | 5/2005 | |
| WO | WO 05/088563 | A1 | 9/2005 | G07D 3/00 |
| WO | WO 06/086531 | A1 | 8/2006 | G07D 9/00 |
| WO | WO 07/035420 | A2 | 3/2007 | G06F 7/00 |
| WO | WO 07/120825 | A2 | 10/2007 | G06K 9/00 |

OTHER PUBLICATIONS

GB Patent Application No. 1717031.7: Search Report, 6 pages (dated Apr. 11, 2018).

GB Patent Application No. 1717031.7: Search Report, 2 pages (dated Feb. 13, 2019).

Amiel Industries: AI-1500 'Pulsar' High Performance Sorting and Bagging Machine, 13 pages (date unknown, but prior to Dec. 14, 2000).

AUI: Coinverter—"No More Lines . . . Self-Serve Cash-Out," by Cassius Elston, 1995 World Games Congress/Exposition Converter, 1 page (dated prior to 1995).

Brandt: 95 Series Coin Sorter Counter, 2 pages (1982).

Brandt: Model 817 Automated Coin and Currency Ordering System, 2 pages (1983).

Brandt: Model 920/925 Counter, 2 pages (date unknown, prior to Jul. 2011, possibly prior to Mar. 17, 1997).

Brandt: System 930 Electric Counter/Sorter, "Solving Problems, Pleasing Customer, Building Deposits," 1 page (date unknown, prior to Mar. 2, 2011, possibly prior to Mar. 17, 1997).

Brandt: Model 940-6 High Speed Sorter/Counter, 2 pages (date unknown, prior to Oct. 31, 1989).

Brandt: System 945 High-Speed Sorter, 2 pages (date unknown, prior to Mar. 2, 2011, possibly prior to Mar. 17, 1997).

Brandt: Model 952 Coin Sorter/Counter, 2 pages (date unknown, prior to Oct. 31, 1989).

Brandt: Model 954 Coin Sorter/Counter, 2 pages (date unknown, prior to Oct. 31, 1989).

Brandt: Model 957 Coin Sorter/Counter, 2 pages (date unknown, prior to Oct. 31, 1989).

Brandt: Model 958 Coin Sorter/Counter, 5 pages. (© 1982).

Brandt: Model 960 High-Speed Coin Sorter & Counter, 2 pages (1984).

Brandt; Model 966 Microsort™ Coin Sorter and Counter, 4 pages, (1979).

Brandt: Model 970 Coin Sorter and Counter, 2 pages (1983).

Brandt: Model 1205 Coin Sorter Counter, 2 pages (1986).

Brandt: Model 1400 Coin Sorter Counter, 2 pages (date unknown, prior to Mar. 2, 2011, possibly prior to Mar. 17, 1997).

Brandt: Model 8904 Upfeed—"High Speed 4-Denomination Currency Dispenser," 2 pages (1989).

Brandt: Mach 7 High-Speed Coin Sorter/Counter, 2 pages (1992).

Case ICC Limited: CDS Automated Receipt Giving Cash Deposit System, 3 pages (date unknown, prior to Nov. 15, 2000).

Cash, Martin: Newspaper Article "Bank Blends New Technology With Service," Winnipeg Free Press, 1 page (Sep. 4, 1992).

(56) References Cited

OTHER PUBLICATIONS

Childers Corporation: Computerized Sorter/Counter, "To coin an old adage, time is money . . . ," 3 pages (1981).
CTcoin: CDS602 Cash Deposit System, 1 page (date unknown, prior to Jan. 15, 2001).
Cummins: Cash Information and Settlement Systems (Form 023-1408), 4 pages (date Dec. 1991).
Cummins: The Universal Solution to All Coin and Currency Processing Needs (Form 13C1218 3-83), 1 page (Mar. 1983).
Cummins: JetSort® High Speed Sorter/Counter Kits I & J—Operating Instructions (Form 022-7123-00) 12 pages (1994).
Cummins: JetSort® Coin Sorter Counter/CA-130XL Coin Wrapper, Cummins Automated Money Systems (AMS) Case Study—Fifth-Third, "6,000 Coin Per Minute Counter/Sorter Keeps pcae With Fifth-Third Bank's Money Processing Needs," (Form 13C1180), 2 pages (Nov. 1981).
Cummins: JetSort®, "Venders Love JetSort," (13C1255), 1 page (Mar. 1987).
Cummins: JetSort® "High Speed Coin Sorter & Counter for Payphone Applications," "CTOCS Ready". (Form 023-1365), 2 pages (Mar. 1989).
Cummins: JetSort® mailer, "One moving part simplicity," "Vendors—Are validators changing your coin and currency needs?" (Form 023-1297), 3 pages (Apr. 1987).
Cummins: JetSort® Series V High Speed Coin Sorter/Counter, (Form 023-1383), 2 pages (Sep. 1990).
Cummins: JetSort® "Time for a Change, Be a smashing success!," (Form 023-1328), 1 page (Jun. 1988).
Cummins: JetSort® "Time for a Change—JetSort® vs. Brandt X," (Form 023-1330), 1 page (Jun. 1988).
Cummins: JetSort® "Time for a Change—No Coins Sorted After 3:00 or on Saturday," (Form 023-1327), 1 page (Aug. 1988).
Cummins: JetSort®, "What do all these Banks have in Common . . . ?", JetSort, CA-130XL coin wrapper, CA-118 coin wrapper, CA-4000 JetCount, (13C1203), 3 pages (Aug. 1982).
Cummins: JetSort® 700-01/CA-118 Coin Wrapper, Cumming Automated Money Systems (ASM) Case Study—University State Bank, "Cummins Money Processing System Boost Teller Service at University State Bank," (Form 13C1192), 2 pages (Mar. 1982).
Cummins: JetSort® 700-01, Cummins Automated Money Systems (AMS) Case Study—First State Bank of Oregon, "JetSort® Gived Bank Coin Service Edge," (Form 13C1196), 2 pages (Apr. 1982).
Cummins: JetSort® 700-01 Coin Sorter/Counter, Operating Instructions, 14 pages (1982).
Cummins: JetSort® 701, Cummins Automated Money Systems (AMS) Case Study—Convenco Vending, "High Speed Coin Sorter increases coin processing power at Convenco Vending," (Form 13C1226), 2 pages (Jul. 1983).
Cummins: JetSort Models 701 and 750 , "State-of-the-art coin processing comes of age," 2 pages (Feb. 1984).
Cummins: JetSort® Model CA-750 Coin Processor (Item No. 50-152), 1 page (Jul. 1984).
Cummins: JetSort® Model CA-750 Coin Sorter/Counter and CA-4050 JetCount currency counter, "Money Processing Made Easy," (Form 13C1221) 2 pages (Jun. 1983).
Cummins: JetSort® Model 1701 with JetStops, Operating Instructions Manual (Form 022-1329-00), 16 pages (1984).
Cummins: JetSort® Model 1760 brochure, (Form 023-1262-00), 2 pages (Jul. 1985).
Cummins: JetSort® Models 1770 and 3000, Communication Package specification and operating instructions, 10 pages (uncertain, possibly Nov. 1985).
Cummins: JetSort® Model 1770, "JetSort® Speed and Accuracy, Now with Communications!", (Form 023-1272) 1 page (Oct. 1986).
Cummins: JetSort® 2000 Series High Speed Coin Sorter/Counter (Form 023-1488), 2 pages (Oct. 2000).
Cummins: JetSort® 3000 Series High Speed Coin Sorter (Form 023-1468 Rev 1), 2 pages (Feb. 1995).
Cummins: JetSort® 3000 Series Options, "Talking JetSort 3000," (Form 023-1338-00), 1 page (between Jan. 1989-Feb. 1989).
Cummins: JetSort® 3000, "3,000 Coins per Minute!," (Form 023-1312), 1 page (date unknown, est. 1987).
Cummins: JetSort® 3200, Enhanced electronics for the JetSort® 3200 (Form 023-1350), 1 page (Apr. 1987).
De La Rue: CDS 500 Cash Deponier System, 6 pages (date unknown, p. 5 has date May 1994, p. 6 has date Dec. 1992) (German).
De La Rue: CDS 5700 and CDS 5800 Cash Deponier System (German) and translation, 7 pages (date unknown, prior to Aug. 13, 1996).
Diebold: Merchant MicroBranch, "Merchant MicroBranch Combines ATM After-Hour Depository Rolled-Coin Dispenser," Bank Technology News, 1 page (Nov. 1997).
Fa. GBS-Geldbearbeitungssysteme: GBS9401SB Technical Specification, 24 pages (date unknown, prior to Nov. 10, 2010).
Frisco Bay: Commercial Kiosk, "Provide self-service solutions for your business customers," 4 pages (date unknown, prior to Mar. 2, 2011, p. 4 has date 1996).
Glory: AMT Automated Merchant Teller, 4 pages (date unknown, prior to Jan. 15, 2001).
Glory: CRS-8000 Cash Redemption System, 2 pages (1996).
Hamilton: Hamilton's Express Banking Center, in Less Space Than a Branch Manager's Desk, 4 pages (date unknown, prior to Jan. 15, 2001).
Intellectual Australia Pty. Ltd.: Microbank, "From down under: Micronbank," "hand-held smart card terminal that combines smart card functions and telephone banking," 2 pages (Feb. 1996).
ISH Electronic: ISH I2005/500 Coin Counter (with translation), 4 pages (date unknown, prior to Aug. 1996).
ISH Electronic: ISH 12005/501 Self-Service Unit (with translation), 4 pages (date unknown, prior to Aug. 1996).
Namsys, Inc.: Namsys Express, Making currency management . . . more profitable, 2 pages (date unknown, prior to Jan. 15, 2001).
NGZ Geldzahlmaschinengesellschaft: NGZ 2100 Automated Coin Depository, 4 pages (date unknown, prior to Sep. 1996).
Perconta: Contomat Coin Settlement Machine for Customer Self Service, 2 pages (date unknown, prior to Apr. 2003).
Prema GmbH: Prema 405 (RE) Self Service Coin Deposit Facility, 2 pages (date unknown, prior to Apr. 2003).
Reis Eurosystems: CRS 6501/CRS 6510 Cash Receipt Systems for Self-Service Area, 3 pages (date unknown, prior to Aug. 13, 1996, maybe Feb. 1995).
Reis Eurosystems: CRS 6520/ CRS 6525 Standard-Class Coin Deporit Systems, 1 page (date unknown, prior to Apr. 2003).
Reis Eurosystems: CS 3510 Disc-Sorter, 1 page (date unknown, prior to Apr. 2003).
Royal Bank: Hemeon, Jade, "Royal's Burlington drive-in bank provides customers 24-hour tellers," The Toronto Star, 1 page (Aug. 21, 1991).
Royal Bank: Leitch, Carolyn, "High-Tech Bank Counts Coins," The Globe and Mail, 2 pages (Sep. 19, 1991).
Royal Bank: Oxby, Murray, "Royal Bank Opens Super Branch," The Gazette Montreal, 2 pages (Sep. 14, 1991).
Royal Bank: SuperBranch, "Experience the Ultimate in Convenience Banking," 2 pages (Feb. 1992).
Scan Coin: International Report, 49 pages (Apr. 1987).
Scan Coin: Money Processing Systems, 8 pages (date unknown, prior to Apr. 2003).
Scan Coin: World, 2 pages (Feb. 1988).
Scan Coin: CDS Cash Deposit System, 6 pages (date unknown, prior to Apr. 2003) [SC 0369].
Scan Coin: CDS Coin Deposit System—Technical Referens Manual, 47 pages (1989).
Scan Coin: CDS 600 User's Manual, 14 pages (date unknown, prior to Apr. 2003).
Scan Coin: CDS 600 & CDS 640 Cash Deposit System—Technical Manual, 45 pages (date unknown, prior to Apr. 2003).
Scan Coin: CDS MK 1 Coin Deposit System—Technical Manual, 32 pages (1991).
Scan Coin: SC 102 Value Counter Technical Manual, 28 pages (date unknown, prior to Apr. 2003).

(56) References Cited

OTHER PUBLICATIONS

Pay by Touch: Secure ID News, "Piggly Wiggly Extends Biometric Payments Throughout the Southeast U.S.," 2 pages, (Dec. 14, 2005).
ESD, Inc: Smartrac Card System, "Coinless laundry makes quarters obsolete; Smartrac Card System really makes a change in laundry industry," Business Wire, 2 pages (Feb. 23, 1996).
Meece, Mickey: Article "Development Bank of Singapore Gets Cobranding Edge with Smart Cards," American Banker, New York, NY, vol. 159, Iss. 195, p. 37, 2 pages (Oct. 10, 1994).
Scan Coin: Coin Sachet System brochure, 4 pages (last page marked "© Scan Coin / Jun. 2007").

* cited by examiner

COIN SORTING SYSTEM COIN CHUTE

CLAIM OF PRIORITY AND CROSS-REFERENCE TO RELATED APPLICATION

This application is a divisional of U.S. patent application Ser. No. 15/782,343 filed on Oct. 12, 2017, now allowed, which claims the benefit of priority to U.S. Provisional Patent Application No. 62/409,656 filed on Oct. 18, 2016, each of which is incorporated herein by reference in its entirety.

FIELD OF THE DISCLOSURE

The present disclosure relates generally to coin sorting devices and, more particularly, to coin sorters of the type which use a coin-driving member and a coin-guiding member or sorting head for sorting coins of mixed diameters.

BACKGROUND OF THE DISCLOSURE

Generally, disc-type coin sorters sort coins according to the diameter of each coin. Typically, in a given coin set such as the United States coin set, each coin denomination has a different diameter. Thus, sorting coins by diameter effectively sorts the coins according to denomination.

Disc-type coin sorters typically include a resilient pad (disposed on a rotating disc) that rotates beneath a stationary sorting head having a lower surface positioned parallel to the upper surface of the resilient pad and spaced slightly therefrom. The rotating, resilient pad presses coins upward against the sorting head as the pad rotates. The lower surface of sorting head includes a plurality of shaped regions including exit slots for manipulating and controlling the movement of the coins. Each of the exit slots is dimensioned to accommodate coins of a different diameter for sorting the coins based on diameter size. As coins are discharged from the sorting head via the exit slots, the sorted coins follow respective coin paths to sorted coin receptacles where the sorted coins are stored.

Although coin sorters have been used for a number of years, problems are still encountered in this technology. For example, as coins are guided by the sorting head, portions of the sorting head and/or pad become worn due to friction between the stationary sorting head and the moving coins.

SUMMARY

According to some embodiments of the present disclosure, a coin processing system for processing a plurality of coins of a mixed plurality of denominations, the coins of the plurality of denominations having a plurality of diameters, comprises a rotatable disc having a resilient pad coupled thereto for imparting motion to the plurality of coins, the resilient pad being generally circular and having an outer periphery edge. The system further comprises a stationary sorting head having a lower surface generally parallel to and spaced slightly away from the resilient pad, the lower surface forming a coin path for directing the movement of each of the coins and an exit slot area comprising a plurality of exit slots for discharging coins based on the diameter of each coin. The coin path below the exit slot area is positioned near the edge of the pad and coins travel along the coin path below the exit slot area having their radially outward edges aligned along a common radius positioned radially outward of the edge of the pad such that the outward edges of the coins extend beyond the edge of the pad. Each exit slot is associated with a given diameter of coin and the plurality of exit slots are arranged from upstream to downstream to accept coins in the order of increasing diameter, wherein each exit slot is sized to permit coins of an associated diameter to enter the exit slot while not permitting coins of larger diameters to enter the exit slot.

According to some embodiments of the present disclosure, a method of processing coins using a coin processing system for processing a plurality of coins of a mixed plurality of denominations, the coins of the plurality of denominations having a plurality of diameters is provided. The coin processing system comprises a rotatable disc having a resilient pad coupled thereto for imparting motion to the plurality of coins, the resilient pad being generally circular and having an outer periphery edge and the coin processing system further comprises a stationary sorting head having a lower surface generally parallel to and spaced slightly away from the resilient pad, the lower surface forming a coin path for directing the movement of each of the coins and an exit slot area comprising a plurality of exit slots for discharging coins based on the diameter of each coin; wherein the coin path in the exit slot area is positioned near the edge of the pad. The method comprises the acts of receiving the coins traveling along the coin path into the exit slot area with their radially outward edges aligned along a common radius positioned radially outward of the edge of the pad such that the outward edges of the coins extend beyond the edge of the pad.

According to some embodiments of the present disclosure, a U.S. coin processing system for processing a plurality of coins of a mixed plurality of U.S. denominations, the coins of the plurality of U.S. denominations having a plurality of diameters, comprises a rotatable disc having a resilient pad coupled thereto for imparting motion to the plurality of coins, the resilient pad being generally circular and having an outer periphery edge. The system further comprises a stationary sorting head having a lower surface generally parallel to and spaced slightly away from the resilient pad, the lower surface forming a coin path for directing the movement of each of the coins and an exit slot area comprising a plurality of exit slots for discharging coins based on the diameter of each coin. The coin path below the exit slot area is positioned near the edge of the pad and coins travel along the coin path below the exit slot area having their radially outward edges aligned along a common radius positioned radially outward of the edge of the pad such that the outward edges of the coins extend beyond the edge of the pad. Each exit slot is associated with a given diameter of coin and the plurality of exit slots are arranged from upstream to downstream to accept coins in the order of increasing diameter. Each exit slot is sized to permit coins of an associated diameter to enter the exit slot while not permitting coins of larger diameters to enter the exit slot. Each exit slot comprises a straight or nearly straight downstream exit wall having a coin-driven length of less than 1¾ inch.

According to some embodiments of the present disclosure, a coin chute for receiving coins exiting from a coin sorting system comprises a rotatable disc for imparting motion to the plurality of coins, a stationary sorting head having a lower surface generally parallel to and spaced slightly away from the resilient pad, the lower surface forming a coin path for directing the movement of each of the coins, and a reject slot. Coins exiting the reject slot travel in a first generally horizontal direction. The coin chute comprises a lower tapered surface having a generally funnel shape having a larger perimeter at its top than near its bottom. The coin chute further comprises an upper generally vertical wall having an angled portion at an angle from the first horizontal direction coins exit the reject slot, the portion being positioned such that coins exiting the reject slot contact the angled portion and are directed in a generally horizontal second direction, the angle of the angled portion being an angle other than 90° from the first generally horizontal direction.

According to some embodiments of the present disclosure, a coin processing system for processing a plurality of coins, comprises a rotatable disc having a resilient pad coupled thereto for imparting motion to the plurality of coins, the resilient pad being generally circular and having an outer periphery edge. The system further comprises a stationary sorting head having a lower surface generally parallel to and spaced slightly away from the resilient pad, the lower surface forming a coin path for directing the movement of each of the coins and a coin reject region for discharging coins. The reject region comprises a diverter pin. A coin to be rejected coin travels toward the diverter pin in a radial outward downward tilted manner.

According to some embodiments of the present disclosure, a coin processing system for processing a plurality of coins of a mixed plurality of denominations, the coins of the plurality of denominations having a plurality of diameters, comprises a rotatable disc having a resilient pad coupled thereto for imparting motion to the plurality of coins, the resilient pad being generally circular and having an outer periphery edge. The system further comprises a stationary sorting head having a lower surface generally parallel to and spaced slightly away from the resilient pad, the lower surface forming a coin path for directing the movement of each of the coins and a coin reject region for discharging coins moving along the coin path satisfying one or more criteria. The reject region comprises a diverter pin, a reject slot having a reject wall, a lower surface, and an elevated surface. The diverter pin has a retracted position at or above the elevated surface and a diverting position wherein the diverting pin extends below the elevated surface toward the resilient pad and into the path of coins traveling along the coin path. When the diverting pin is in the diverting position, a coin traveling along the coin path will contact the diverter pin and move in a radially outward direction. The coin path below the reject region is positioned near the edge of the pad. When coins travel along the coin path below the reject region their radially inward edges are aligned along a radius positioned near the edge of the pad such that the outward edges of the coins extend beyond the edge of the pad. The elevated surface is positioned radially inward of a portion of the lower surface. When a coin travels along the coin path toward the diverter pin it is pressed by the pad upward toward the sorting head such that the radially inner edge of the coin is pressed into the elevated surface and a portion of the coin contacts a portion of the lower surface whereby the coin travels toward the diverter pin in a radial outward downward tilted manner.

According to some embodiments of the present disclosure, a coin processing system for processing a plurality of coins of a mixed plurality of denominations, the coins of the plurality of denominations having a plurality of diameters, comprises a rotatable disc having a resilient pad coupled thereto for imparting motion to the plurality of coins, the resilient pad being generally circular and having an outer periphery edge. The system further comprises a stationary sorting head having a lower surface generally parallel to and spaced slightly away from the resilient pad, the lower surface forming a coin path for directing the movement of each of the coins and a coin reject region for discharging coins moving along the coin path satisfying one or more criteria. The reject region comprises a diverter pin and a reject slot having a reject wall, the reject wall being downstream of the diverter pin. The diverter pin has a retracted position whereat a coin traveling along the coin path does not contact the diverter pin and the diverting pin has a diverting position whereat a coin traveling along the coin path will contact the diverter pin and move in a radially outward direction. When the diverter pin is in its diverting position and a rejected coin contacts the diverter pin, the resilient pad maintains control over the movement of the rejected coin at least until the rejected coin contacts the reject wall.

According to some embodiments of the present disclosure, a reject region of a coin processing system for processing a plurality of coins of a mixed plurality of denominations is provided. The coins of the plurality of denominations have a plurality of diameters. The coin processing system comprises a rotatable disc having a resilient pad coupled thereto for imparting motion to the plurality of coins, the resilient pad being generally circular and having an outer periphery edge. The coin processing system further comprises a stationary sorting head having a lower surface generally parallel to and spaced slightly away from the resilient pad. The lower surface forms a coin path for directing the movement of each of the coins and a coin reject region for discharging coins moving along the coin path satisfying one or more criteria. The reject region comprises a diverter pin having a generally cylindrical shape and having a bottom surface and generally vertical sides. The reject region further comprises a reject slot having a reject wall, a lower surface, and an elevated surface. The diverter pin has a retracted position at or above the elevated surface and a diverting position wherein the diverting pin extends below the elevated surface toward the resilient pad and into the path of coins traveling along the coin path. When the diverting pin is in the diverting position, a coin traveling along the coin path will contact the diverter pin and move in a radially outward direction. The coin path below the reject region is positioned near the edge of the pad wherein when coins travel along the coin path below the reject region they have their radially inward edges aligned along a radius positioned near the edge of the pad such that the outward edges of the coins extend beyond the edge of the pad. The elevated surface is positioned radially inward of a portion of the lower surface and wherein a coin traveling along the coin path toward the diverter pin is pressed by the pad upward toward the sorting head such that the radially inner edge of the coin is pressed into the elevated surface and a portion of the coin contacts a portion of the lower surface whereby the coin travels toward the diverter pin in a radial outward downward tilted manner. When the diverter pin is in its diverting position, a coin contacts the diverter pin while the coin is tilted in a radial outward downward tilted manner.

According to some embodiments of the present disclosure, a coin processing system for processing a plurality of coins of a mixed plurality of denominations, the coins of the plurality of denominations having a plurality of diameters, comprises a rotatable disc having a resilient pad coupled thereto for imparting motion to the plurality of coins, the resilient pad being generally circular and having an outer periphery edge and a center. The system further comprises a stationary sorting head having a lower surface generally parallel to and spaced slightly away from the resilient pad, the lower surface forming a coin path for directing the movement of each of the coins past a coin re-gauging area. The re-gauging area comprises a gauging block, a lower surface, and an elevated surface. The coin path below the re-gauging area is positioned near the edge of the pad and wherein coins travel along the coin path into the re-gauging area having their radially inward edges aligned along a radius positioned near the edge of the pad such that the outward edges of the coins extend beyond the edge of the pad. The rotation of the pad drives radial outward edges of the coins into contact with the gauging block. The elevated surface is positioned radially inward of a portion of the lower surface and the gauging block is positioned radially outward of the portion of the lower surface. When the coins contact the gauging block the coins are pressed by the pad upward toward the sorting head such that the radially inner edges of the coins are pressed into the elevated surface and a portion of the coins contacts a portion of the lower surface whereby the coins contact the gauging block in a radial outward downward tilted manner. The gauging block has a gauging wall having an upstream end and a downstream end, the downstream end of the gauging wall being positioned radially closer to the center of the pad than the upstream end of the gauging wall. The rotation of the pad drives the coins downstream along a gauging wall of the gauging block whereby the outer edges of the coins becomes radially aligned and wherein the coins are driven along the gauging wall in a radial outward downward tilted manner.

The above summary of the present disclosure is not intended to represent each embodiment, or every aspect, of the present disclosure. Additional features and benefits of the present disclosure will become apparent from the detailed description, figures, and claims set forth below.

Figure 1A:
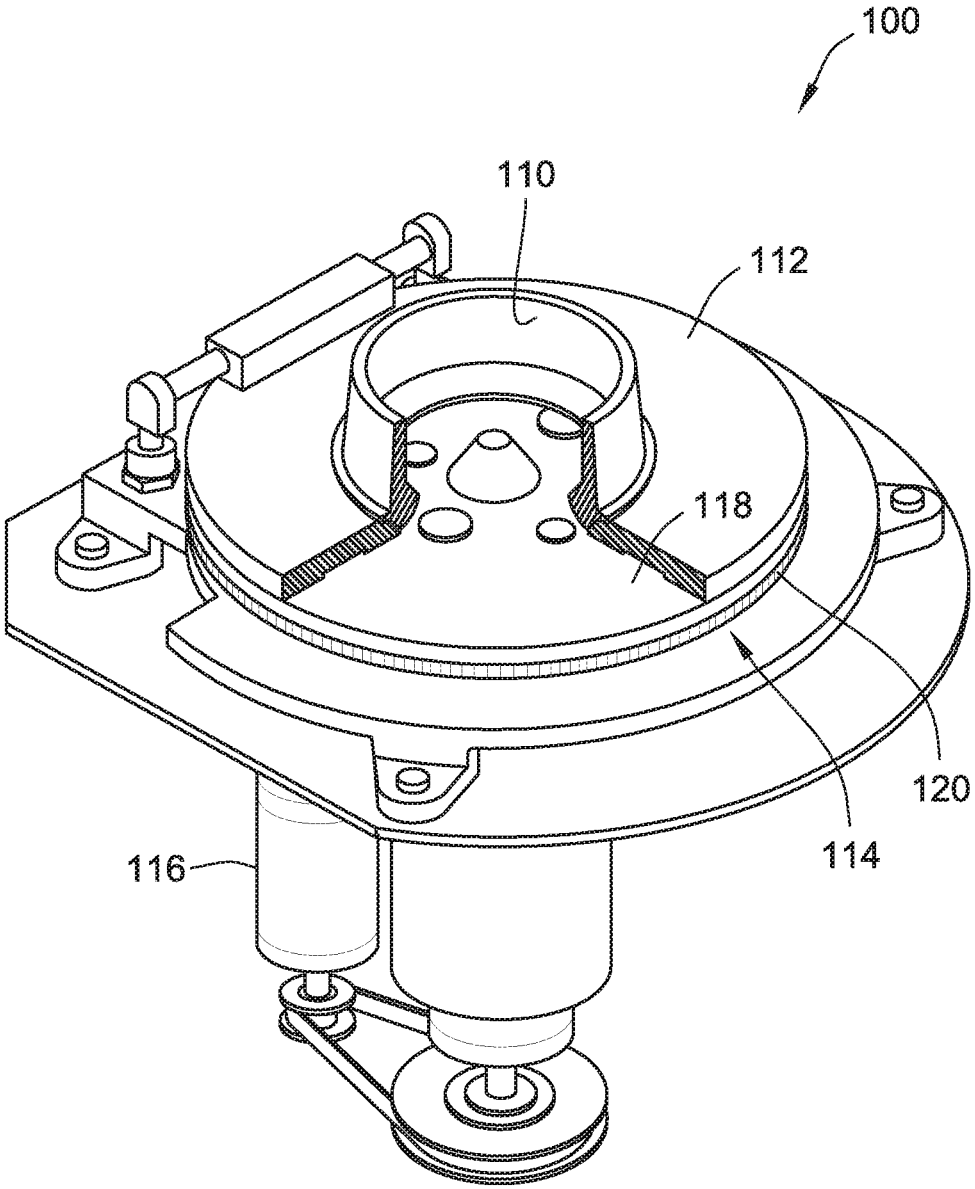
FIG. 1A is a perspective view of a coin processing system or coin sorter, according to some embodiments of the present disclosure, with portions thereof broken away to show the internal structure.

While the disclosure is susceptible to various modifications and alternative forms, specific embodiments will be shown by way of example in the drawings and will be desired in detail herein. It should be understood, however, that the disclosure is not intended to be limited to the particular forms disclosed. Rather, the disclosure is to cover all modifications, equivalents and alternatives falling within the spirit and scope of the inventions as defined by the appended claims.

DETAILED DESCRIPTION OF THE ILLUSTRATED EMBODIMENTS

Turning now to the drawings and referring first to FIG. 1A, a disc-type coin processing system or coin sorter 100 according to some embodiments of the present disclosure is shown. FIG. 1A is a perspective view of a coin processing system or coin sorter, according to some embodiments of the present disclosure, with portions thereof broken away to show the internal structure. The coin processing system 100 includes a hopper 110 for receiving coins of mixed denominations that feeds the coins through a central opening in an annular sorting head 112. As the coins pass through this opening, they are deposited on the top surface of a rotatable disc 114. This rotatable disc 114 is mounted for rotation on a shaft (not shown) and driven by an electric motor 116. The disc 114 typically comprises a resilient pad 118, preferably made of a resilient rubber or polymeric material, bonded to the top surface of a solid disc 120. While the solid disc 120 is often made of metal, it can also be made of a rigid polymeric material.

According to some embodiments, coins are initially deposited by a user or operator in a coin tray (not shown) disposed above the coin processing system 100 shown in FIG. 1A. The user lifts the coin tray which funnels the coins into the hopper 110. A coin tray suitable for use in connection with the coin processing system 100 is described in detail in U.S. Pat. No. 4,964,495 entitled "Pivoting Tray For Coin Sorter," which is incorporated herein by reference in its entirety.

As the disc 114 is rotated, the coins deposited on the resilient pad 118 tend to slide outwardly over the surface of the pad 118 due to centrifugal force. As the coins move outwardly, those coins which are lying flat on the pad 118 enter the gap between the surface of the pad 118 and the sorting head 112 because the underside of the inner periphery of the sorting head 112 is spaced above the pad 118 by a distance which is about the same as the thickness of the thickest coin the coin sorter 100 is designed to sort. As is further described below, the coins are processed and sent to exit stations or channels where they are discharged. The coin exit stations or channels may sort the coins into their respective denominations and discharge the coins from the sorting head 112 corresponding to their denominations.

Figure 1B:
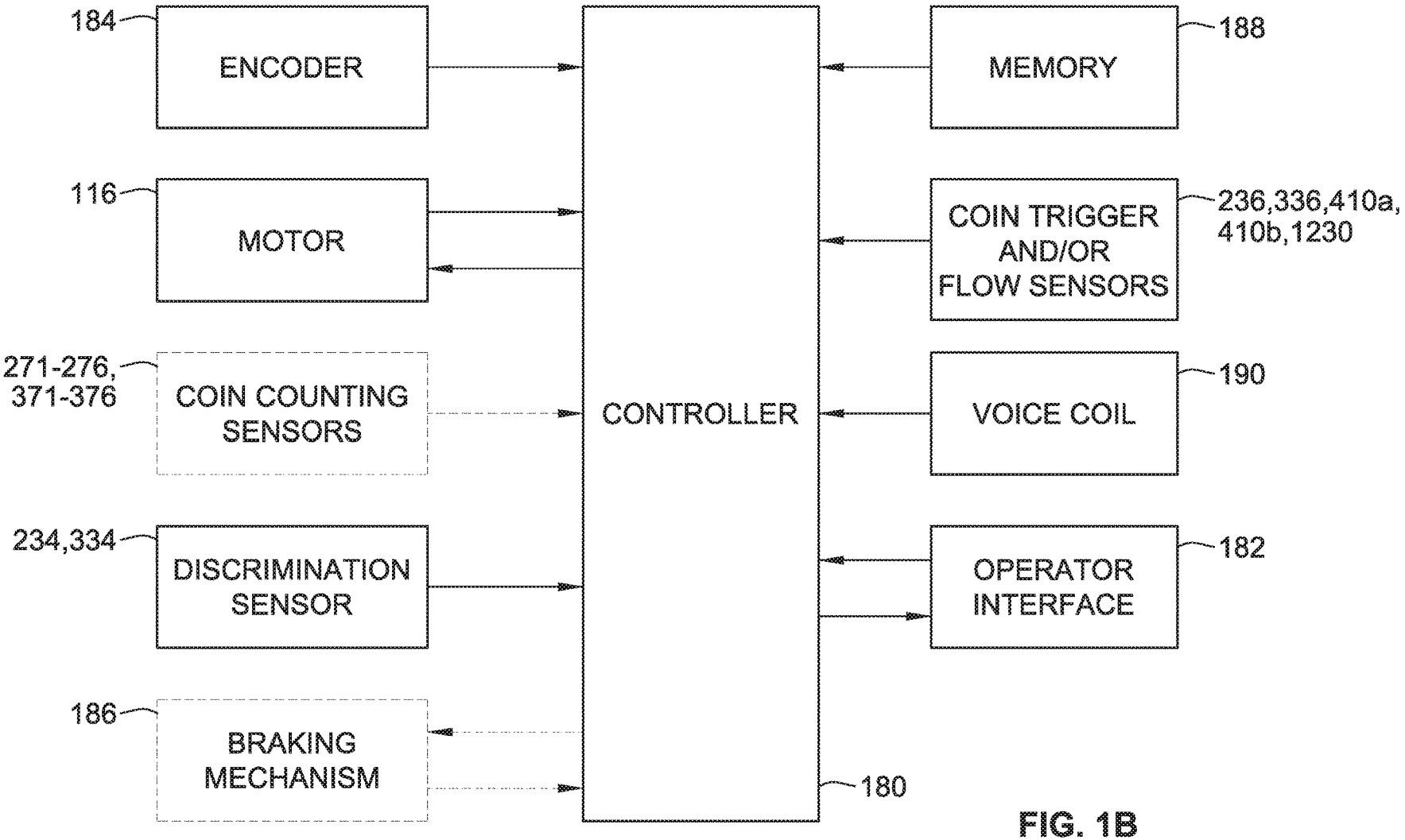
FIG. 1B is a functional block diagram of a control system for the coin processing system shown in FIG. 1A.

FIG. 1B is a functional block diagram of a control system for the coin processing system 100 shown in FIG. 1A which may be employed with the sorting heads 212, 312 to be subsequently described. FIG. 1B illustrates a system controller 180 and its relationship to the other components in the coin processing system 100. More details regarding a system controller 180 and its relationship to the other components in the coin processing system 100 are described in U.S. Pat. No. 7,743,902, which is incorporated herein by reference in its entirety. But briefly, an operator of system 100 communicates with the coin processing system 100 via an operator interface 182 which is configured to receive information from the operator and display information to the operator about the functions and operation of the coin processing system 100. The controller 180 monitors the angular position of the disc 114 via an encoder 184 which sends an encoder count to the controller 180 upon each incremental movement of the disc 114. Based on input from the encoder 184, the controller 180 determines the angular velocity at which the disc 114 is rotating as well as the change in angular velocity, that is, the acceleration and deceleration, of the disc 114. The encoder 184 allows the controller 180 to track the position of coins on the sorting head 212 or 312 after being sensed. According to some embodiments of the coin processing system 100, the encoder has a resolution of 40,000 pulses per revolution of the disc 114.

The controller 180 also controls the power supplied to the motor 116 which drives the rotatable disc 114. When the motor 116 is a DC motor, the controller 180 can reverse the current to the motor 116 to cause the rotatable disc 114 to decelerate. Thus, the controller 180 can control the speed of the rotatable disc 114 without the need for a braking mechanism. If a braking mechanism 186 is used, the controller 180 also controls the braking mechanism 186. Because the amount of power applied is proportional to the braking force, the controller 180 has the ability to alter the deceleration of the disc 114 by varying the power applied to the braking mechanism 186.

According to some embodiments of the coin processing 100 and as will be described further below such as in reference to FIGS. 2 and 3, the controller 180 also monitors coin counting sensors 271-276 which are disposed in each of the coin exit slots 261-266 of the sorting head 212 (or just outside the periphery of the sorting head 212). As coins move past one of these counting sensors 271-276, the controller 180 receives a signal from the counting sensor 271-276 for the particular denomination of the passing coin and adds one to the counter for that particular denomination within the controller 180. The controller 180 and memory 188 maintain a counter for each denomination of coin that is to be sorted. In this way, each denomination of coin being sorted by the coin processing system 100 has a count continuously tallied and updated by the controller 180. According to some embodiments, the controller 180 is able to cause the rotatable disc 114 to quickly terminate rotation after "n" number (i.e., a predetermined number n) of coins have been discharged from an exit slot, but before the "n+1" coin has been discharged. For example, it may be necessary to stop the discharging of coins after a predetermined number of coins have been delivered to a coin receptacle, such as a coin bag, so that each bag contains a known number of coins, or to prevent a coin receptacle from becoming overfilled. Alternatively, the controller 180 can cause the system to switch between bags in embodiments having more than one coin bag corresponding to each exit slot. For embodiments of sorting head 312 employing coin counting sensors similar to sensors 271-276 in or near exit slots 361-366, the above description related to the use of sensors 271-276 would also apply. In some embodiments employing either sorting head 212 or 312, the controller 180 and memory 188 maintain a counter for each denomination of coin that is to be sorted without the use of exit slot sensors 271-276 such as by using a trigger sensor and monitoring the rotation of the pad 118 and tracking the location of the coins as they travel under and out from under the sorting heads 212,312.

The controller 180 also monitors the output of a coin discrimination sensor 234, 334 and compares information received from the discrimination sensor 234, 334 to master information stored in a memory 188 of the coin processing system 100 including information associated with known genuine coins. If the received information does not favorably compare to master information stored in the memory 188, the controller 180 sends a signal to a voice coil 190 causing a diverting pin 242, 342 to move to a diverting position. According to some embodiments of the coin processing system 100, as described in more detail in U.S. Pat. No. 7,743,902, after a coin moves past a trigger sensor 236, 336 the coin discrimination sensor 234, 334 begins sampling the coin and the controller 180 then compares the coin's signature to a library of "master" signatures associated with known genuine coins stored in the memory 188 and the controller 180 determines whether to reject a coin. After determining that a coin is invalid, the controller 180 sends a signal to activate a voice coil 190 for moving a diverting pin 242, 342 to a diverting position.

Overview of Sorting Heads

To better appreciate some of the features and aspects associated with a sorting head according to the present disclosure, a first sorting head 212 and the manner in which it guides coins will be discussed in conjunction with FIG. 2 and then an embodiment of a second sorting head 312 incorporating various features and aspects of the present disclosure and the manner in which it guides coins will be discussed in conjunction with FIG. 3. Then differences between various aspects and features of sorting head 212 and 312 will be discussed in more detail in conjunction with subsequent figures.

Figure 2:
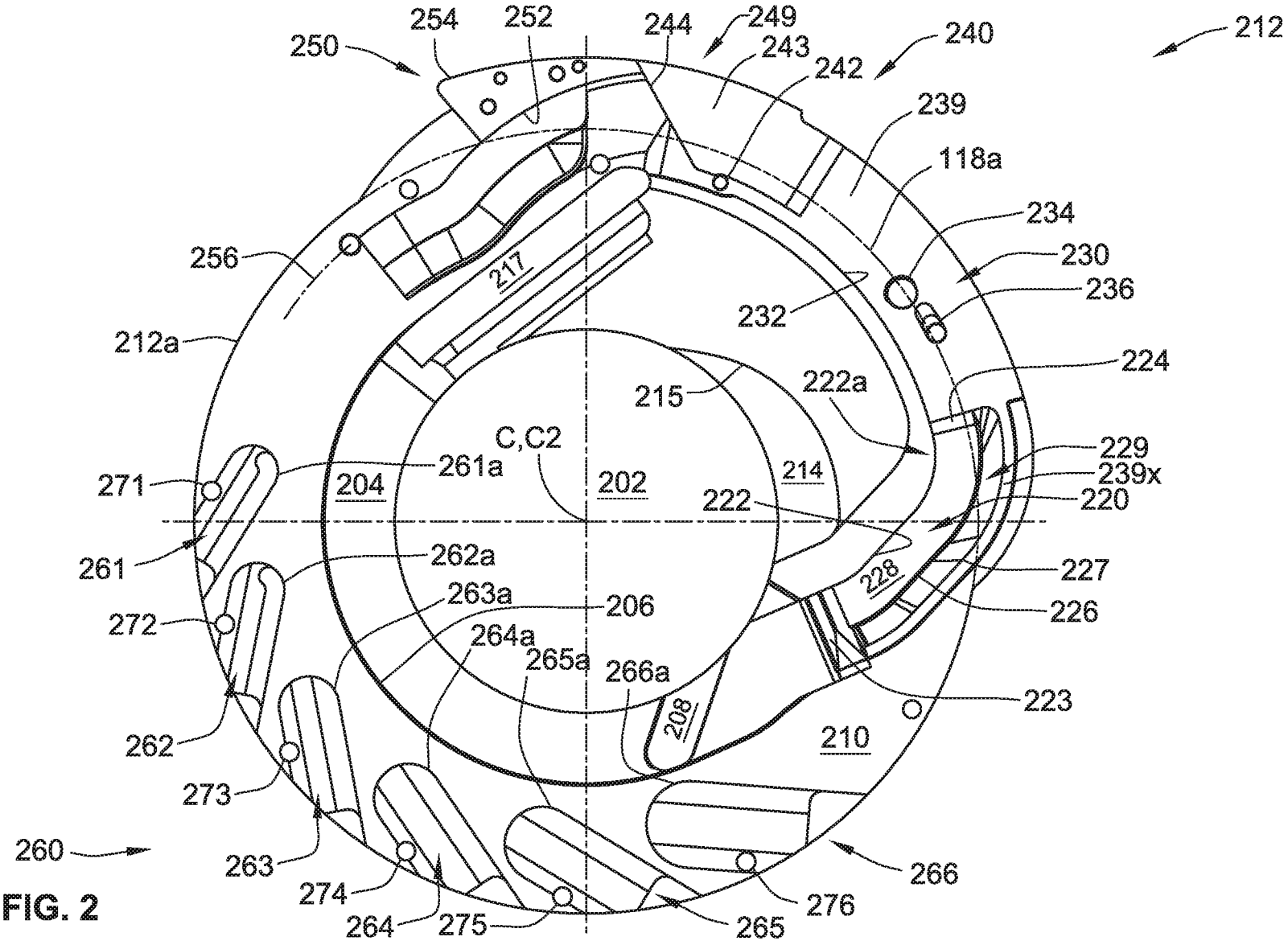
FIG. 2 is a bottom plan view of a first sorting head for use with the system of FIGS. 1A and 1B.

Referring now to FIG. 2, a bottom plan view of the underside of a first sorting head 212 for use with the system of FIGS. 1A and 1B is shown. The coin sets for any given country are sorted by the sorting head 212 due to variations in the diameter size. The coins circulate between the sorting head 212 and the pad 118 (FIG. 1A) on the rotatable disc 114 (FIG. 1A). The pad 118 has a circular surface with a center at C. The sorting head 212 has a circular portion centered at point C2 which corresponds with the center C of pad 118. The coins are deposited on the pad 118 via a central opening 202 and initially enter an entry area 204 formed in the underside of the sorting head 212. It should be kept in mind that the circulation of the coins in FIG. 2 appears counterclockwise as FIG. 2 is a view of the underside of the sorting head 212.

An outer wall 206 of the entry area 204 divides the entry area 204 from the lowermost surface 210 of the sorting head 212. The lowermost surface 210 is preferably spaced from the pad 118 by a distance that is less than the thickness of the thinnest coins the coin sorter is designed to sort. Consequently, the initial outward radial movement of all the coins is terminated when the coins engage the outer wall 206, although the coins continue to move more circumferentially along the wall 206 (in the counterclockwise direction as viewed in FIG. 2) by the rotational movement imparted to the coins by the pad 118 of the rotatable disc 114.

In some cases, coins may be stacked on top of each other—commonly referred to as "stacked" coins or "shingled" coins. Stacked coins which are not against the wall 206 must be recirculated and stacked coins in contact against the wall 206 must be unstacked. To unstack the coins, the stacked coins encounter a stripping notch 208 whereby the upper coin of the stacked coins engages the stripping notch 208 and is channeled along the stripping notch 208 back to an area of the pad 118 disposed below the central opening 202 where the coins are then recirculated. The vertical dimension of the stripping notch 208 is slightly less the thickness of the thinnest coins so that only the upper coin is contacted and stripped. While the stripping notch 208 prohibits the further circumferential movement of the upper coin, the lower coin continues moving circumferentially across stripping notch 208 into a queuing channel 220.

Stacked coins that may have bypassed the stripping notch 208 by entering the entry area 204 downstream of the stripping notch 208 are unstacked after the coins enter the queuing channel 220 and are turned into an inner queuing wall 222 of the queuing channel 220. The upper coin contacts the inner queuing wall 222 and is channeled along the inner queuing wall 222 while the lower coin is moved by the pad 118 across the inner queuing wall 222 into a region defined by surface 214 wherein the lower coin engages a wall 215 and is recirculated. Other coins that are not properly aligned along the inner queuing wall 222, but that are not recirculated by wall 215, are recirculated by recirculating channel 217.

As the pad 118 continues to rotate, those coins that were initially aligned along the wall 206 (and the lower coins of stacked coins moving beneath the stripping notch 208) move across a ramp 223 leading to the queuing channel 220 for aligning the innermost edge of each coin along the inner queuing wall 222. In addition to the inner queuing wall 222, the queuing channel 220 includes a first rail 226 that forms the outer edge of surface 228 and a second rail 227 that forms the outer edge of beveled surface 229. The beveled surface 229 transitions downward from first rail 226 to second rail 227. A flat surface 239*x* is located radially outward of the second rail 227. The surfaces 228 and 229 are sized such that the width of surface 228 is less than that of the smallest (in terms of the diameter) coins and the combined width of surfaces 228 and 229 is less than that of the largest coin. As a result, because surface 228 has a width less than that of the smallest diameter coin the sorting head is configured to sort, each coin has a portion thereof which extends beyond the outer periphery 118*a* of the rotating pad 118 as they enter a discrimination region 230.

The coins are gripped between one of the two rails 226, 227 and the pad 118 as the coins are rotated through the queuing channel 220. The coins, which were initially aligned with the outer wall 206 of the entry area 204 as the coins moved across the ramp 223 and into the queuing channel 220, are rotated into engagement with inner queuing wall 222. Because the queuing channel 220 applies a greater amount of pressure on the outside edges of the coins, the coins are less likely to bounce off the inner queuing wall 222 as the radial position of the coin is increased along the inner queuing wall 222.

It can be seen that the queuing channel 220 is generally "L-shaped." The queuing channel 220 receives the coins as the coins move across the ramp 223 and into the queuing channel 220. The coins exit the queuing channel 220 as the coins turn a corner 222*a* of the L-shaped queuing channel 220 and are guided down ramp 224. L-shaped queuing channels are discussed in more detail in U.S. Pat. No. 7,743,902, incorporated herein by reference in its entirety. As the pad 118 continues to rotate, the coins move along the queuing channel 220 and are still engaged on the inner queuing wall 222. The coins move across a ramp 224 as the coins enter the discrimination region 230 and the inner queuing wall 222 transitions to an inner alignment wall 232. The discrimination region includes a discrimination sensor 234 for discriminating between valid and invalid coins and/or identifying the denomination of coins.

As the pad 118 continues to rotate, the L-shape of the queuing channel 220 imparts spacing to the coins which are initially closely spaced, and perhaps abutting one another, as the coins move across the ramp 223 into the queuing channel 220. As the coins move along the queuing channel 220 upstream of corner 222*a*, the coins are pushed against inner queuing wall 222 and travel along the inner queuing wall 222 in a direction that is transverse to (i.e., generally unparallel) the direction in which the pad 118 is rotating. This action aligns the coins against the inner queuing wall 222. However, as the coins round the corner 222*a* of the queuing channel 220, the coins are turned in a direction wherein they are moving with the pad (i.e., in a direction more parallel to the direction of movement of the pad). A coin rounding the corner 222*a* is accelerated as the coin moves in a direction with the pad; thus, the coin is spaced from the next coin upstream. Put another way, the queuing channel 220 receives coins from the entry area 204 and downstream of corner 222*a* the queuing channel 220 is disposed in an orientation that is substantially more in the direction of movement of the rotatable disc 114 for creating an increased spacing between adjacent coins. Accordingly, the coins moving out of the queuing channel 220 are spaced apart. According to some embodiments of the present disclosure, the coins are spaced apart by at least about 10 mm or 0.40 inches when the sorting head 212 has an eleven inch diameter and the pad 118 rotates at a speed of approximately three hundred revolutions per minute (300 rpm) such as at approximately 320 rpm.

The coins move across ramp 224 and transition to a flat surface 239 of the discrimination region 230 as the pad 118 continues to rotate. Put another way, the two surfaces 228, 229 of the queuing channel 220 transition into the flat surface 239 of the discrimination region 230. The pad 118 holds each coin flat against the flat surface 239 of the discrimination region 230 as the coins are moved past the discrimination sensor 234.

The sorting head 212 includes a cutout for the discrimination sensor 234. The discrimination sensor 234 is disposed flush with the flat surface 239 of the discrimination region 230 or recessed slightly within the sorting head just above the flat surface 239 of the discrimination region 230. Likewise, a coin trigger sensor 236 is disposed just upstream of the discrimination sensor 234 for detecting the presence of a coin. Coins first move over the coin trigger sensor 236 (e.g., a photo detector or a metal proximity detector) which sends a signal to a controller (e.g., controller 180) indicating that a coin is approaching the coin discrimination sensor 234. According to some embodiments, the sensor 236 is an optical sensor which may employ a laser to measure a chord of passing coins and/or the length of time it takes the coin to traverse the sensor 236 and this information along with the information from the coin discrimination sensor is used to determine the diameter, denomination, and validity of a passing coin. Additional description of such embodiments may be found in U.S. Pat. No. 7,743,902, incorporated herein by reference in its entirety.

According to some embodiments, the coin discrimination sensor 234 is adapted to discriminate between valid and invalid coins. Use of the term "valid coin" refers to coins of the type the sorting head is designed or configured to sort. Use of the term "invalid coin" refers to items being circulated on the rotating disc that are not one of the coins the sorting head is designed to sort. Any truly counterfeit coins (i.e., a slug) are always considered "invalid." According to another alternative embodiment of the present disclosure, the coin discriminator sensor 234 is adapted to identify the denomination of the coins and discriminate between valid and invalid coins.

Some coin discrimination sensors suitable for use with the disc-type coin sorter shown in FIGS. 1A-3 are described in detail in U.S. Pat. Nos. 7,743,902; 5,630,494; and 5,743,373, each of which is incorporated herein by reference in its entirety. Another coin discrimination sensor suitable for use with the present disclosure is described in detail in U.S. Pat. No. 6,892,871, which is incorporated herein by reference.

As discussed above according to one alternative embodiment of the present disclosure, the discrimination sensor 234 discriminates between valid and invalid coins. Downstream of the discrimination sensor 234 is a diverting pin 242 disposed adjacent inner alignment wall 232 that is movable to a diverting position (out of the page as viewed in FIG. 2) and a home position (into the page as viewed in FIG. 2). In the diverting position, the diverting pin 242 directs coins off of inner alignment wall 232 and into a reject slot 249. The reject slot 249 includes a reject surface 243 and a reject wall 244 that rejected coins abut against as they are off-sorted to the periphery of the sorting head 212. Off-sorted coins are directed to a reject area (not shown). Coins that are not rejected (i.e., valid coins) eventually engage an outer wall 252 of a gauging channel or region 250 where coins are aligned on a common outer radius for entry into a coin exit station or exit slot area 260 as is described in greater detail below.

According to some embodiments of the present disclosure, the diverting pin 242 is coupled to a voice coil 190 (not shown in FIG. 2, see FIG. 1B) for moving the diverting pin 242 between the diverting position and the home position. More details on diverting pins such as diverting pins 242 and 342 and voice coils are discussed in U.S. Pat. No. 7,743,902, incorporated herein by reference in its entirety. Other types of actuation devices can be used in alternative embodiments of the present disclosure instead of voice coils. For example, a linear solenoid or a rotary solenoid may be used to move a pin such as diverting pin 242 between a diverting position and a home position.

As the pad 118 continues to rotate, those coins not diverted into the reject slot 249 continue to the gauging region 250. The inner alignment wall 232 terminates just upstream of the diverter pin 242; thus, the coins no longer abut the inner alignment wall 232 at this point. The radial position of the coins is maintained, because the coins remain under pad pressure, until the coins contact an outer wall 252 of the gauging region 250. According to some embodiments, the sorting head 212 includes a gauging block 254 which has an outer wall 252 extending beyond the outer periphery 118*a* of the rotating pad 118.

The gauging wall 252 extends radially inward in the counterclockwise direction as viewed in FIG. 2 so as to align the coins along a common outer radius 256 which is positioned inboard of the outer periphery 118*a* of the rotating pad 118 and the outer periphery 212*a* of the sorting head 212 as the coins approach a series of coin exit slots 261-266 which discharge coins of different denominations. The first exit slot 261 is dedicated to the smallest diameter coin to be sorted (e.g., the dime in the U.S. coin set). Beyond the first exit slot 261, the sorting head 212 shown in FIG. 2 forms five more exit slots 262-266 which discharge coins of different denominations at different circumferential locations around the periphery of the sorting head 212. Thus, the exit slots 261-266 are spaced circumferentially around the outer periphery 212*a* of the sorting head 212 with the innermost edges 261*a*-266*a* of successive channels located progressively closer to the center C2 of the sorting head 212 so that coins are discharged in the order of increasing diameter. The number of exit slots can vary according to alternative embodiments.

The innermost edges 261*a*-266*a* of the exit slots 261-266 are positioned so that the inner edge of a coin of only one particular denomination can enter each channel 261-266. The coins of all other denominations reaching a given exit slot extend inwardly beyond the innermost edge of that particular exit slot so that those coins cannot enter the channel and, therefore, continue on to the next exit slot under the circumferential movement imparted on them by the pad 118. To maintain a constant radial position of the coins, the pad 118 continues to exert pressure on the coins as they move between successive exit slots 261-266.

According to some embodiments of the sorting head 212, each of the exit slots 261-266 includes a coin counting sensor 271-276 for counting the coins as coins pass through and are discharged from the coin exit slots 261-266. In embodiments of the coin processing system utilizing a discrimination sensor 234 capable of determining the denomination of each of the coins, it is not necessary to use the coin counting sensors 271-276 because the discrimination sensor 234 provides a signal that allows the controller 180 to determine the denomination of each of the coins. Through the use of the system controller 180 (FIG. 1B), a count is maintained of the number of coins discharged by each of the exit slots 261-266.

Now that a first sorting head 212 has been described, an embodiment of a second sorting head 312 incorporating various features and aspects of the present disclosure and the manner in which sorting head 312 guides coins will be discussed in conjunction with FIG. 3. Similar reference numerals will be used for similar features (e.g., the last two digits of reference numerals of similar features are the same).

Figure 3:
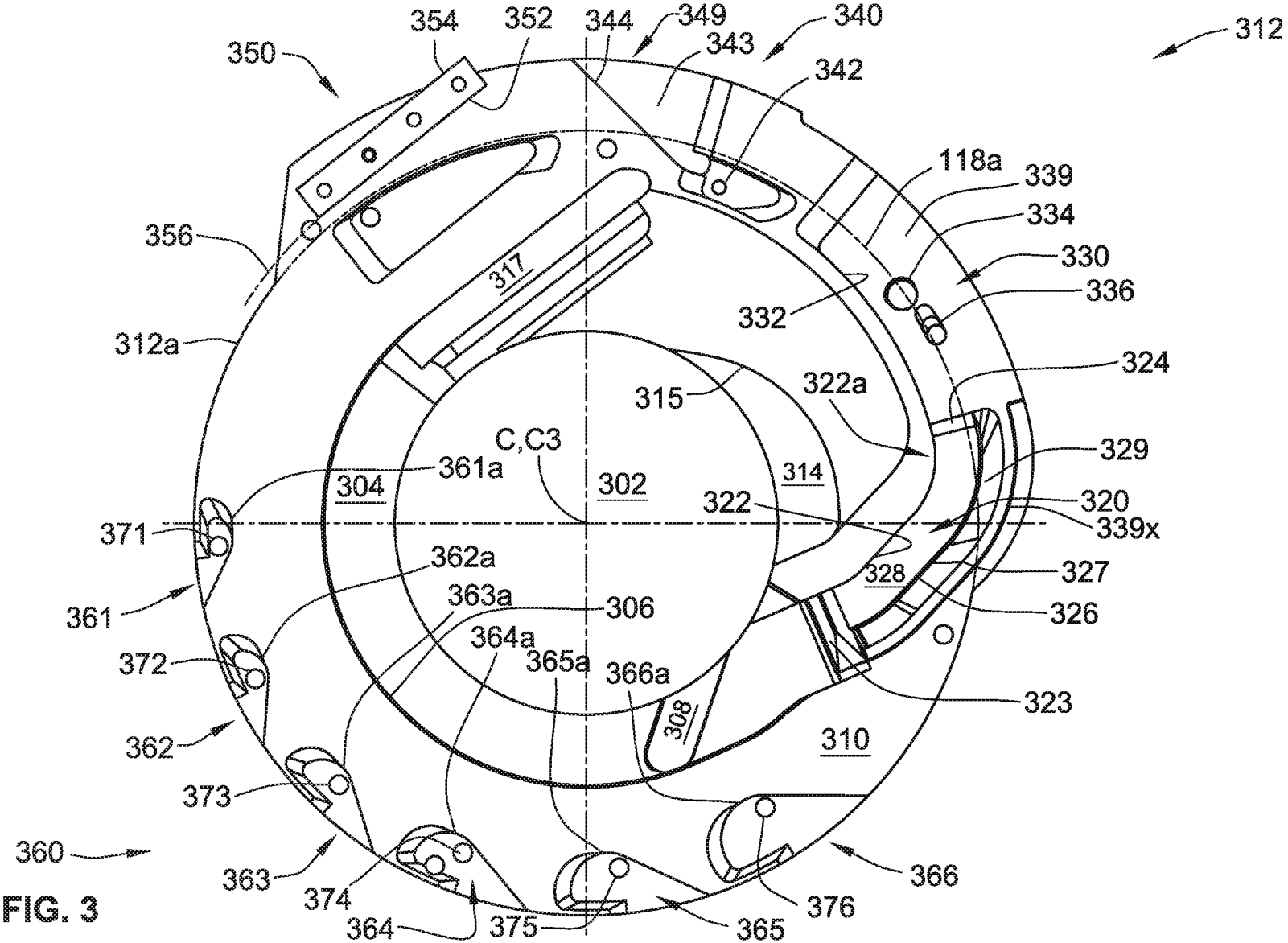
FIG. 3 is a bottom plan view of a second sorting head for use with the system of FIGS. 1A and 1B embodying concepts and features of the present disclosure.

Referring now to FIG. 3, the underside of a sorting head 312 is shown. The coin sets for any given country are sorted by the sorting head 312 due to variations in the diameter size. The coins circulate between the sorting head 312 and the pad 118 (FIG. 1A) on the rotatable disc 114 (FIG. 1A). The pad 118 has a circular surface with a center at C. The sorting head 312 has a circular portion centered at point C3 which corresponds with the center C of pad 118. The coins are deposited on the pad 118 via a central opening 302 and initially enter an entry area 304 formed in the underside of the sorting head 312. It should be kept in mind that the circulation of the coins in FIG. 3 appears counterclockwise as FIG. 3 is a view of the underside of the sorting head 312.

An outer wall 306 of the entry area 304 divides the entry area 304 from the lowermost surface 310 of the sorting head 312. The lowermost surface 310 is preferably spaced from the pad 118 by a distance that is less than the thickness of the thinnest coins the coin sorter is designed to sort. Consequently, the initial outward radial movement of all the coins is terminated when the coins engage the outer wall 306, although the coins continue to move more circumferentially along the wall 306 (in the counterclockwise direction as viewed in FIG. 3) by the rotational movement imparted to the coins by the pad 118 of the rotatable disc 114.

In some cases, coins may be stacked on top of each other—commonly referred to as "stacked" coins or "shingled" coins. Stacked coins which are not against the wall 306 must be recirculated and stacked coins in contact against the wall 306 must be unstacked. To unstack the coins, the stacked coins encounter a stripping notch 308 whereby the upper coin of the stacked coins engages the stripping notch 308 and is channeled along the stripping notch 308 back to an area of the pad 118 disposed below the central opening 302 where the coins are then recirculated. The vertical dimension of the stripping notch 308 is slightly less the thickness of the thinnest coins so that only the upper coin is contacted and stripped. While the stripping notch 308 prohibits the further circumferential movement of the upper coin, the lower coin continues moving circumferentially across stripping notch 308 into a queuing channel 320.

Stacked coins that may have bypassed the stripping notch 308 by entering the entry area 304 downstream of the stripping notch 308 are unstacked after the coins enter the queuing channel 320 and are turned into an inner queuing wall 322 of the queuing channel 320. The upper coin contacts the inner queuing wall 322 and is channeled along the inner queuing wall 322 while the lower coin is moved by the pad 118 across the inner queuing wall 322 into a region defined by surface 314 wherein the lower coin engages a wall 315 and is recirculated. Other coins that are not properly aligned along the inner queuing wall 322, but that are not recirculated by wall 315, are recirculated by recirculating channel 317.

As the pad 118 continues to rotate, those coins that were initially aligned along the wall 306 (and the lower coins of stacked coins moving beneath the stripping notch 308) move across a ramp 323 leading to the queuing channel 320 for aligning the innermost edge of each coin along the inner queuing wall 322. In addition to the inner queuing wall 322, the queuing channel 320 includes a first rail 326 that forms the outer edge of surface 328 and a second rail 327 that forms the outer edge of beveled surface 329. The beveled surface 329 transitions downward from first rail 326 to second rail 327. A flat surface 339*x* is located radially outward of the second rail 327. The surfaces 328 and 329 are sized such that the width of surface 328 is less than that of the smallest (in terms of the diameter) coins and the combined width of surfaces 328, 329 is less than that of the largest coin. As a result, because surface 328 has a width less than that of the smallest diameter coin the sorting head is configured to sort, each coin has a portion thereof which extends beyond the outer periphery 118*a* of the rotating pad 118 as they enter a discrimination region 330.

The coins are gripped between one of the two rails 326, 327 and the pad 118 as the coins are rotated through the queuing channel 320. The coins, which were initially aligned with the outer wall 306 of the entry area 304 as the coins moved across the ramp 323 and into the queuing channel 320, are rotated into engagement with inner queuing wall 322. Because the queuing channel 320 applies a greater amount of pressure on the outside edges of the coins, the coins are less likely to bounce off the inner queuing wall 322 as the radial position of the coin is increased along the inner queuing wall 322.

It can be seen that the queuing channel 320 is generally "L-shaped." The queuing channel 320 receives the coins as the coins move across the ramp 323 and into the queuing channel 320. The coins exit the queuing channel 320 as the coins turn a corner 322*a* of the L-shaped queuing channel 320. L-shaped queuing channels are discussed in more detail in U.S. Pat. No. 7,743,902 incorporated herein by reference in its entirety. As the pad 118 continues to rotate, the coins move along the queuing channel 320 and are still engaged on the inner queuing wall 322. The coins move across a ramp

324 as the coins enter the discrimination region 330 and the inner queuing wall 322 transitions to an inner alignment wall 332. The discrimination region 330 includes a discrimination sensor 334 for discriminating between valid and invalid coins and/or identifying the denomination of coins.

As the pad 118 continues to rotate, the L-shape of the queuing channel 320 imparts spacing to the coins which are initially closely spaced, and perhaps abutting one another, as the coins move across the ramp 323 into the queuing channel 320. As the coins move along the queuing channel 320 upstream of corner 322*a*, the coins are pushed against inner queuing wall 322 and travel along the inner queuing wall 322 in a direction that is transverse to (i.e., generally unparallel) the direction in which the pad 118 is rotating. This action aligns the coins against the inner queuing wall 322. However, as the coins round the corner 322*a* of the queuing channel 320, the coins are turned in a direction wherein they are moving with the pad (i.e., in a direction more parallel to the direction of movement of the pad). A coin rounding the corner 322*a* is accelerated as the coin moves in a direction with the pad; thus, the coin is spaced from the next coin upstream. Put another way, the queuing channel 320 receives coins from the entry area 304 and downstream of corner 322*a* the queuing channel 320 is disposed in an orientation that is substantially more in the direction of movement of the rotatable disc 114 for creating an increased spacing between adjacent coins. Accordingly, the coins moving out of the queuing channel 220 are spaced apart. According to some embodiments of the present disclosure, the coins are spaced apart by at least about 10 mm or 0.40 inches when the sorting head 312 has an eleven inch diameter and the pad 118 rotates at a speed of approximately three hundred revolutions per minute (300 rpm) such as at approximately 320 rpm.

The coins move across ramp 324 and transition to a flat surface 339 of the discrimination region 330 as the pad 118 continues to rotate. Put another way, the two surfaces 328, 329 of the queuing channel 320 transition into the flat surface 339 of the discrimination region 330. The pad 118 holds each coin flat against the flat surface of the discrimination region 330 as the coins are moved past the discrimination sensor 334.

The sorting head 312 includes a cutout for the discrimination sensor 334. The discrimination sensor 334 is disposed flush with the flat surface 339 of the discrimination region 330 or recessed slightly within the sorting head 312 just above the flat surface 339 of the discrimination region 330. Likewise, a coin trigger sensor 336 is disposed just upstream of the discrimination sensor 334 for detecting the presence of a coin. Coins first move over the coin trigger sensor 336 (e.g., a photo detector or a metal proximity detector) which sends a signal to a controller (e.g., controller 180) indicating that a coin is approaching the coin discrimination sensor 334. According to some embodiments, the sensor 336 is an optical sensor which may employ a laser to measure a chord of passing coins and/or the length of time it takes the coin to traverse the sensor 336 and this information along with the information from the coin discrimination sensor is used to determine the diameter, denomination, and validity of a passing coin. Additional description of such embodiments may be found in U.S. Pat. No. 7,743,902, incorporated herein by reference in its entirety.

According to some embodiments, the coin discrimination sensor 334 is adapted to discriminate between valid and invalid coins. Use of the term "valid coin" refers to coins of the type the sorting head is designed or configured to sort. Use of the term "invalid coin" refers to items being circulated on the rotating disc that are not one of the coins the sorting head is designed to sort. Any truly counterfeit coins (i.e., a slug) are always considered "invalid." According to another alternative embodiment of the present disclosure, the coin discriminator sensor 334 is adapted to identify the denomination of the coins and discriminate between valid and invalid coins.

Some coin discrimination sensors suitable for use with the disc-type coin sorter shown in FIGS. 1A-3 are described in detail in U.S. Pat. Nos. 7,743,902; 5,630,494; and 5,743,373, each of which is incorporated herein by reference in its entirety. Another coin discrimination sensor suitable for use with the present disclosure is described in detail in U.S. Pat. No. 6,892,871, which is incorporated herein by reference.

As discussed above according to one alternative embodiment of the present disclosure, the discrimination sensor 334 discriminates between valid and invalid coins. Downstream of the discrimination sensor 334 is a diverting pin 342 disposed adjacent inner alignment wall 332 that is movable to a diverting position (out of the page as viewed in FIG. 3) and a home position (into the page as viewed in FIG. 3). In the diverting position, the diverting pin 342 directs coins off of inner alignment wall 332 and into a reject slot 349. The reject slot 349 includes a reject surface 343 and a reject wall 344 that rejected coins abut against as they are off-sorted to the periphery of the sorting head 312. Off-sorted coins are directed to a reject area (not shown). Coins that are not rejected (i.e., valid coins) eventually engage an outer wall 352 of a gauging channel or region 350 where coins are aligned on a common outer radius for entry into the coin exit station or exit slot area 360 as is described in greater detail below.

According to some embodiments of the present disclosure, the diverting pin 342 is coupled to a voice coil 190 (not shown) for moving the diverting pin 342 between the diverting position and the home position. More details on diverting pins such as diverting pins 242 and 342 and voice coils are discussed in U.S. Pat. No. 7,743,902, incorporated herein by reference in its entirety. Other types of actuation devices can be used in alternative embodiments of the present disclosure instead of voice coils. For example, a linear solenoid or a rotary solenoid may be used to move a pin such as diverting pin 342 between a diverting position and a home position.

As the pad 118 continues to rotate, those coins not diverted into the reject slot 349 continue to the gauging region 350. The inner alignment wall 332 terminates just upstream of the reject slot 349; thus, the coins no longer abut the inner alignment wall 332 at this point. The radial position of the coins is maintained, because the coins remain under pad pressure, until the coins contact an outer wall 352 of the gauging region 350. According to some embodiments, the sorting head 312 includes a gauging block 354 which extends the outer wall 352 beyond the outer periphery 118*a* of the rotating pad 118.

The gauging wall 352 extends radially inward in the counterclockwise direction as viewed in FIG. 3 so as to align the coins along a common outer radius 356 which is positioned outboard of the outer periphery 118*a* of the rotating pad 118 and the outer periphery 312*a* of the sorting head 312 as the coins approach a series of coin exit slots 361-366 which discharge coins of different denominations. Accordingly, as each coin approaches the exit slots 361-366, a portion of each coin is positioned outside the periphery 118*a* of the rotating pad 118 and the outer periphery 312*a* of the sorting head 312. The first exit slot 361 is dedicated to the smallest diameter coin to be sorted (e.g., the dime in the U.S.

coin set). Beyond the first exit slot 361, the sorting head 312 shown in FIG. 3 forms five more exit slots 362-366 which discharge coins of different denominations at different circumferential locations around the periphery of the sorting head 312. Thus, the exit slots 361-366 are spaced circumferentially around the outer periphery 312*a* of the sorting head 312 with the innermost edges 361*a*-366*a* of successive channels located progressively closer to the center C3 of the sorting head 312 so that coins are discharged in the order of increasing diameter. The number of exit slots can vary according to alternative embodiments.

The innermost edges 361*a*-366*a* of the exit slots 361-366 are positioned so that the inner edge of a coin of only one particular denomination can enter each channel 361-366. The coins of all other denominations reaching a given exit slot extend inwardly beyond the innermost edge of that particular exit slot so that those coins cannot enter the channel and, therefore, continue on to the next exit slot under the circumferential movement imparted on them by the pad 118. To maintain a constant radial position of the coins, the pad 118 continues to exert pressure on the coins as they move between successive exit slots 361-366.

According to some embodiments of the sorting head 312, each of the exit slots 361-366 includes a coin counting sensor 371-376 for counting the coins as coins pass through and are discharged from the coin exit slots 361-366. In embodiments of the coin processing system utilizing a discrimination sensor 334 capable of determining the denomination of each of the coins, it is not necessary to use the coin counting sensors 371-376 because the discrimination sensor 334 provides a signal that allows the controller 180 to determine the denomination of each of the coins. Through the use of the system controller 180 (FIG. 1B), a count is maintained of the number of coins discharged by each of the exit slots 361-366.

Now that the overall sorting heads 212 and 312 have been described, particular areas of these sorting heads will be described in more detail.

Reject Areas

Figure 4A:
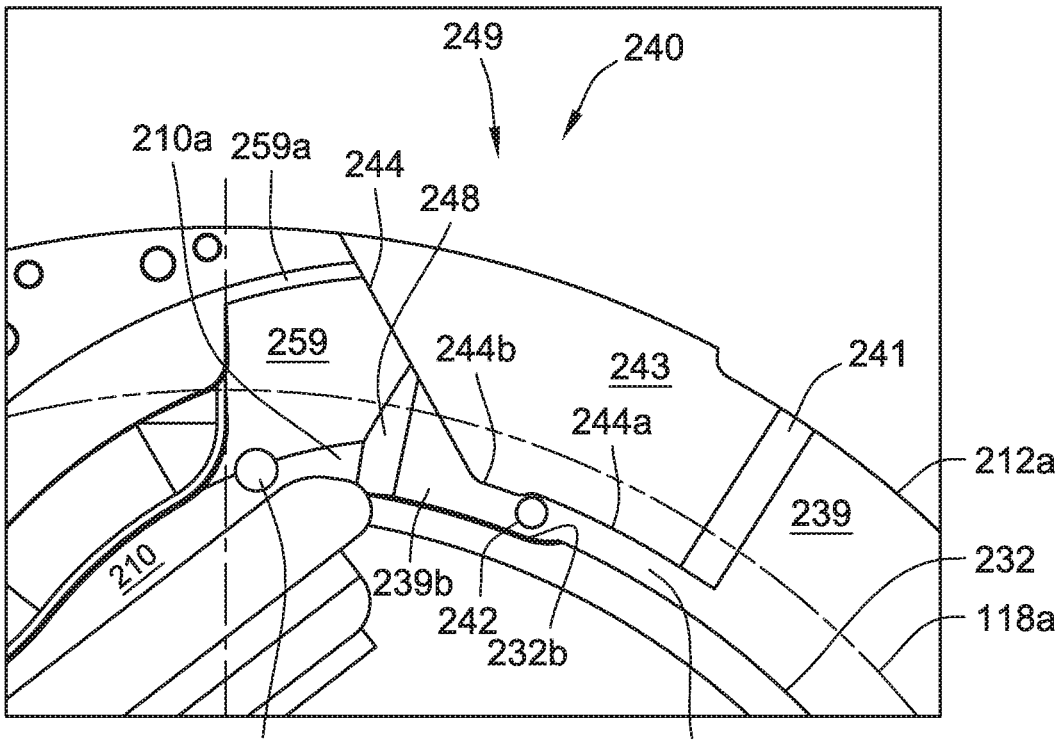
FIG. 4A is a bottom plan view of a reject region of the sorting head of FIG. 2.
Figure 4B:
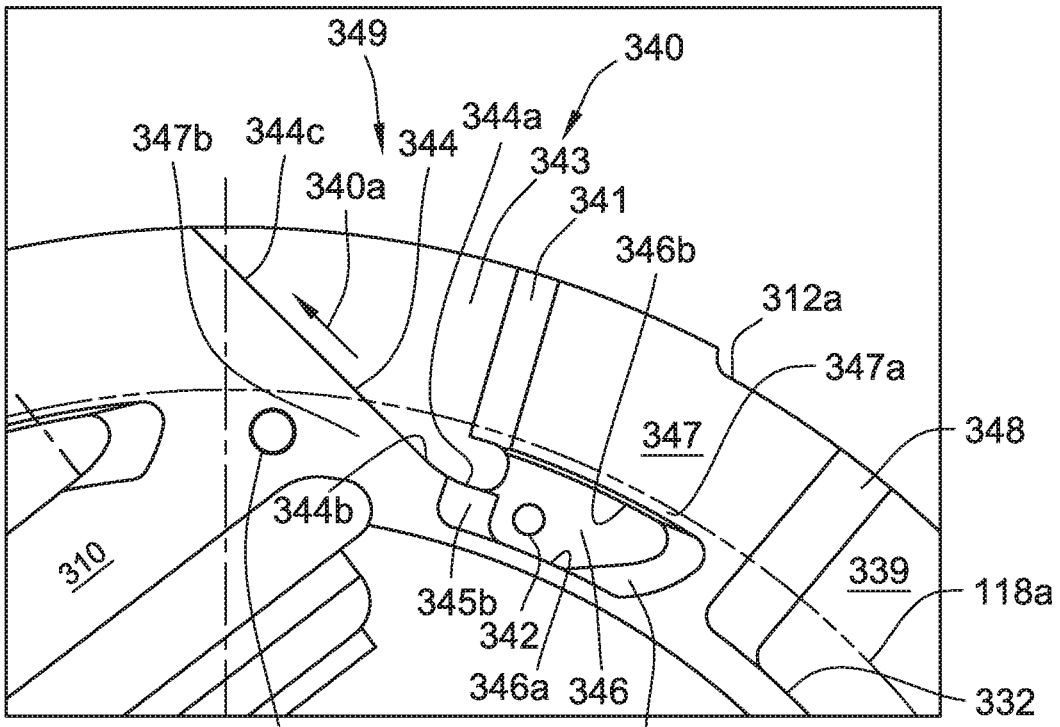
FIG. 4B is a bottom plan view of a reject region of the sorting head of FIG. 3.
Figure 5A:
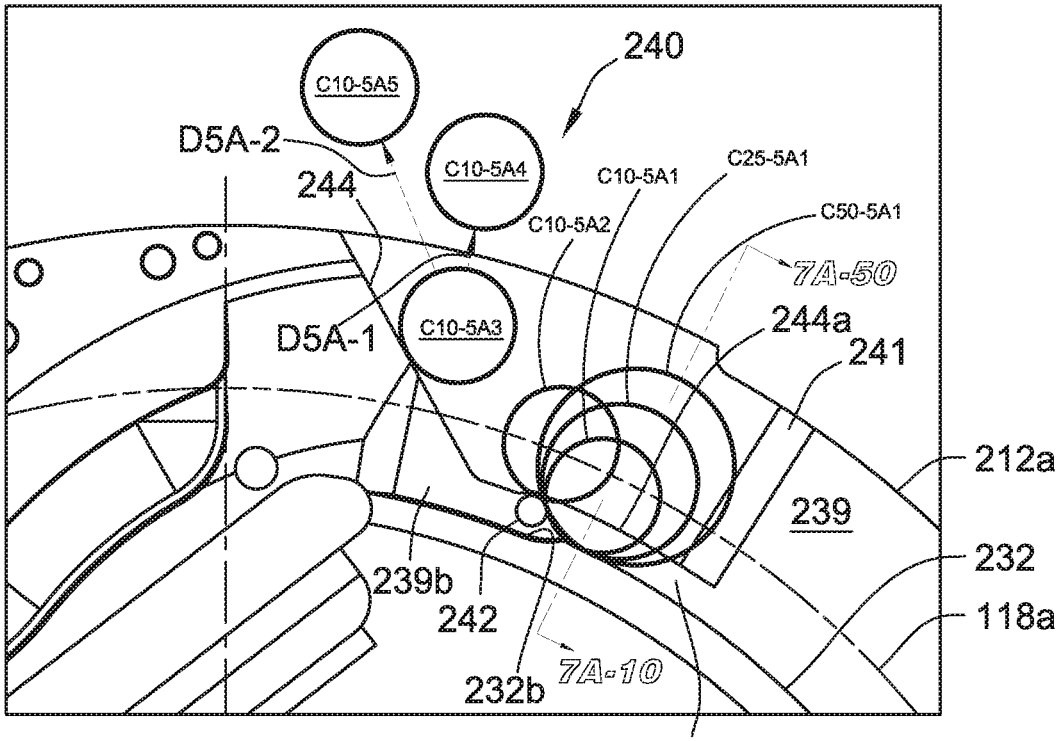
FIG. 5A is a bottom plan view of reject region or area of sorting head of FIG. 2 with representations of coins in the reject region.
Figure 5B:
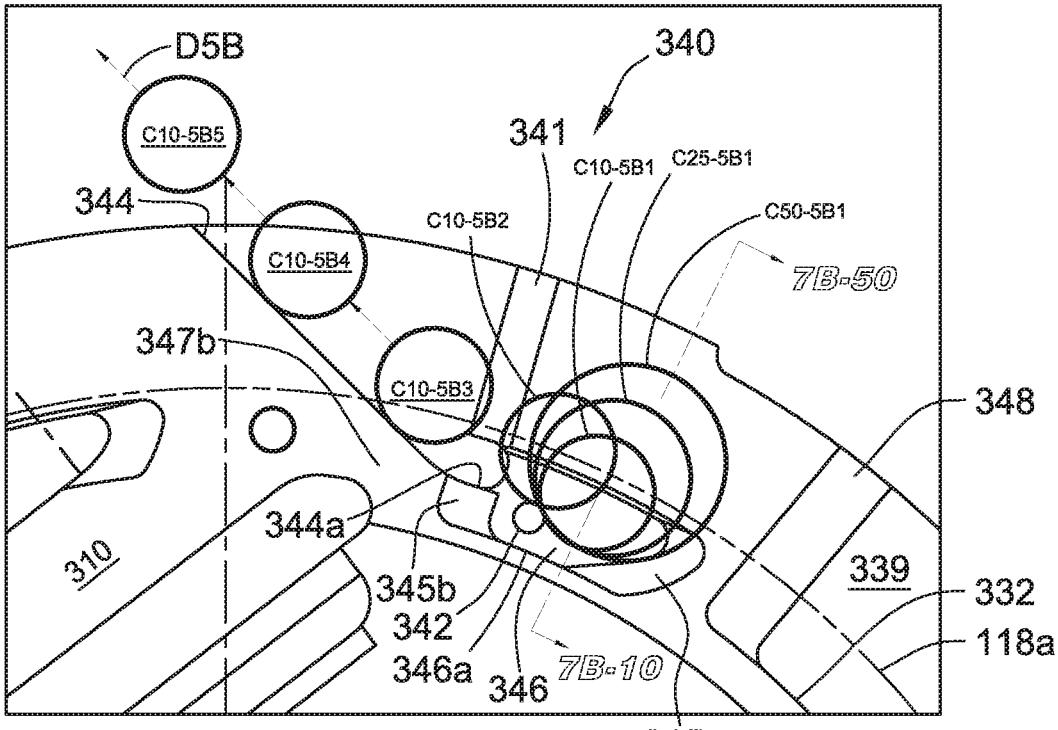
FIG. 5B is a bottom plan view of reject region or area of sorting head of FIG. 3 with representations of coins in the reject region.
Figure 6A:
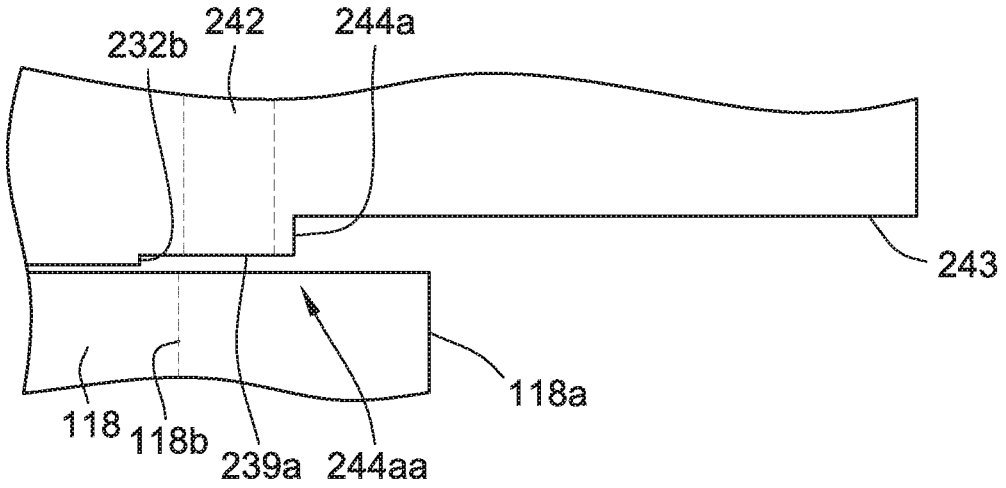
FIG. 6A is a partial cross-sectional view of the reject region of FIG. 5A in a location near a diverter pin.
Figure 6B:
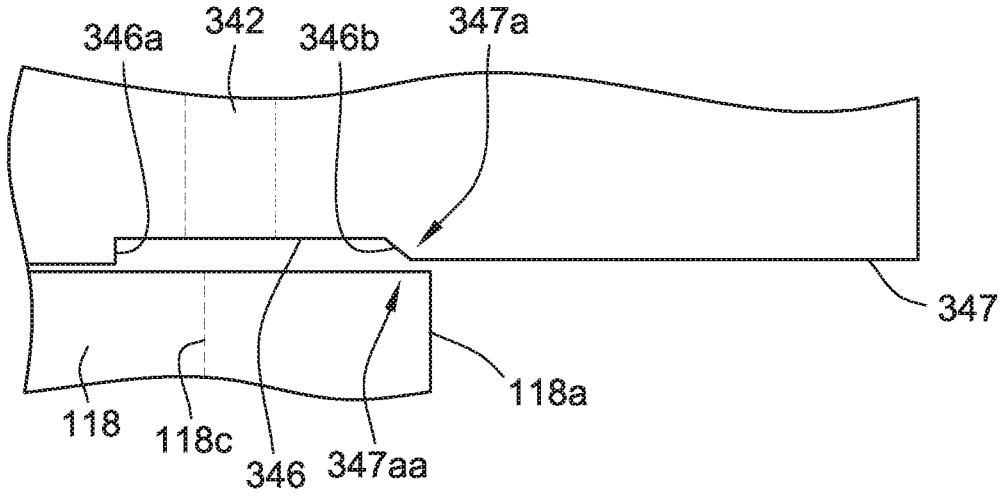
FIG. 6B is a partial cross-sectional view of the reject region of FIG. 5B in a location near a diverter pin.
Figure 7B:
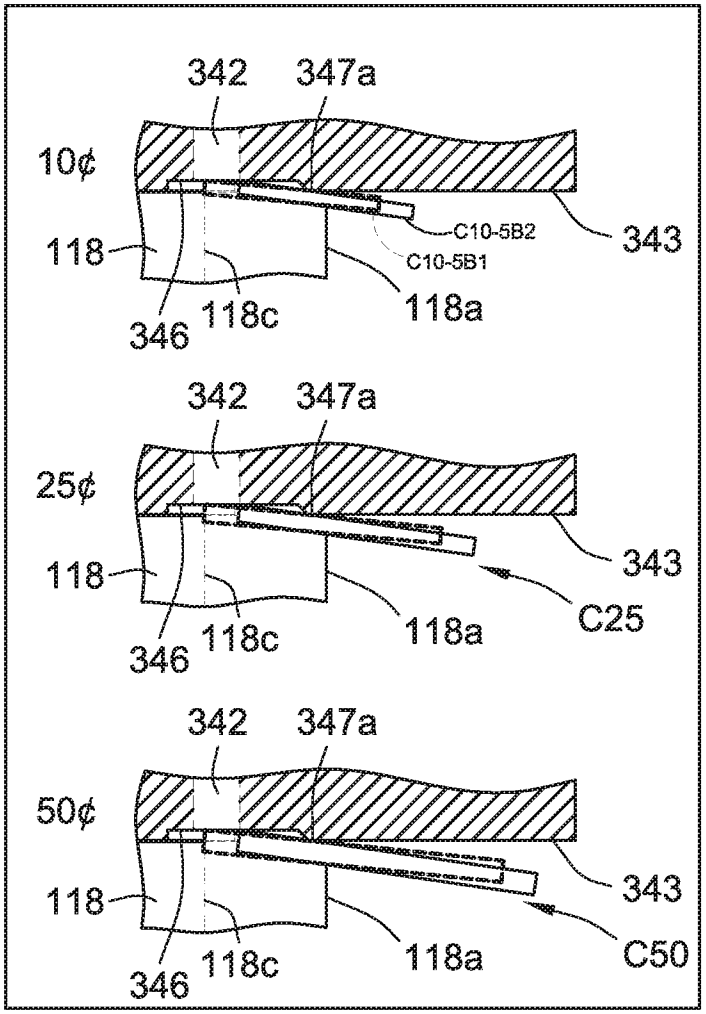
FIG. 7B is a partial cross-sectional view of the reject region of FIG. 5B at two locations near a diverter pin illustrating the tilt of exemplary coins (US 10¢, 25¢, and 50¢ coins) in the reject region.
Figure 7A:
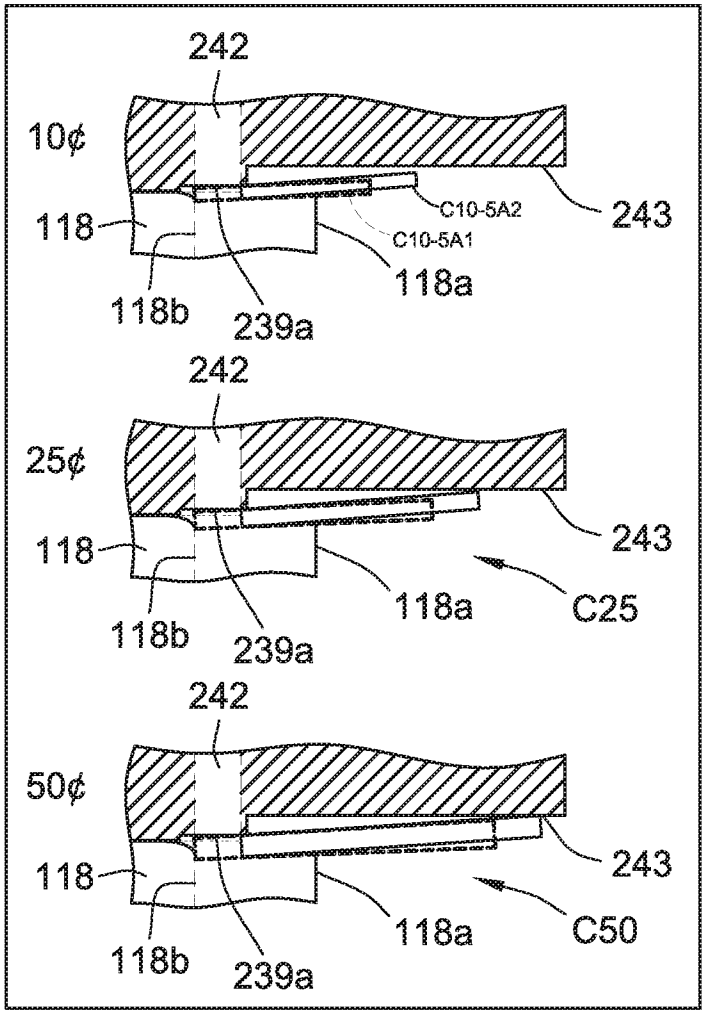
FIG. 7A is a partial cross-sectional view of the reject region of FIG. 5A at two locations near a diverter pin illustrating the tilt of exemplary coins (US 10¢, 25¢, and 50¢ coins) in the reject region.

FIGS. 4A and 4B are bottom plan views of reject regions 240, 340 of sorting heads 212, 312, respectively, and FIGS. 5A and 5B are bottom plan views of reject regions or areas 240, 340 of sorting heads 212, 312, respectively, with representations of coins in the reject regions. FIGS. 6A and 6B are partial cross-sectional views of the sorting heads 212, 312, respectively, and pad 118 in a location near the diverter pins 242, 342. FIGS. 7A and 7B are partial cross-sectional views of the sorting heads 212, 312, respectively, and pad 118 at two locations near the diverter pins 242, 342 illustrating the tilt of exemplary coins (US 10¢, 25¢, and 50¢ coins) in the reject regions 240, 340, respectively.

Turning to FIGS. 4A and 5A, as described above, the reject region 240 of sorting head 212 comprises a reject surface 243, a diverter pin 242, and a reject wall 244. A coin approaches diverter pin 242 having an inner edge aligned along inner alignment wall 232. The inner alignment wall 232 is positioned radially inward near the diverter 242 to a relieved portion 232*b* of the inner alignment wall 232. The reject wall 244 has an upstream portion 244*a* near the diverter pin 242. The coins are initially maintained in a relatively flat position as surface 239 extends from the inner alignment wall 232 to the edge 212*a* of the sorting head 212. An outward portion of the surface of the sorting head 212 then transitions upward via ramp 241 which leads up into an elevated surface 243 of the reject slot 249. A ledge 239*a* keeps a passing coin approaching diverter 242 under positive control by pinching the coin between ledge 239*a* and the rotating pad 118. If the diverter 242 remains in its retracted upper position as the coin passes under it, the coin remains gripped between the ledge 239*a* and pad 118 and eventually the coin reaches a downstream portion 239*b* of the ledge whereat the coin has passed the reject slot 249.

Region 210*a* is at "0" depth, meaning at the lowermost surface of the sorting head. Surface 259 is beveled from a "0" depth adjacent to region 210*a* upward as toward a higher region 259*a* near the outer portion of sorting head 212. Ramp 248 is a beveled surface extending downward from downstream portion 239*b* of the ledge to area 210*a*. As a non-rejected coin passes over downstream portion 239*b*, a portion of the coin may be dragged under the edge of reject wall 244 and down ramp 248 and into contact with beveled surface 259. The movement of a coin over this region can cause some coins to flutter which can cause wear of the sorting head on surfaces 248 and 259 and on the bottom edge of wall 244.

If, however, the diverter pin 242 is in its extended lower position, the coin strikes the diverter pin 242, bounces away from inner alignment wall 232 and out from under ledge 239*a* and enters the reject slot 249, strikes reject wall 244 and then travels out from under the sorting head 212.

FIG. 6A is a partial cross-sectional view of the sorting head 212 and pad 118 in a region near the diverter pin 242 when no coin is present. FIG. 7A illustrates partial cross-sectional views of the sorting head 212 and pad 118 at two locations near diverter pin 242 illustrating the tilt of exemplary coins (US 10¢, 25¢, and 50¢ coins). In a first location where coins are about to first abut diverter pin 242 shown by exemplary (a) coin C10-5A1 for a dime and the cross-section taken through the middle of the dime along line 7A-10 shown in FIG. 5A, (b) coin C50-5A1 for a half dollar and the cross-section taken through the middle of the half dollar along line 7A-50 shown in FIG. 5A, and (c) coin C25-5A1 for a quarter through the middle of the quarter (the cross-section line not being shown in FIG. 5A). Coins in this first location are shown in dashed lines in FIG. 7A. The second location is where coins are positioned to the radially outside surface or edge of diverter pin 242 as shown for a dime by position C10-5A2 in FIG. 5A. Coins in this second location are shown in solid lines in FIG. 7A. According to some embodiments, in FIG. 7A, the radially outward upward tilt of the dime is about 2.5° at the first location (dashed coin C10-5A1) and about 4.4° at the second location (solid coin C10-5A2), the radially outward upward tilt of the quarter is about 2.7° at the first location (dashed coin) and about 4.4° at the second location (solid coin), and the radially outward upward tilt of the half dollar is about 3.2° at the first location (dashed coin) and about 3.9° at the second location (solid coin).

Turning to FIG. 6A, the portion 232*b* of the inner alignment wall 232 is illustrated along with ledge 239*a*, the upstream portion 244*a* of reject wall 244, and reject surface 243. The ledge 239*a* and portion 244*a* of the reject wall 244 meet at a corner 244*aa*. As coins approach this area, their inner edges are aligned with line 118*b* which is at a radial distance equivalent of inner alignment wall 232.

Figure 7C:
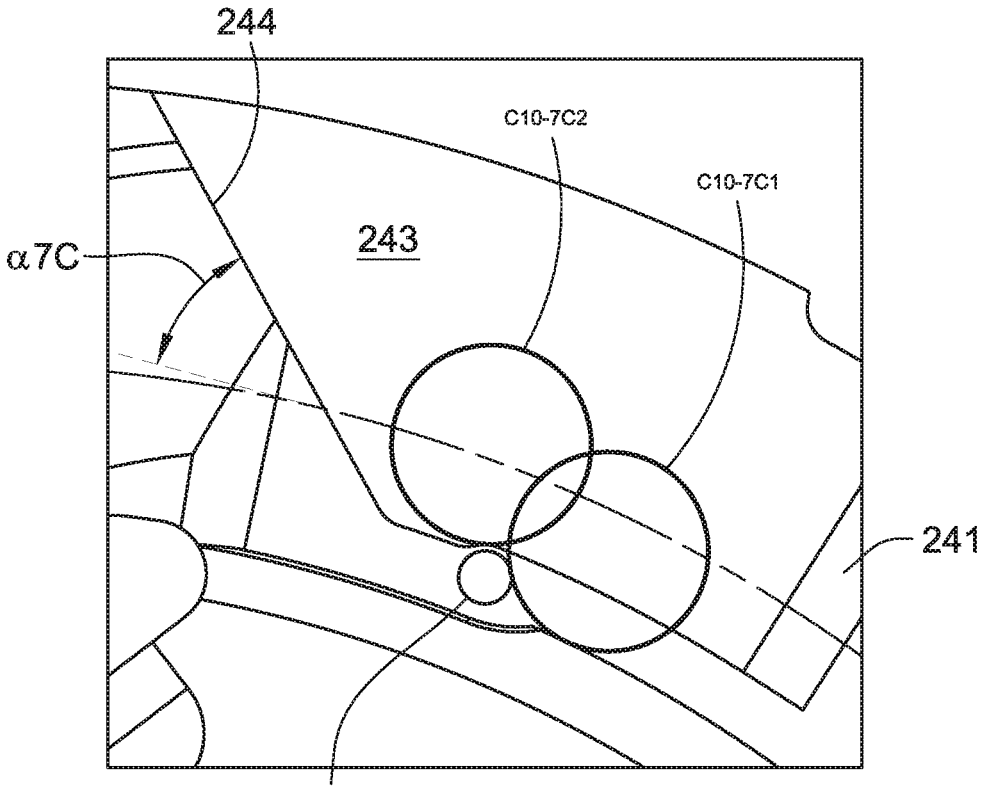
FIG. 7C is a bottom plan view of a reject region of the sorting head of FIG. 2 illustrating the range ad hence the duration of "pad controlled drive" of a rejected dime from first pin contact to end of pad-to-disc grip.

As seen in FIG. 7A, a coin pinched between resilient rotating pad 118 and ledge 239*a* is tilted upward in a radially outward direction (the inner edge of the coin is lower than the outer edge). At the first location (coins shown in dashed lines) just before or as coins strike the diverter 242, they are pinched between the pad 118 and the sorting head 212 between roughly line 118*b* and the corner 244*aa*. At the second location when the coins to be rejected are adjacent the radial outside surface or edge of the diverter pin 242, the coins are barely under any pad pressure as pad pressure is exerted only over a minimal distance between the inner edge of each coin and corner 244*aa*. As a result, coins striking diverter 242 are almost immediately released from pad pressure as coins are ejected out from under edge 244*aa* and control over the rejected coins is lost. The resulting almost immediate loss of control over a rejected coin can yield a less than predictable trajectory of rejected coins. FIG. 7C illustrates the range and hence the duration of "pad controlled drive" of a rejected dime from first pin contact C10-7C1 to end of pad-to-disc grip C10-7C2. That is, the position of dime C10-7C1 illustrates where a rejected dime first strikes the diverter pin 242 while the position of dime C10-7C2 illustrates the last position where a rejected dime is when any kind of pad control is present. As can be seen, pad control over a rejected dime is lost prior to the dime striking reject wall 244. As seen in FIG. 7C, reject wall 244 downstream of bend 244*b* is angled from a line tangent to a circumference intersecting the downstream straight portion of reject wall 244 by an angle α7C. According to some embodiments, angle ζ7C is about 43°.

Turning back to FIG. 5A, exemplary paths of a rejected dime are shown. For example, a dime striking pin 242 may move from position C10-5A2 and then strike reject wall 244 such as at position C10-5A3 and then either to position C10-5A4 along direction D5A-1 or position C105-A5 along direction D5A-2. The lack of control over the manner and direction in which rejected coins leave the reject slot 249 can cause problems when the rejected coins come into contact with hardware such as a coin chute or external diverter designed to redirect the coins. Exemplary coin chutes and external diverters are described in more detail in U.S. Pat. Nos. 6,039,644 and 7,743,902, each of which is incorporated herein by reference in its entirety. For example, a rejected coin could be ejected from reject slot 249 in a manner whereby it strikes the back of a coin chute and bounces back into the path of a subsequently rejected coin and the collision of the coins could result in a jam forming in the chute. Such a jam of coins in a coin chute can even lead to a backup of coins back into the reject slot 249.

According to some embodiments, coins approach the reject area 240 aligned radially to a common inner edge of 5.010" radius on top of the rotating, resilient disc pad 118 having a 5.500" radius outer edge. That is, the inner alignment wall 232 is positioned at a radius of 5.010" from the center C of the pad (center C2 of the sorting head 212). All coins overhang the outer edge 118*a* of the coin pad 118. The sorting head 212 "ceiling" of surface 239 extends radially beyond the outermost edge of the largest diameter coin in the coin set at a height of approximately 0.025" above the coin pad 118 surface. The coins rotated toward the reject area 240 are pressed into the coin pad 118 by a distance equivalent to their thickness, less 0.025". When the coins enter the reject area 240, the sorting head 212 ceiling is raised beyond an edge of a radius of 5.220", that is, the upstream portion 244*a* of reject wall 244 is positioned at a radius of 5.220" and the reject slot 249 has an elevated surface 243 located beyond that radius. The edge of the raised ceiling (at wall portion 244*a*) of the reject surface 243 is now significantly inboard of the outer edge of all coins in the coin set (e.g., U.S. coins) as well as inboard of the outer pad edge 118*a*. With the disc ceiling raised in reject slot 249, the upward pressure exerted by the pad 118 lifts the outer portion of the coin, resulting in a tilted condition of the coin as discussed above and shown in connection with FIG. 7A.

As discussed above, coins to be rejected are rotated within the reject area 240, in the above discussed pressed (i.e., under pad pressure) and tilted condition, toward an extended reject pin 242 which projects into the coin path by a distance of approximately 0.025" to 0.030". As the coins to be rejected are driven into contact with the reject pin 242, they are driven outward beyond the outer edge of the pad and hurled toward a reject chute leading to a reject coin collection area.

Figure 7D:
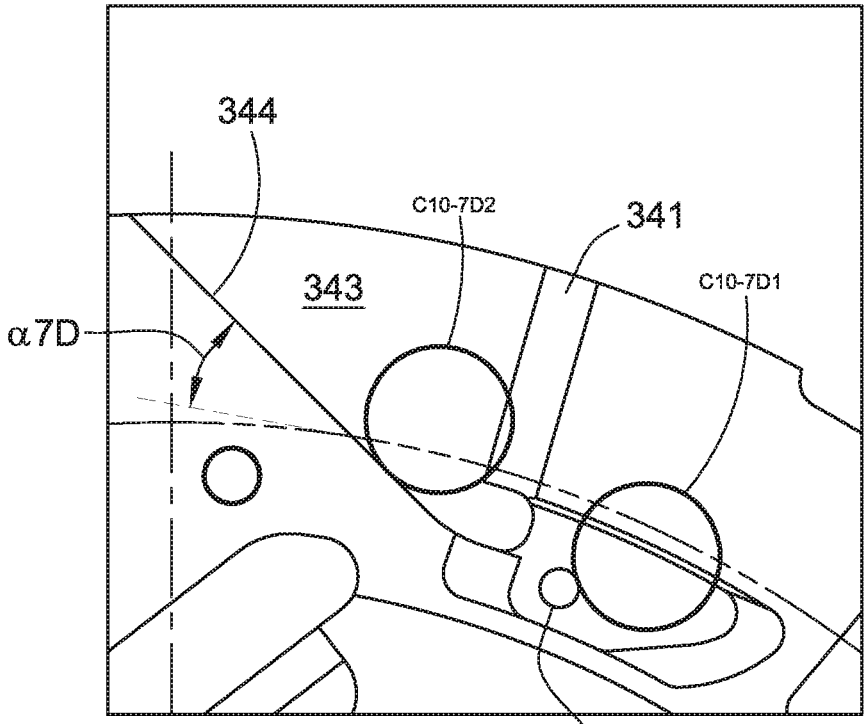
FIG. 7D is a bottom plan view of a reject region of the sorting head of FIG. 3 illustrating the range and hence the duration of "pad controlled drive" of a rejected dime from first pin contact to end of pad-to-disc grip.
Figure 7E:
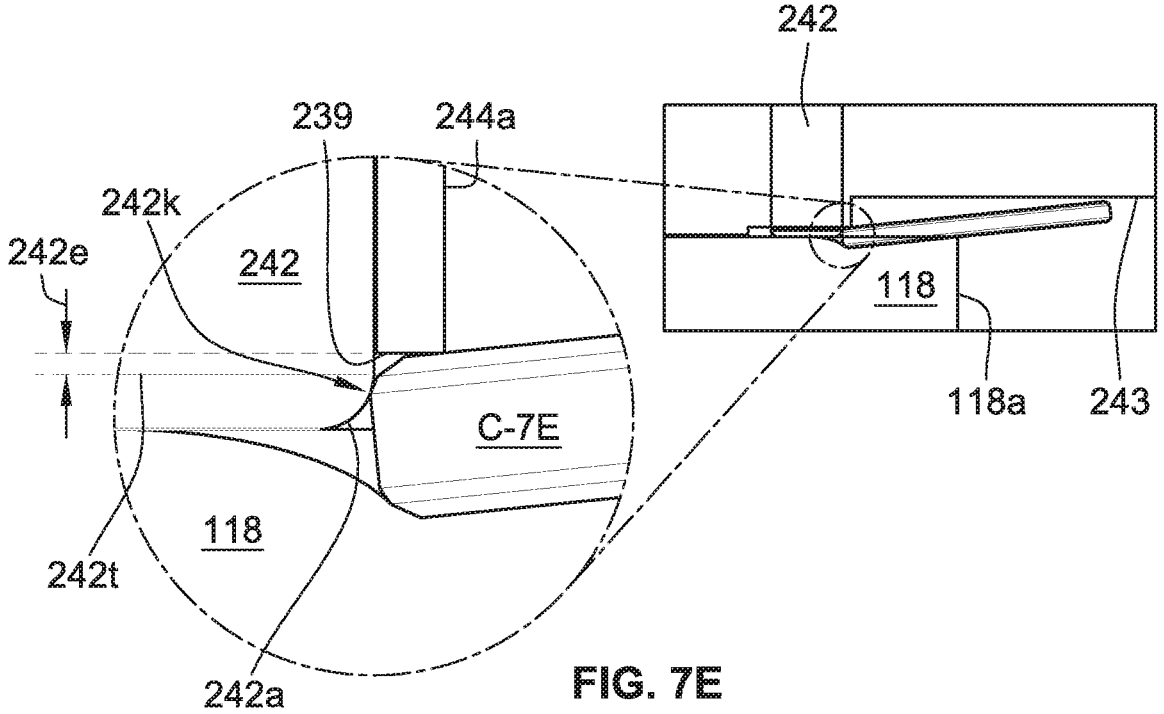
FIG. 7E is an enlarged, cross-sectional view of a rejected coin abutting an outside, lower corner of a diverter pin in the reject region of FIG. 4A.

Turning to FIG. 7E, an enlarged, cross-sectional view of a rejected coin C-7E abutting the outside, lower corner of diverter pin 242 is illustrated. The diverter pin 242 is rounded near its lower end. The point below which the vertical sides of diverter pin 242 begin to round is indicated by line 242*t*. The exposed vertical side of diverter pin 242 between line 242*t* and surface 239 has a height indicated by 242*e* which according some embodiments is about 0.007 inches. While the reject pin 242 extends a specific distance downward into the coin stream, the tilted coin contacts only a portion of that extended length at or near the rounded corner 242*a*. The larger the tilt angle of a coin to be rejected, the less pin surface is contacted. Coins striking the pin 242 will, over time, wear away the outer surface of the pin near corner 242*a*. Once this wear reaches a certain point, the diverter pin 242 will no longer redirect a coin to be rejected sufficiently outward so that it enters the reject surface 243, instead allowing a reject coin to pass the reject area 240 and to move on toward exit slots 261-266 and then potentially into a container for acceptable coins. Additionally, when coins strike the diverter pin 242 below line 242*t*, they can cause the diverter pin 242 to move upward and allow a coin to be rejected to pass underneath the diverter pin and onto gauging area 250.

Additionally, turning back to FIG. 4A, as discussed above, acceptable/non-rejected coins are rotated through the reject area 240, past the retracted reject pin 242, along a narrow ledge 239*a* which narrows further beyond the diverter pin 242 as the edge of reject wall 244 moves inward to wall portion 244*b* which is positioned at a radius of 5.175" according to some embodiments. The acceptable/non-rejected coins are then dragged by this slight grip of the pad 118 into a downward ramped surface 248 beyond the reject wall 244 and onward toward the exit slots 261-266. The tilted condition of the coins as they are dragged past the reject wall causes a "slapping" of the coins onto the flat disc surface 239*b* and the ramp 248 leading from the recessed reject area 240. Over time, this slapping impact of the coins pounds a curved dent into the ramp surface 248. The edge of this dent acts to stall coin travel.

A flow sensor 410*a* is positioned just beyond the reject wall 244 to identify any passing coin. The passing coin may be an accepted coin, or as previously described a reject coin which bypassed rejection. As the specific position of the coin on the pad 118 and the timing of pad rotation are precisely monitored, the flow sensor expects each accepted coin to be detected within a certain time window. If the coin experiences any delay, due to slipping, dragging, or stalling, its motion may exceed the pre-determined sensing window timeframe and trigger an error condition.

As will be described below, the reject area 340 addresses all of these conditions by providing a more positive and predictable control of coins throughout the new reject area 340, increasing stability, decreasing wear and tear on the sorting disc 312, reject pin 342, coin pad 118 and on the coins themselves. At the same time, the projection of the reject pin 342 and the level of pad pressure on the coins are increased, helping to ensure that coins are driven in a controlled manner, and in a specific direction.

Turning to FIGS. 4B and 5B, as described above, the reject region 340 of sorting head 312 comprises a reject surface 343, a diverter pin 342, and a reject wall 344. A coin approaches diverter pin 342 having an inner edge aligned along inner alignment wall 332. The reject wall 344 has an upstream wall portion 344*a* near the diverter pin 342. According to some embodiments, the upstream wall portion 344*a* is located just radially inward of the outside edge of the diverter pin 342. The coins are initially maintained in a relatively flat position as surface 339 extends from the inner alignment wall 332 to the edge 312*a* of the sorting head 312. The entire portion of the surface of the sorting head 312 outward of inner alignment wall 332 then transitions downward via ramp 348 which leads down to a lower surface 347. From a radius just inward of the outer edge 118*a* of the rotating resilient pad 118 and extending to the outer edge 312*a* of the sorting head 312 the surface 347 continues until reaching a ramp 341 which leads up into reject surface 343. An elevated portion or surface 346 of the sorting head has an outer wall 346*b* positioned at a radius just inward of the outer edge 118*a* of the resilient pad 118 and an inward wall 346*a* near a radius slightly inward of the radius of the inner alignment wall 332. An upstream ramp 345*a* leads up from surface 347 to elevated portion or recess 346. The diverter pin 342 is positioned within elevated portion 346 which is elevated from surface 347 by about half as much as rejected channel 343. The surface 347 generally surrounds elevated portion 346. On the downstream side of the diverter pin 342, elevated portion 346 transitions back down to the level of surface 347 in the region of 347*b* via downward ramp 345*b* positioned near the radius of the inner alignment wall 332. According to some embodiments, the surface 347 including region 347*b* have the same depth as surface 310, namely, a "0" depth, meaning at the lowermost surface of the sorting head 312. Surface 347 has a small area 347*a* extending from outer wall 346*b* of the elevated portion 346 to a radius corresponding to the outer edge 118*a* of the resilient pad 118.

FIG. 6B is a partial cross-sectional view of the sorting head 312 and pad 118 in a region near the diverter pin 342 when no coin is present. FIG. 7B illustrates partial cross-sectional views of the sorting head 312 and pad 118 at two locations near diverter pin 342 illustrating the tilt of exemplary coins (US 10¢, 25¢, and 50¢ coins). As above with respect to FIG. 7A, in FIG. 7B the first location is the location where coins are about to first abut diverter pin 342 and the second location is where coins are positioned adjacent to the outside edge of diverter pin 342. In FIG. 5B, the first location is shown by exemplary (a) coin C105-B1 for a dime and the cross-section taken through the middle of the dime along line 7B-10 shown in FIG. 5B, (b) coin C50-5B1 for a half dollar and the cross-section taken through the middle of the half dollar along line 7B-50 shown in FIG. 5B, and (c) coin C25-5B1 for a quarter through the middle of the quarter (the cross-section line not being shown in FIG. 5B). The second location is shown for a dime by position C10-5B2 in FIG. 5B. In FIG. 7B coins in this first location are shown in dashed lines and coins in this second location are shown in solid lines. According to some embodiments, in FIG. 7B, the radially outward downward tilt of the dime is about 5.5° at the first location (dashed coin C10-5B1) and about 8.1° at the second location (solid coin C10-5B2), the radially outward downward tilt of the quarter is about 5.4° at the first location (dashed coin) and about 8.1° at the second location (solid coin), and the radially outward downward tilt of the half dollar is about 5.5° at the first location (dashed coin) and about 8.3° at the second location (solid coin). According to some embodiments, the radial outward downward tilt of coins at the first location in the reject area 340 is greater than about 5°. According to some embodiments, the radial outward downward tilt of coins in the reject area 340 is greater than about 4° or 4.5°. According to some embodiments, the radial outward downward tilt of coins in the reject area 340 is greater than about 2°. According to some embodiments, the radial outward downward tilt of coins in the reject area 340 is between about 2° and 7°. According to some embodiments, the radial outward downward tilt of coins at the second location in the reject area 340 is greater than about 8°. According to some embodiments, the radial outward downward tilt of coins in the reject area 340 (such as at the second location) is greater than about 7° or 7½°. According to some embodiments, the radial outward downward tilt of coins in the reject area 340 (such as at the second location) is between about 5° and 11°.

Turning to FIG. 6B, the elevated surface 346 and its inward wall 346*a* and outward wall 346*b* are illustrated along with surface 347, small area 347*a*, and corner 347*aa* where area 347*a* meets the bottom of wall 346*b*. As coins approach this area, their inner edges are aligned with line 118*c* which is at a radial distance equivalent of inner alignment wall 332. According to some embodiments, the elevated surface 346 is about 0.035-0.045 inches above surface 347.

As a coin approaches the reject region 340, it is pressed against surface 339, down ramp 348, and then pressed against surface 347. Then the inner edge of the coin travels up ramp 345*a* and then along surface 346 and becomes tilted as illustrated in FIG. 7B. As seen in FIG. 7B, a coin pinched between resilient rotating pad 118 and corner 347*aa* is tilted downward in a radially outward direction (the inner edge of the coin is higher than the outer edge). At the first location (shown in dashed lines) just before or as coins strike the diverter 342, they are pinched between the pad 118 and the sorting head 312 between roughly line 118*c* and the corner 347*aa*. At the second location when the coins to be rejected are adjacent the diverter pin 342, the coins are still maintained under significant pad pressure as pad pressure is exerted over the distance between the inner edge of each coin and corner 347*aa*. As a result, coins striking diverter 342 are not immediately released from pad pressure and control over the rejected coins is maintained. FIG. 7D illustrates the range and hence the duration of "pad controlled drive" of a rejected dime with sorting head 312 from first pin contact C10-7D1 to end of pad-to-disc grip C10-7D2. That is, the position of dime C107-D1 illustrates where a rejected dime first strikes the diverter pin 342 while the position of dime C10-7D2 illustrates the last position where any kind of pad pressure control is present. As can be seen, pad pressure control over a rejected dime is maintained until after the dime strikes reject wall 344. The resulting maintenance of control over a rejected coin yields a predictable trajectory of rejected coins. As seen in FIG. 7D, reject wall 344 downstream of bend 344*b* is angled from a line tangent to a circumference intersecting straight portion 344*c* of reject wall 344 by an angle α7D. According to some embodiments, angle α7D is about 30°. According to some embodiments, angle α7D is between about 25° and 35°.

A comparison of FIGS. 7A and FIG. 7B shows more pad/sort head contact on coins before and after coins strikes diverter pin 342 for reject area 340 versus reject area 240. As discussed above, the design of reject area 340 keeps a coin under pad pressure even after the coin strikes pin 342. Rejected coins remain under pad pressure as coin continues to move along surface 347 and up ramp 341. Pad pressure remains on the outward side of a rejected coin until coin almost reaches top of ramp 341 and enters reject slot 349. Meanwhile, the inward side of a rejected coin remains under pad pressure as the inward side of the rejected coin travels up ramp 345*a* and moves through elevated recess region 346 and even after striking pin 342. Before a rejected coin is completely released from pad pressure it has already contacted reject wall 344 in an upstream area 344*a* of reject wall and through bend 344*b* of reject wall 344. Thus, the release trajectory of a rejected coin is in the direction 340*a* (FIG. 4B) parallel to a straight portion 344*c* of reject wall 344 before the coin is completely released from being under pad pressure. This leads to a smooth and more predictable release of rejected coins.

Turning back to FIG. 5B, the path of a rejected dime is shown. A dime striking pin 342 moves from position C10-5B2, is guided by upstream wall portion 344*a* and bend 344*b* of the reject wall 344 to position C10-5B3 while still under pad control and then follows along wall 344 to position C10-5B4 and then to position C10-5B5 along direction D5B. According to some embodiments, coins first engage reject wall 344 at a point past bend 344*b*. For example, in the case of a dime, according to some embodiments, dimes first contact reject wall 344 at a location downstream of bend 344*b* but just upstream of the position depicted by position C10-5B3. As can be seen in, for example, FIGS. 4B and 5B, the reject surface 343 of the reject slot 349 is defined by the shape of reject wall 344 and the upper edge of ramp 341 and has a rounded peninsula extending upstream of the inner edge of ramp 341 toward recess 346. The upstream end 344*a* is positioned at a radial location just radially inward of the outside edge of the diverter pin 342. According to some embodiments, rejected coins repositioned to the outside edge of reject pin 342 proceed to engage wall portion 344*a*. According to some embodiments, the bend 344*b* of the reject wall 344 is a gentle bend and assists with smoothly guiding rejected coins into a direction parallel to the outwardly extending straight portion 344*c*. According to some embodiments, the radius of bend 344*b* is a little larger than the radius of the largest coin to be sorted. According to some embodiments, the outwardly extending straight portion 344*c* is oriented at or nearly 60° from a radius of the rotating pad 118 intersecting the straight portion 344*c* (or 30° from a circumference intersecting the straight portion 344*c* as seen by angle α7D shown in FIG. 7D). According to some embodiments, this angle may be between about 25° and 35°. The control over the manner and direction in which rejected coins leave the reject slot 349 alleviates problems discussed above in connection with reject region 240. An exemplary chute for receiving rejected coins from reject slot 349 is described below in connection with FIGS. 16 and 17.

Figure 4C:
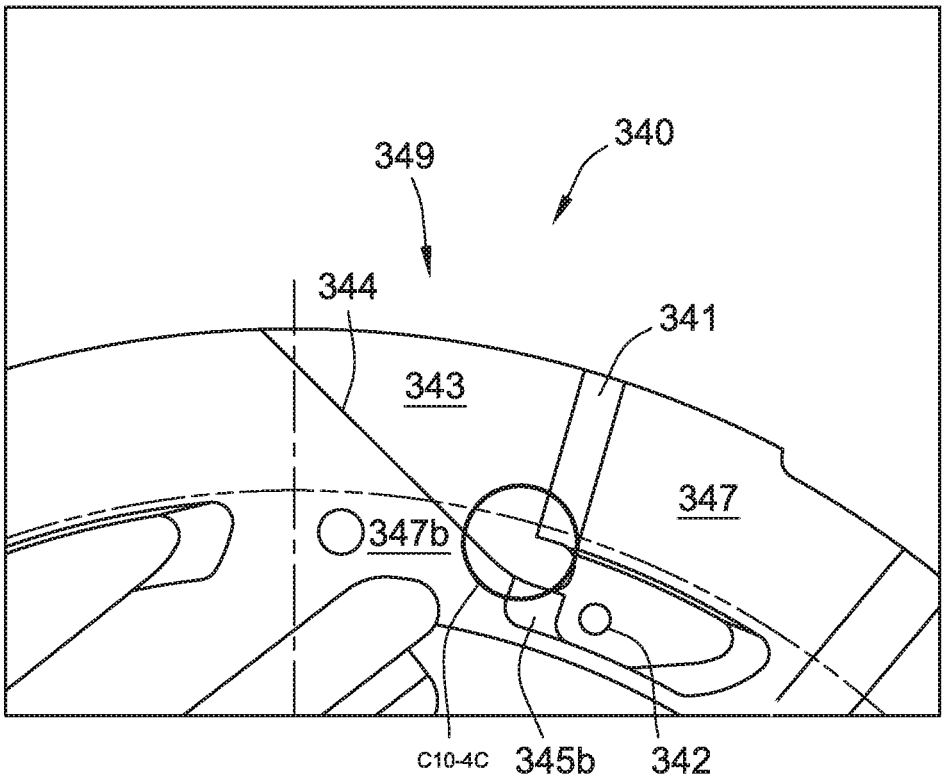
FIG. 4C is a bottom plan view of the reject area of the sorting head of FIG. 3 illustrating the passage of a non-rejected coin.

Turning to FIG. 4C, a bottom plan view of the reject area 340 of sorting head 312 is provided illustrating the passage of a non-rejected coin. In FIG. 4C, the non-rejected coin is a dime C10-4C, the smallest diameter coin in the U.S. coin set. The non-rejected coin C10-4C passes under retracted diverter pin 342 and its inner side slides down ramp 345*b* to surface 347*b* while its outer side is maintained pressed against surface 347 which is at the same height as surface 347*b* whereby the coin is returned to a flat position. The movement of a non-rejected coin in this manner through reject area 340 for sorting head 312 eliminates or significantly reduces the flutter which can occur with non-rejected coins in the reject area 240 of the sorting head 212 downstream of diverter pin 242. Accordingly, FIG. 4C illustrates that even for the small diameter dime C10-4C, the dime transitions over the reject slot 349 and has a leading edge past the reject wall 344 while the trailing edge of the coin is still near the upstream edge of ramp 341. This illustrates that even for the small dime, two opposing edges of the dime (one past or downstream of the reject wall 344 and a second edge upstream of reject surface 343 and reject wall 344) are pressed flat by the pad 118 at surfaces that are at or near the same height. Accordingly, the amount of up and down movement of a non-rejected coin as a non-rejected coin passes reject surface 343 and reject wall 344 is reduced, significantly reducing or eliminating coin flutter otherwise associated with the transitioning of a coin past reject slot 249.

Similar to the reject area 240 described above, according to some embodiments, coins approach the reject area 340 aligned radially to a common inner edge of 5.010" radius on top of the rotating, resilient disc pad 118 having a 5.500" radius outer edge. That is, the inner alignment wall 332 is positioned at a radius of 5.010" radius from the center C of the pad (center C3 of the sorting head 312). All coins overhang the outer edge 118*a* of the coin pad 118. However, unlike the reject area 240, the "ceiling" of surface 347 is not recessed and the coins are fully pressed into the coin pad 118 by a distance equivalent to their thickness, less 0.005" (the adjusted gap between the sorting disc 312 at surface 347 and the surface of the coin pad 118). As coins enter the reject area 340, the outer portion of the disc surface 347 remains at "0" depth while the inner portion is recessed approx. 0.040" upward into recess 346 of the disc 312. With the coins fully pressed into the pad 118 along the outer edge 118*a*, the inner portion of the coin lifts upward fully into the recessed area 346 (see FIG. 7B). All coins lift upward to the same tilt angle.

Figure 7F:
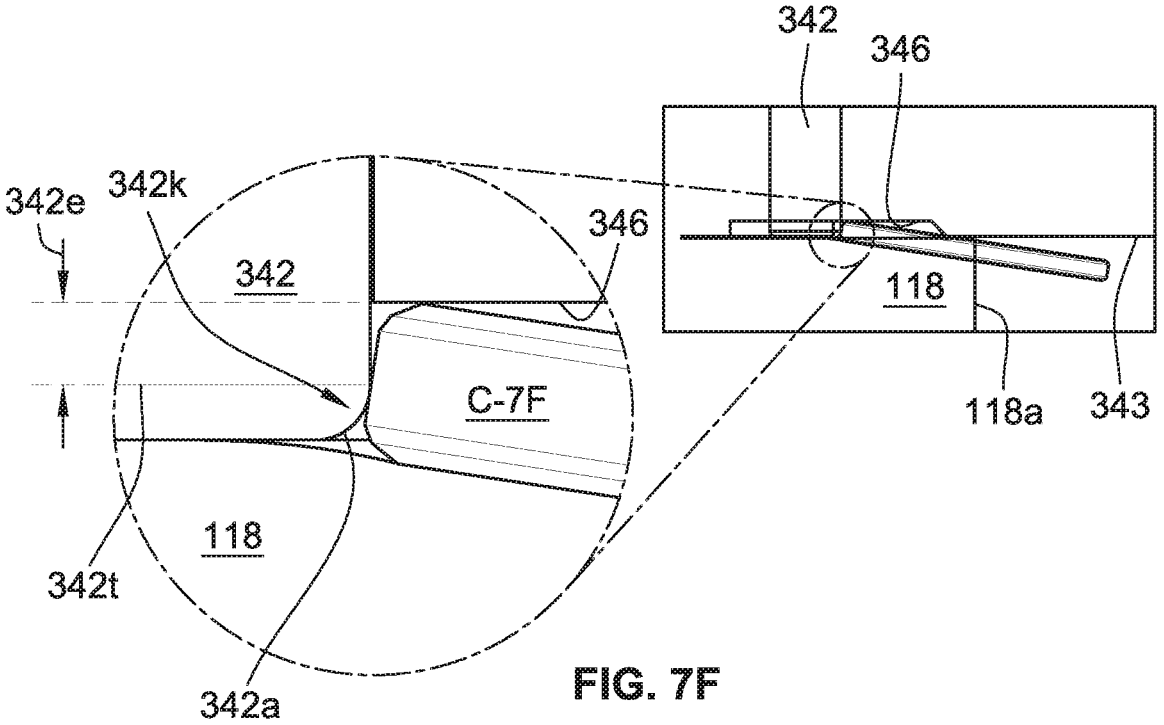
FIG. 7F is an enlarged, cross-sectional view of a rejected coin abutting an outside, lower corner of a diverter pin in the reject region of FIG. 4B.
Figure 7G:
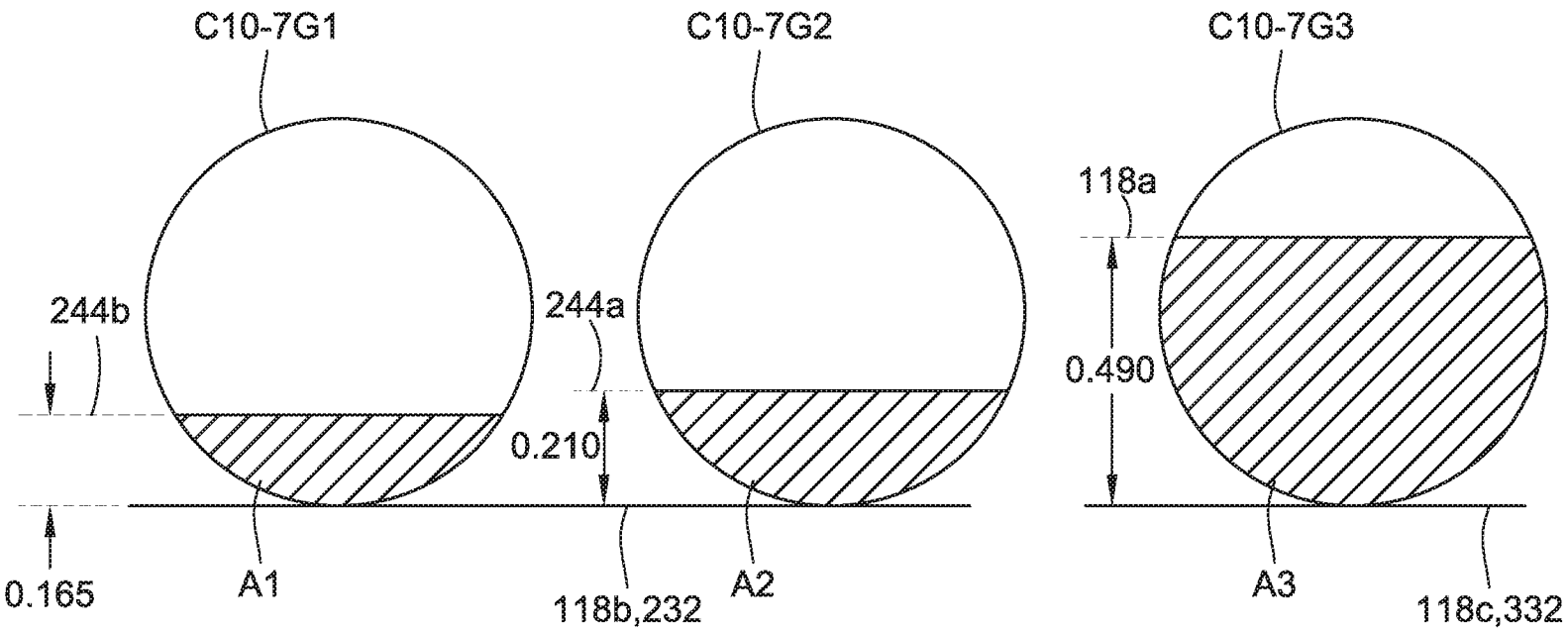
FIG. 7G illustrates the hold areas for a dime in the reject regions of sorting heads of FIG. 2 and FIG. 3.

With reference to Table 1A and FIG. 7G, the grip area for non-rejected coins (e.g., coins which pass through the reject regions 240, 340 and do not engage diverter pin 242,342) will now be discussed. According to some embodiments, for non-rejected coins the width of the effective ceiling (the gripping distance from the edge of a coin to a chord beyond which the pad no longer grips a coin) in the reject area 340 is 0.490" (the distance between line 118*c* and outer pad edge 118*a* shown in FIG. 6B), as compared to the design of sorting head 212 for non-rejected coins where the effective ceiling (gripping distance) is initially 0.210" (the distance between line 118*b* and wall portion 244*a*, see FIGS. 4A and 6A) and then 0.165" (the distance between line 118*b* and wall portion 244*b*, see FIGS. 4A and 6A). This increase in effective width dramatically increases the grip area on the non-rejected coins by about 300% as indicated in Table 1A.

TABLE 1A

| | | Reject Area - Coin Pad Grip Comparison Denomination | | | | | |
|---|---|---|---|---|---|---|---|
| Row | | 10 c | 1 c | 5 c | 25 c | $1 | 50 c |
| 1 | Coin Radius (in.) | 0.3525 | 0.3750 | 0.4175 | 0.4775 | 0.5215 | 0.6025 |
| 2 | Coin Area A (sq. in.) | 0.3904 | 0.4418 | 0.5476 | 0.7163 | 0.8544 | 1.1404 |

TABLE 1A-continued

| Row | | Reject Area - Coin Pad Grip Comparison Denomination | | | | | |
|---|---|---|---|---|---|---|---|
| | | 10 c | 1 c | 5 c | 25 c | $1 | 50 c |
| 3 | Reject Region 240 Hold Area A2 @ 0.210" (sq. in.) | 0.0975 | 0.1013 | 0.1080 | 0.1168 | 0.1228 | 0.1332 |
| 4 | Reject Region 240 Hold Area A1 @ 0.165" (sq. in.) | 0.0695 | 0.0721 | 0.0766 | 0.0827 | 0.0868 | 0.0940 |
| 5 | Reject Region 340 Hold Area A3 @ 0.490" (sq. in.) | 0.2896 | 0.3058 | 0.3340 | 0.3701 | 0.3944 | 0.4354 |
| 6 | Hold Area Increase | 297% | 302% | 309% | 317% | 321% | 327% |
| 7 | A1% of A | 17.8% | 16.3% | 14.0% | 11.5% | 10.2% | 8.2% |
| 8 | A2% of A | 25.0% | 22.9% | 19.7% | 16.3% | 14.4% | 11.7% |
| 9 | A3% of A | 74.2% | 69.2% | 61.0% | 51.7% | 46.2% | 38.2% |

In Table 1A, the area of a coin is $\pi r^2$. For example, the radius of a U.S. dime is 0.3525 inches, its area ($A=\pi r^2$) is 0.3904 square inches as indicated in Row 2. FIG. 7G illustrates the hold areas for a non-rejected dime in the reject region 240 and reject region 340. For reject region 240, the hold area A1 of dime downstream of diverter 242 pin is shaded in coin C10-7G1 and is the area between inner alignment wall 232 (line 118*b*) and wall portion 244*b* (shown in FIG. 4A) (indicated numerically in Row 4). For reject region 240, the hold area A2 of dime upstream of diverter 242 pin is shaded in coin C10-7G2 and is the area between inner alignment wall 232 (line 118*b*) and wall portion 244*a* (shown in FIG. 4A) (indicated numerically in Row 3). For reject region 340, the hold area A3 of dime (upstream and downstream of diverter 342 pin) is shaded in coin C10-7G3 and is the area between inner alignment wall 332 (line 118*c*) and outer pad edge 118*a* (shown in FIG. 6B) (indicated numerically in Row 5). The average of the increase between the values in Row 5 vs Row 3 and Row 5 vs Row 4 is provided in Row 6. Row 7 provides the percentage of the area of a non-rejected coin being gripped or held by pad 118 for coins downstream of diverter 242 pin. For example, for a non-rejected dime downstream of diverter 242 pin in the reject region 240 of the sorting head 212, 17.8% of the area of the dime is gripped or held by the pad 118. Row 8 provides the percentage of the area of a non-rejected coin being gripped or held by pad 118 for coins below or upstream of diverter 242 pin. For example, for a non-rejected nickel below or upstream of diverter 242 pin in the reject region 240 of the sorting head 212, 19.7% of the area of the nickel is gripped or held by the pad 118. Row 9 provides the percentage of the area of a non-rejected coin being gripped or held by pad 118 in the reject region 340 of sorting head 312. For example, for a non-rejected dime in the reject region 340 of the sorting head 312, 74.2% of the area of the dime is gripped or held by the pad 118. As can be seen in FIG. 7G and detailed in Table 1A, the reject region 340 provides a dramatically increased hold area over coins passing through the reject region 340 as compared to reject region 240.

An additional benefit of reject area 340 and reject pin 342 will be discussed in conjunction with FIGS. 7E and 7F. Turning to FIG. 7F, an enlarged, cross-sectional view of a rejected coin C-7F abutting the outside, lower corner of diverter pin 342 is illustrated. The diverter pin 342 is rounded near its lower end. The point below which the vertical sides of diverter pin 342 begin to round is indicated by line 342*t*. The exposed vertical side of diverter pin 342 between line 342*t* and surface 346 has a height indicated by 342*e* which according some embodiments is about 0.027 inches. While the reject pin 342 extends a specific distance downward into the coin stream, the tilted coin contacts a portion of that extended length at or near the rounded corner 342*a*. With reference to FIGS. 7E and 7F, by increasing the recess depth (raising the ceiling) from the 0.020" depth (for surface 239) to the 0.040" depth (for surface 346) above the "0" depth, the effective height of the reject pin 342 is increased by over 300% (0.027/0.007 is greater than about 380%). Referring to FIG. 7E, as the top inside edges of coins abut diverter pin 242 they contact the pin 242 near area 242*k*. Over time, area 242*k* is worn down and a channel is formed in pin 242 near area 242*k*. The top inside edges of subsequent coins engage the pin 242 in the growing channel 242*k*. Referring to FIG. 7F, as the inside edges of coins abut diverter pin 342 they contact the pin 342 near area 342*k*. Over time, area 342*k* is worn down.

Comparing FIGS. 7E and 7F, it can be seen that by reversing the coin tilt direction, reject pin 342 wear from rejected coins will occur from the "tip up" in an angular orientation, rather than from the "middle down" for pin 242 and reject area 240. The wear pattern evident from FIG. 7F allows significantly more wear to occur before an error condition will occur as a result of a coin to be rejected not properly striking reject pin 342 and failing to enter reject surface 343. Additionally, the radially outward downward tilt of the coins when coins strike the diverter pin 342 (together with the greater exposes vertical side 342*e*) reduces the likelihood they will cause the diverter pin 342 to move upward and allow a coin to be rejected to pass underneath the diverter pin and onto gauging area 350 as compared to the arrangement of reject region 240.

Another benefit of reject area 340 discussed above is the maintenance of pad control of a rejected coin for a longer period of time and greater distance after a reject coin contacts the reject pin 342. As described above, rejected coins which contact the reject pin 342 are no longer immediately removed from pad contact and disc control. Instead, the coins are transitioned from a first radius of rotation (aligned with wall 322) to a second radius of rotation (aligned with the outer edge of reject pin 342 and the upstream end 344*a* of reject wall 344. This second radius is sufficiently larger to allow the reject coins to enter the reject slot 349 and engage reject wall 344 and be directed along a reject path DB5 parallel to a downstream straight portion 344*c* of reject wall 344. Accordingly, the rejected coins, while still fully pressed into the pad 118, are guided into contact and directional control of the outwardly extending straight portion 344*c* of the reject wall 344. The rejected coins are driven along the straight portion 344*c* of the reject wall 344 by the maintained pressure and rotation of the pad. This driven action causes the exiting rejected coins to achieve a generally predictable path of travel approximately parallel to the straight portion 344*c* of the reject wall 344.

In Table 1B, the area that a rejected coin is gripped or held by pad 118 is provided in Row 3 and the percentage of the surface area of a rejected coin is gripped or held by pad 118 is provided in Row 4. The distance of 0.350 inches referred to in the below Table 1B is the distance from the outside edge of diverter pin 342 to pad edge 118*a* such as the distance from the inner edge of coin C10-5B1 in FIG. 5B to the edge 118*a* of pad 118. As compared to reject region 240 in which a rejected coin which contacts the reject pin 242 is almost immediately removed from pad contact and disc control, after a rejected coin strikes diverter pin 342 in reject region 340, a substantial portion of the area of the surface of rejected coins is still under pad pressure or pad grip—from over 20% of the surface area (for 500 coins) to almost 50% (for dimes).

TABLE 1B

| | | Reject Area 340 - Coin Pad Grip of Rejected Coins Denomination | | | | | |
|---|---|---|---|---|---|---|---|
| Row | | 10 c | 1 c | 5 c | 25 c | $1 | 50 c |
| 1 | Coin Radius (in.) | 0.3525 | 0.3750 | 0.4175 | 0.4775 | 0.5215 | 0.6025 |
| 2 | Coin Area A (sq. in.) | 0.3904 | 0.4418 | 0.5476 | 0.7163 | 0.8544 | 1.1404 |
| 3 | Reject Region 340 Hold Area A4 @ 0.350" (sq. in.) | 0.1934 | 0.2022 | 0.2177 | 0.2379 | 0.2516 | 0.2751 |
| 4 | A4% of A | 49.5% | 45.8% | 39.8% | 33.2% | 29.4% | 24.1% |

An additional benefit of reject area 340 relates to the manner in which non-rejected coins pass through the reject area 340. As described above, non-rejected (accepted) coins enter the reject area 340 is the same orientation (alignment, radius, and tilt) as coins to be rejected, however, they pass under the retracted reject pin 342 and engage an inner ramp 345*b* that drives the inner portion of the coin downward into the pad. This re-orients the coins into a flat, horizontal, fully pressed condition and allows the rotating pad to guide the coins away from the reject area 340 and onward toward the exit slots 361-366. This "flattened" orientation eliminates or reduces coins dragging across the reject wall 344, eliminates or reduces the "slapping" condition described above in connection with reject area 240, and increases the longevity of the disc surface surrounding the reject area 340, resulting in a nearly unrestricted passage of non-rejected coins and maintaining the coin travel well within the time window of flow sensor 410*b* which operates in the same manner as flow sensor 410*a* described above.

Re-Gauging Areas

Figure 8A:
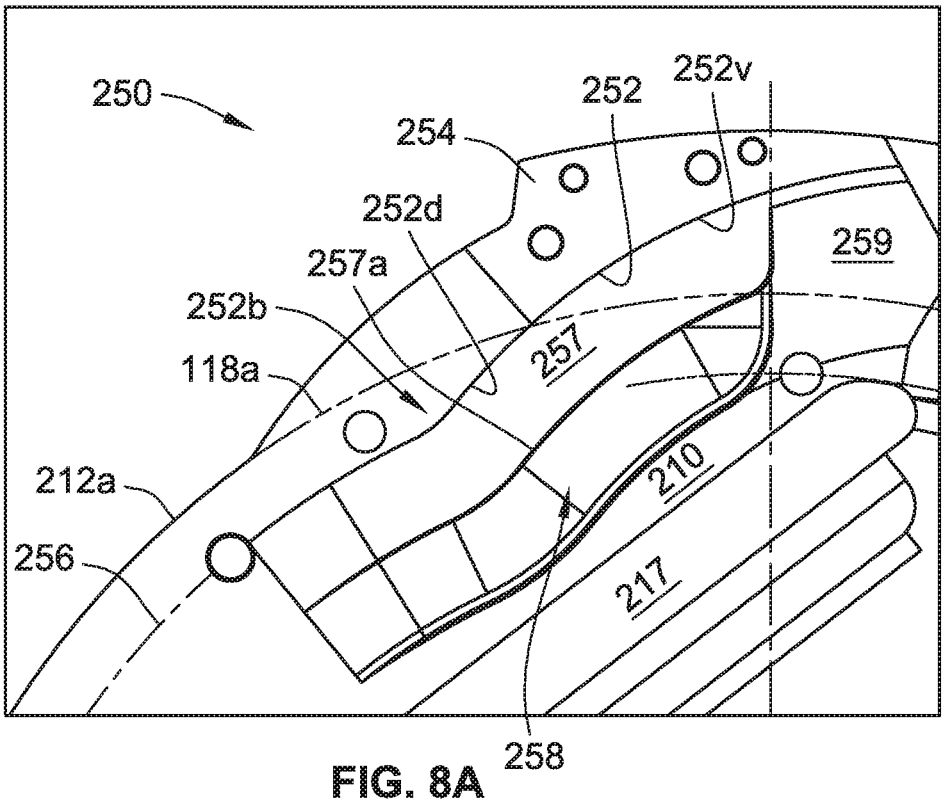
FIG. 8A is a bottom plan view of a re-gauging area of the sorting head of FIG. 2.
Figure 8B:
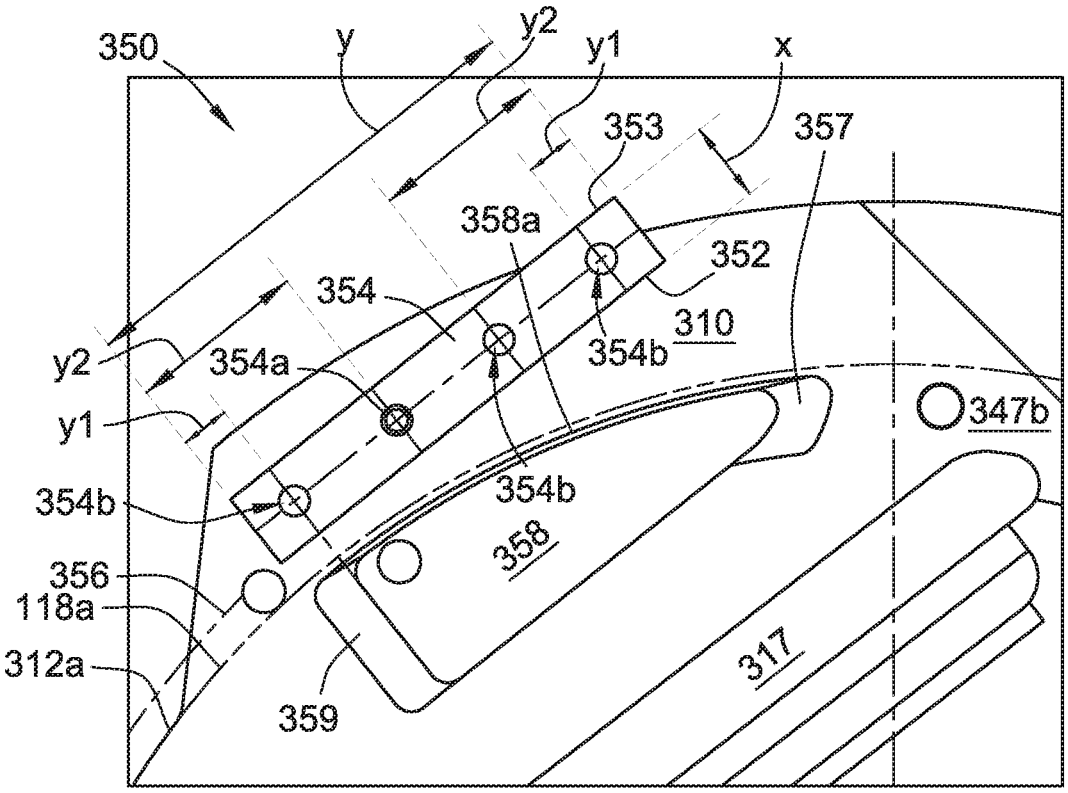
FIG. 8B is a bottom plan view of a re-gauging area of the sorting head of FIG. 3.
Figure 9A:
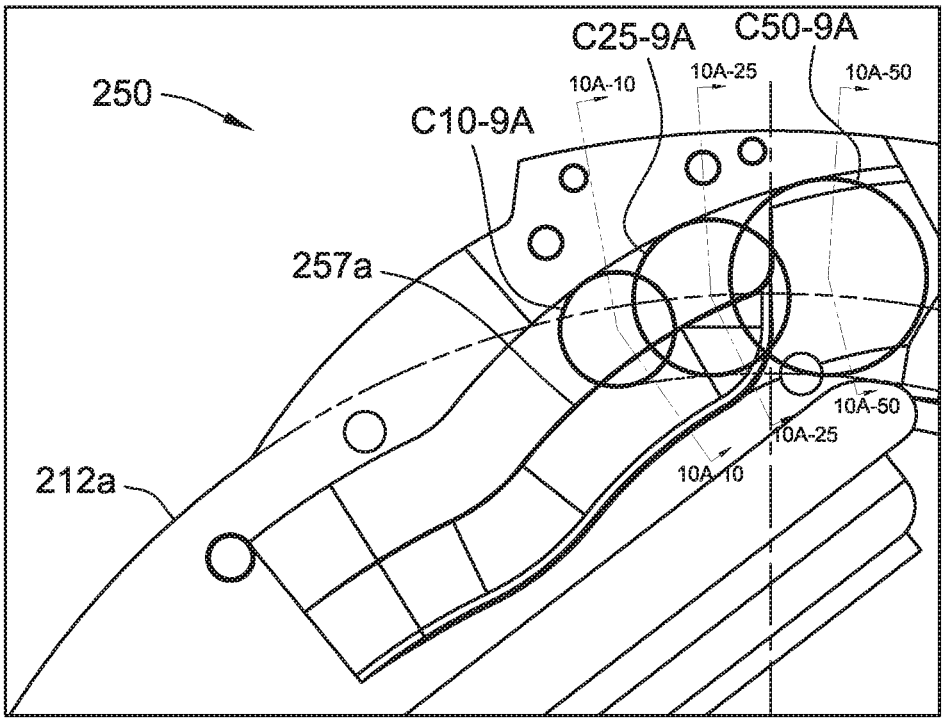
FIG. 9A is a bottom plan view of the re-gauging area of the sorting head of FIG. 2 with representations of coins in the re-gauging area.
Figure 9B:
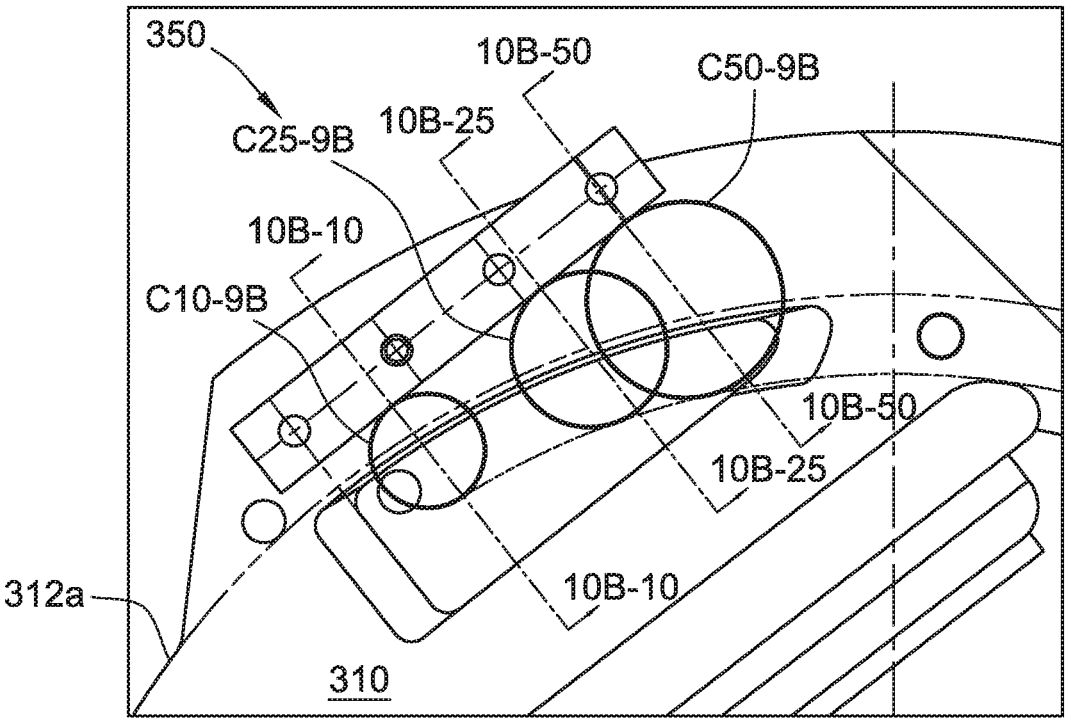
FIG. 9B is a bottom plan view of the re-gauging area of the sorting head of FIG. 3 with representations of coins in the re-gauging area.
Figure 10A:
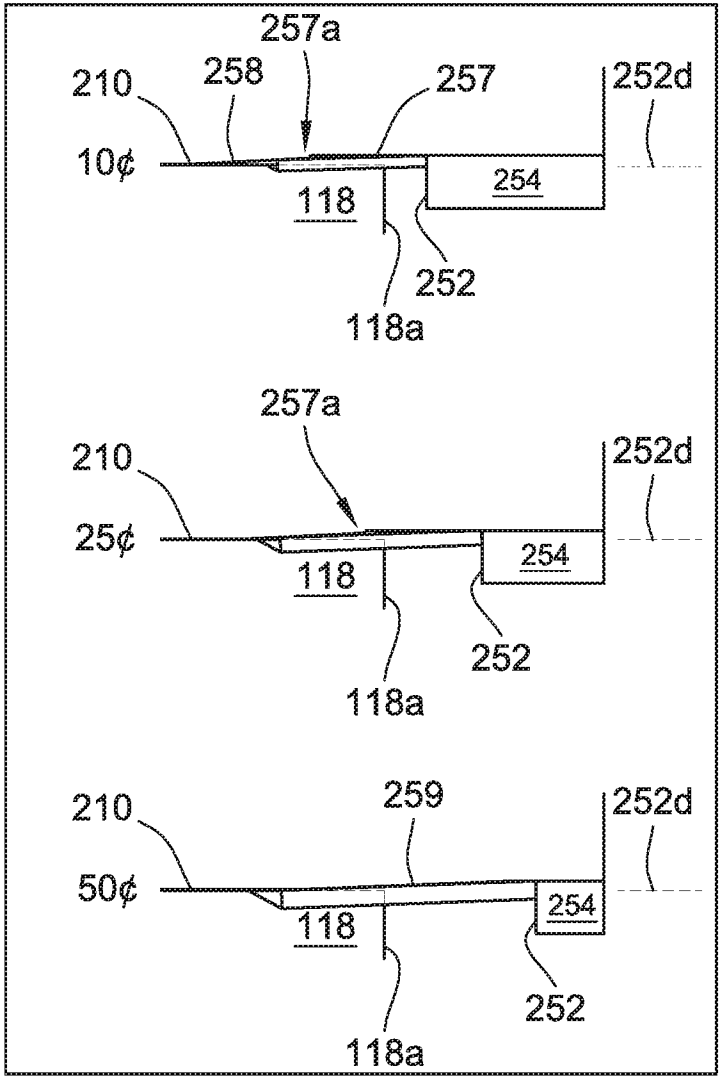
FIG. 10A is a partial cross-sectional view the re-gauging area of FIG. 9A illustrating the tilt of exemplary coins (US 10¢, 25¢, and 50¢ coins) in the re-gauging area.
Figure 10B:
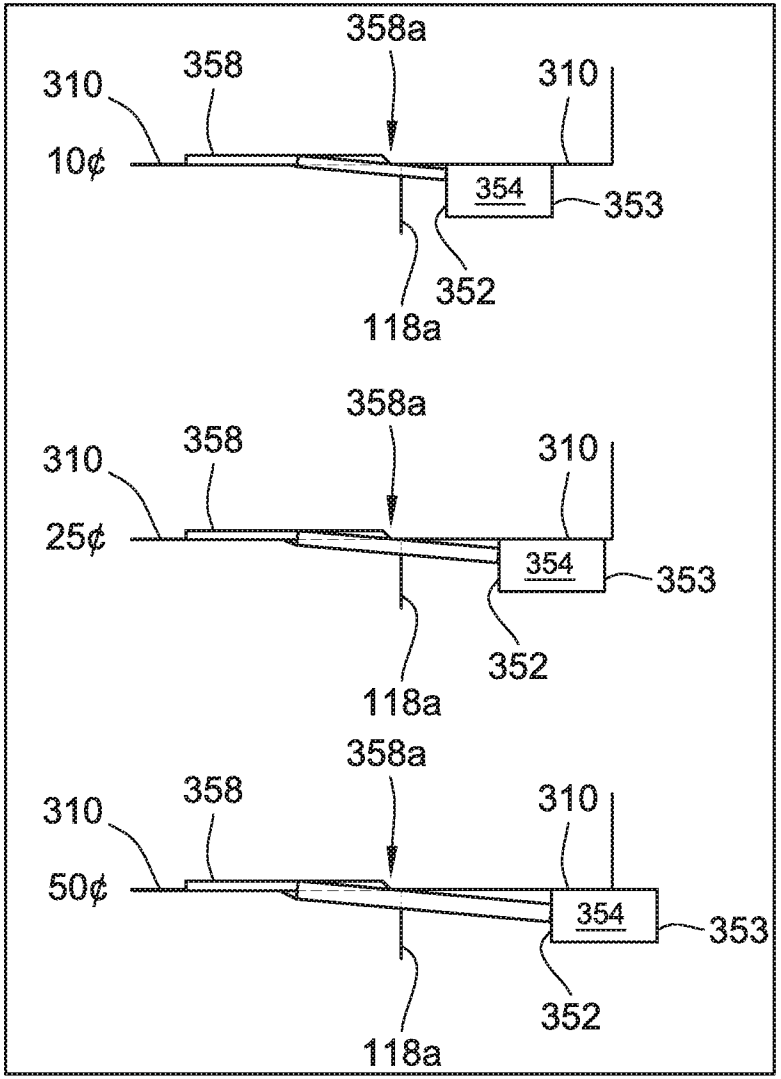
FIG. 10B is a partial cross-sectional view the re-gauging area of FIG. 9B illustrating the tilt of exemplary coins (US 10¢, 25¢, and 50¢ coins) in the re-gauging area.
Figure 11A:
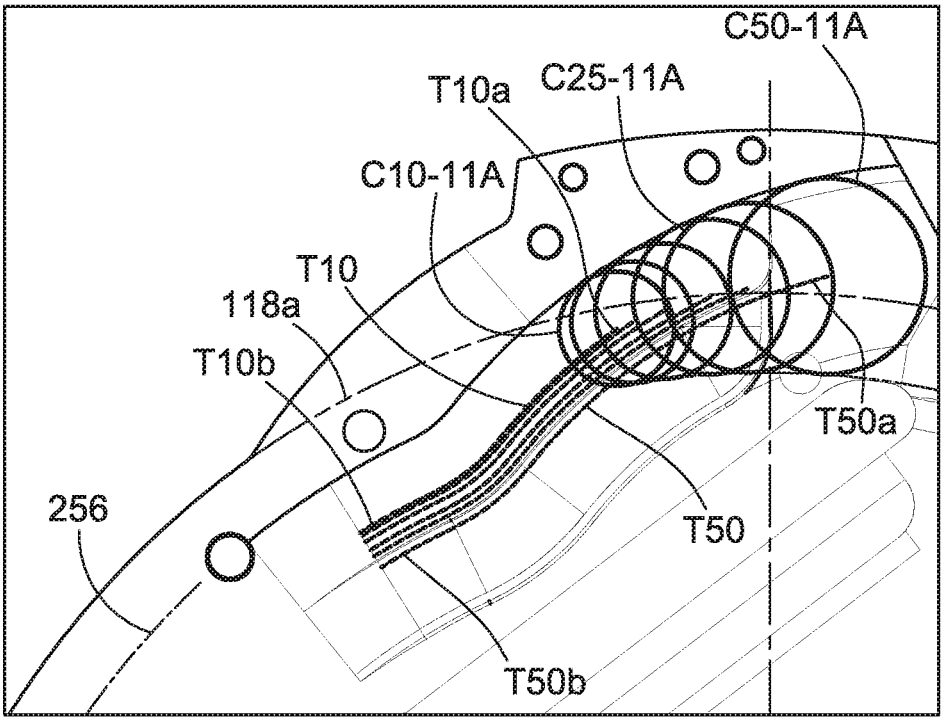
FIG. 11A is a bottom plan view of the re-gauging area of the sorting head of FIG. 2 illustrating radial displacement of exemplary coins (US 10¢, 5¢, 1¢, $1, 25¢, and 50¢ coins) as the coins pass through the re-gauging area.
Figure 11B:
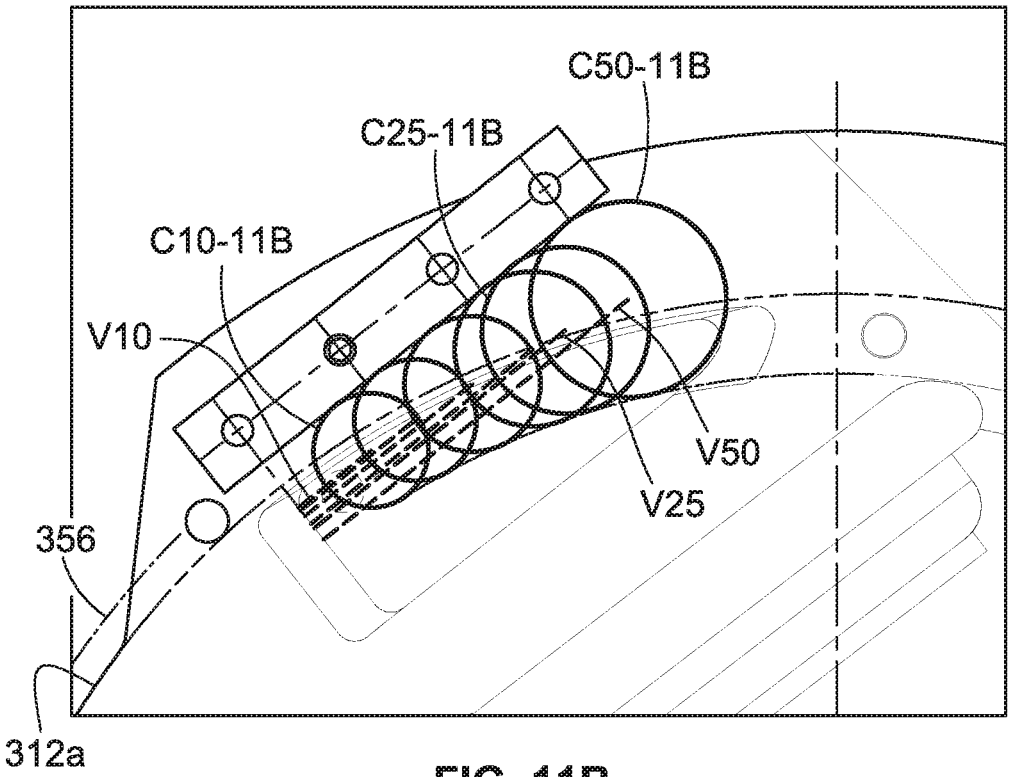
FIG. 11B is a bottom plan view of the re-gauging area of the sorting head of FIG. 3 illustrating radial displacement of exemplary coins (US 10¢, 5¢, 1¢, $1, 25¢, and 50¢ coins) as the coins pass through the re-gauging area.

FIGS. 8A and 8B are bottom plan views of re-gauging areas 250, 350 of sorting heads 212, 312, respectively. FIGS. 9A and 9B are bottom plan views of re-gauging areas 250, 350 of sorting heads 212, 312, respectively, with representations of coins in the re-gauging areas 250, 350. FIGS. 10A and 10B are partial cross-sectional views of the sorting heads 212, 312, respectively, and pad 118 in a regions of re-gauging areas 250, 350, respectively. FIGS. 11A and 11B are bottom plan views of re-gauging areas 250, 350 of sorting heads 212, 312, respectively, illustrating radial displacement of exemplary coins (US 10¢, 5¢, 1¢, $1, 25¢, and 50¢ coins) as the coins pass through the re-gauging areas 250, 350.

Coins approaching the re-gauging area 250 are aligned to a common inner radius, with the inner portion pressed into the coin pad 118. For the coins to be sorted by diameter, they need to be reoriented (re-gauged) to a common outer edge so that each coin has a distinct and relatively unique inner edge radius. This aligns the coins to coin exit slots or channels 261-266 located downstream at the perimeter of the sorting disc 212.

Turning to FIG. 8A, as described above, the re-gauging area 250 comprises a gauging block 254 which has an outer wall 252. The outer wall 252 begins from an upstream location from a radial position beyond the outer edge 118*a* of the rotating pad 118 and then curves inward until reaching a bend 252*b* in wall 252 at which point the outer wall 252 maintains a fixed radial position 256 as it proceeds downstream. The re-gauging wall 252 comprises two sections—an upstream section 252*v* and a downstream section 252*d*. The bottom of the upstream section 252*v* extends below the "0" level of the sorting head 312 by the thickness of the gauging block (see FIG. 10A). The bottom of the downstream section 252*d* is at level "0"—the level of surface 210 (see FIG. 10A).

Coins received from the reject area 240 strike different points along outer wall 252 depending upon their diameter. The points along outer wall 252 where US 10¢, 25¢, and 50¢ coins initially contact outer wall 252 are shown by the locations of coins C10-9A, C25-9A, and C50-9A, respectively, in FIG. 9A. The points (from left to right) along outer wall 252 where US 10¢, 5¢, 1¢, $1, 25¢, and 50¢ coins, respectively, initially contact outer wall 252 are shown in FIG. 11A (only the locations of the 10¢, 25¢, and 50¢ coins are labeled—coins C10-11A, C25-11A, and C50-11A, respectively).

Coins engage outer wall 252 and are moved radially inward as they are driven along the outer wall 252 under pad pressure in the counterclockwise direction as viewed in FIGS. 8A and 11A so as to align the coins along a common outer radius 256 which is positioned inboard of the outer periphery 118*a* of the rotating pad 118 and the outer periphery 212*a* of the sorting head 212 as the coins approach a series of coin exit slots 261-266 which discharge coins of different denominations. The wall 252 can be wholly integral to the sorting disc 212 or partially integral with an attached precision profiled gauging block 254 providing a portion of the wall surface.

With re-gauging area 250, as seen in FIG. 11A coins are re-gauged by a significant amount. The larger a coin's diameter, the further it must be re-gauged. For example, the U.S. coin set is re-gauged by a radial distance ranging from 0.615" (Dime) to 1.115" (Half Dollar). For example, see line T10 tracing the center of a dime and the radial shift from the beginning of line T10 at T10*a* (inboard of edge 118*a* of the rotating pad 118) to a final radial position of a dime at T10*b*

(downstream of bend 252*b*). Likewise, line 50 illustrates the radial inward movement of the center of a 50¢ coin from its initial radial position near T50*a* (outboard of edge 118*a* of the rotating pad 118) to a final radial position of a half dollar at T50*b* (downstream of bend 252*b*).

The re-gauging area 250 also comprises a flat, horizontal surface 257 and a downward angled or beveled surface 258 which meet at a wall 257*a*. With reference to FIG. 8A, surface 210 is a flat, horizontal surface at level "0" and surface 257 is a flat, horizontal recessed area positioned above level "0". Moving radially outward from surface 210, surface 258 transitions upward to meet recessed surface 257. See also, the cross-sectional views of a 10¢ and a 25¢ coin illustrated in FIG. 10A. With reference to FIG. 10A, once coins are rotated into the re-gauging area, they achieve a tilted orientation within a tapered recess. Cross-sectional views along lines 10A-10 (dime), 10A-25 (quarter), and 10A-50 (half dollar) in FIG. 9A are shown in FIG. 10A. According to some embodiments, this recess is approximately 0.045" deep at the outer area 257, extending downward toward a "0" depth at the furthest inner area meeting surface 210. The 0.045" depth must be held precisely, as it forms the height of the downstream section 252*d* of the re-gauging wall 252 and at the same time provides the depth required to grip the thinnest coin in the coin set. If this area is too shallow, coins may not be sufficiently restrained and drive past the downstream section 252*d* of the re-gauging wall 252. And if this area is too deep, it may not provide sufficient pressure on the thinner coins, allowing them to bounce off the wall, inwardly beyond the re-gauging radius 256.

As the coins contact the re-gauging wall 252, they are pushed inward along the tapered surface 258, deeper into the coin pad 118, increasing the amount of pressure and resistance, as the edges of the coins scrape along the top surface of the pad 118. The significant re-gauging distance, increasing pad pressure and resistance, wall impact angle, and pad surface scraping produces a great amount of wear and tear on the disc 212, wall 252*v* of gauging block 254, pad 118, and the coins themselves.

Re-gauging area 350 of sorting disc 312 will now be discussed in connection with FIGS. 8B, 9B, 10B, and 11B. According to some embodiments, the re-gauging area 350 of sorting disc 312 addresses these issues by minimizing the re-gauging distance, shortening the re-gauging path, using a simple gauging block to achieve the movement, and reversing the coin tilt direction. By minimizing the re-gauging distance, the outer edges of coins remain outside the edge 118*a* of the coin pad 118, reducing the amount of pressed area and surface friction. The shortened re-gauging path reduces the area required for the re-gauging process. And the reversed tilt eases the resistance and scraping of the pad surface, lightening the impact loads.

As with re-gauging area 250, coins approaching the re-gauging area 350 are aligned to a common inner radius, with the inner portion pressed into the coin pad 118. For the coins to be sorted by diameter, they need to be reoriented (re-gauged) to a common outer edge so that each coin has a distinct and relatively unique inner edge radius. This aligns the coins to coin exit slots or channels 361-366 located downstream at the perimeter of the sorting disc 312.

Turning to FIG. 8B, as described above, the re-gauging area 350 comprises a gauging block 354 which has an outer re-gauging wall 352. The outer wall 352 begins from an upstream location from a radial position beyond the outer edge 118*a* of the rotating pad 118 and also ends downstream at a point or corner which is also positioned radially beyond the outer edge 118*a* of the rotating pad. According to some embodiments, the outer wall 352 is linear and the re-gauging block has a rectangular plan shape and a three-dimensional shape of a cuboid.

Coins received from the reject area 340 strike different points along outer wall 352 depending upon their diameter. The points along outer wall 352 where US 10¢, 25¢, and 50¢ coins initially contact outer wall 352 are shown by the locations of coins C10-9B, C25-9B, and C50-9B, respectively, in FIG. 9B. The points (from left to right) along outer wall 352 where US 10¢, 5¢, 1¢, $1, 25¢, and 50¢ coins, respectively, initially contact outer wall 352 are shown in FIG. 11B (only the locations of the 10¢, 25¢, and 50¢ coins are labeled—coins C10-11B, C25-11B, and C50-11B, respectively).

Coins engage outer wall 352 and are moved radially inward as they are driven along the outer wall 352 under pad pressure in the counterclockwise direction as viewed in FIGS. 8B and 11B so as to align the coins along a common outer radius 356 which is positioned outboard of the outer periphery 118*a* of the rotating pad 118 and the outer periphery 312*a* of the sorting head 312 as the coins approach a series of coin exit slots 361-366 which discharge coins of different denominations. According to some embodiments, the wall 352 and gauging block 354 are completely separate from the sorting disc 312 with the side 352 of the gauging block providing a removeably attachable precision profiled wall surface.

The re-gauging area 350 also comprises a flat, horizontal recessed or elevated surface 358 surrounded by zero ("0") depth surface 310. An entrance ramp 357 leads up into recessed area 358 and a trailing exit ramp 359 leads downward back to surface 310. An outward wall 358*a* of the recessed area 358 is maintained at a fixed radial position just inward of the outer edge 118*a* of the rotating pad 118. See also, the cross-sectional views of a 10¢ coin, a 25¢ coin, and a 50¢ coin illustrated in FIG. 10B. Cross-sectional views along lines 10B-10 (dime), 10B-25 (quarter), and 10B-50 (half dollar) in FIG. 9B are shown in FIG. 10B. In the illustrated embodiment, the recessed area 358 has a generally triangular shape having a generally straight inward edge positioned at approximately 90° degrees from a generally straight downstream edge near ramp 359 and the outward wall 358*a* is a circular arc and forms the third side of the generally triangular shaped recess 358.

With reference to FIG. 10B, once coins are rotated into the re-gauging area, they achieve a tilted orientation with inward edges being positioned within the recess 358. The re-gauging area 350 is configured to cause coins to tilt in the opposite direction of the design of re-gauging area 250. The outer portion 310 is maintained at a "0" depth, keeping full pad pressure on all coins at the outermost pad perimeter as they rotate through the area 350. According to some embodiments, the inner recessed area 358 is flat and recessed at an elevated level of 0.045" above level "0", although inner recessed area 358 could also be tapered inwardly deeper to further ease the resistance to coin movement and further reduce pad surface scraping. All coins enter the recess 358 at roughly the same tilt angle, and the angle of their tilt is reduced as they are pushed inward as they are driven along re-gauging wall 352. The "0" depth press at the perimeter keeps the coins from bouncing off the wall 352 at their impact. For example, according to some embodiments, in FIG. 10B, the radially outward downward tilt of the dime is about 5.2°, the radially outward downward tilt of the quarter is about 5.0°, and the radially outward downward tilt of the half dollar is about 5.2°. According to some embodiments, the radial outward downward tilt of coins in the re-gauging area 350 is greater than about 5°. According to some embodiments, the radial outward downward tilt of coins in the re-gauging area 350 is greater than about 4° or 4½°. According to some embodiments, the radial outward downward tilt of coins in the re-gauging area 350 is between about 2° and 7°. Conversely, according to some embodiments, in FIG. 10A, the radially outward upward tilt of the dime is about 1.7°, the radially outward upward tilt of the quarter is about 2.0°, and the radially outward upward tilt of the half dollar is about 2.1°.

With re-gauging area 350, as seen in FIG. 11B coins are re-gauged by a lesser amount as compared to re-gauging area 250. The larger the coin's diameter, the further it must be re-gauged. For example, the U.S. coin set is re-gauged by a distance ranging from 0.030" (Dime) to 0.530" (Half Dollar). For example, see line V10 tracing the center of a dime and the radial shift from the beginning, upstream end of line V10 to a final radial position of a dime at the downstream end of line V10. Likewise, line T50 illustrates the radial inward movement of the center of a 50¢ coin from an initial, upstream radial position to a final downstream radial position.

The significantly reduced re-gauging distances for U.S. coin are described in the Table 2 below. In Table 2, "Index R." is the radius of the outer edge of coins when their inner edge is aligned with alignment wall 232, 332 (the radius of outer edge of coins when they enter re-gauging areas 250/350) and the "Gauging R." is the radius of the outer edge of coins as they leave re-gauging area 250/350. The last row of Table 2 provides the percentage of the re-gauging radial displacement for re-gauging area 350 vs. re-gauging area 250. For example, a dime is radially displaced by 0.030 inches in re-gauging area 350 divided by 0.615 inches in re-gauging area 250 equals about 5%.

TABLE 2

Re-Gauging Area - Coin Displacement Comparison

| | Denomination | | | | | |
|---|---|---|---|---|---|---|
| | 10 c | 1 c | 5 c | 25 c | $1 | 50 c |
| | Displacement Distance - Index R. vs. Gauging R. | | | | | |
| Re-gauging area 250 Index @ 5.100" R. | 0.615 | 0.660 | 0.745 | 0.865 | 0.953 | 1.115 |
| Re-gauging area 350 Index @ 5.685" R. | 0.030 | 0.075 | 0.160 | 0.280 | 0.368 | 0.530 |
| Percentage of Re-gauging area 250 | 5% | 11% | 21% | 32% | 39% | 48% |

According to some embodiments, the inward push of the re-gauging operation is achieved using a simple rectangular block or rectangular cuboid 354. The block is designed symmetrical in both X and Y axes, and is configured to be "flip-able" and "reversible", providing at least four re-gauging coin contact surfaces, e.g., an upper (or first) and a lower (or second) surface or portion of re-gauging wall 352 and an upper (or first) and a lower (or second) surface or portion of the opposing wall 353 of the re-gauging block 354 (see FIGS. 8B and 10B). As one surface wears, dents, or otherwise may negatively affect coin flow due to long term use, the gauging block 354 may be removed and re-attached in a new orientation providing a fresh re-gauging surface. This extends the useful life of an already lower cost part with the repositioning able to be done by personnel with little or no service training. For example, with reference to FIG. 8B, the re-gauging block 354 may be attached to the sorting head 312 via at least one screw 354*a* screwed into a corresponding hole in the sorting head 312 via openings 354*b* in the re-gauging block. According to some embodiments, the openings 354*b* are positioned in the re-gauging block so as to be located in the same position relative to the sorting head 312 no matter which end is positioned upstream and no matter which surface is facing downward such as (with reference to FIG. 8B) by placing the holes 354*b* along a line half way along the width (x-axis) and at common distances from the ends along the length (y-axis), e.g., one hole Y1 inches from each end and one hole Y2 inches from each end. According to some embodiments, the sorting head 312 has a dowel pin set (raised bumps or projections from the surface of sorting head 312) that aid in the precision locating of the gauging block 354 relative to the sorting head 312. For example, precision placement pins may be located below the location of the first and last openings 354*b* or the first and third openings 354*b* (from left to right in FIG. 8B).

Compared with re-gauging area 250 and recess 257, the precision of the depth of recess 358 is no longer an issue. Coin stability throughout the re-gauging area 350 is increased dramatically, maintaining a stable, distinct, and defined pathway as the coins leave the area on a common outer edge radius 356 with their outer portions off the coin pad 118 beyond the edge 118*a*.

Exit Slot Area Configurations

Figure 12B:
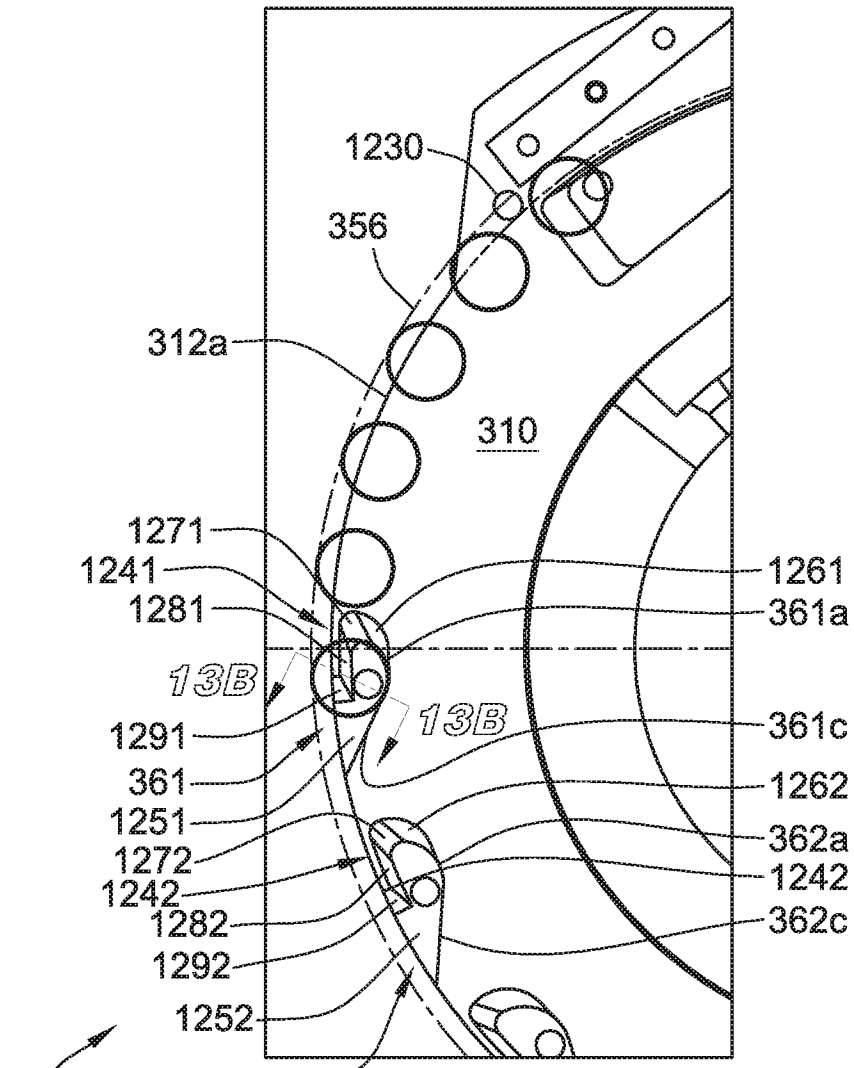
FIG. 12B is a partial bottom plan view of an exit slot area of the sorting head of FIG. 3.
Figure 12A:
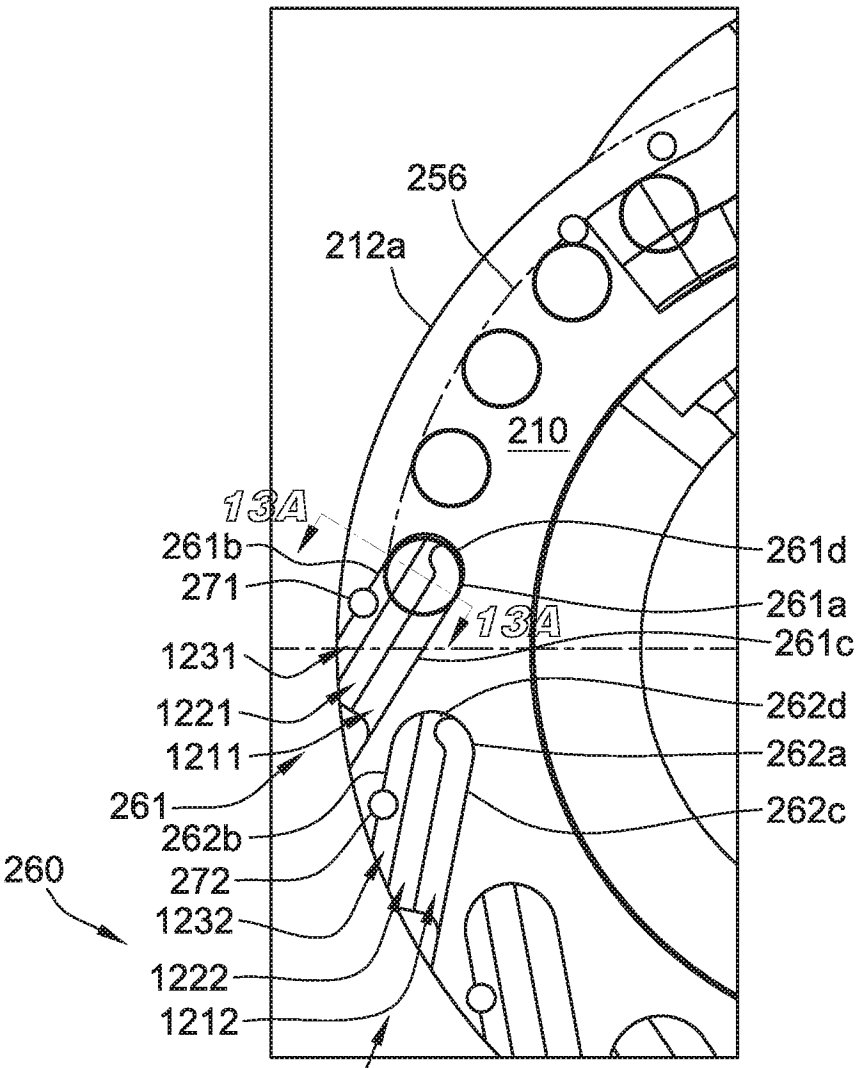
FIG. 12A is a partial bottom plan view of an exit slot area of the sorting head of FIG. 2.
Figure 12C:
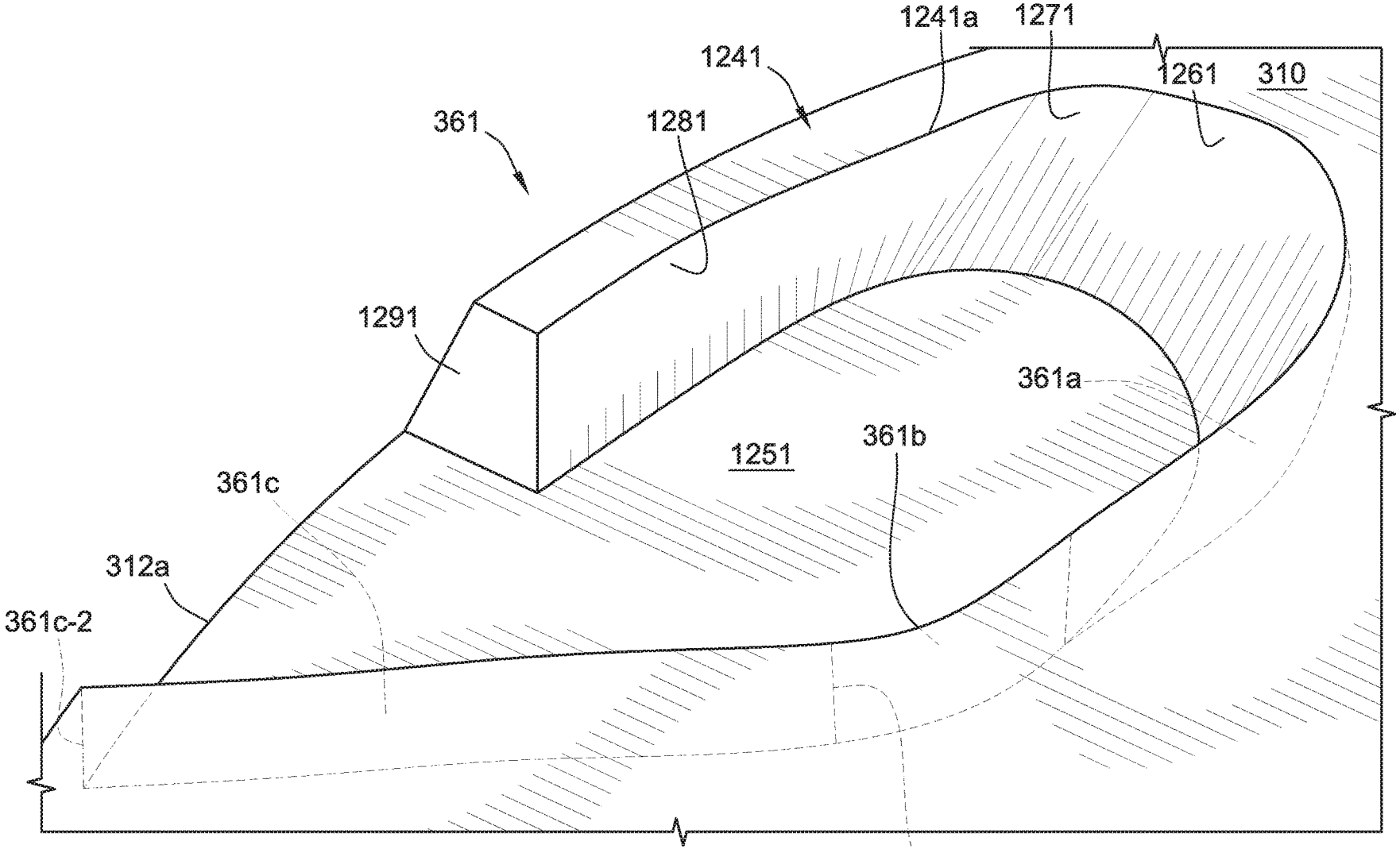
FIG. 12C is an upward perspective view of a first exit slot of the sorting head of FIG. 3.
Figure 13A:
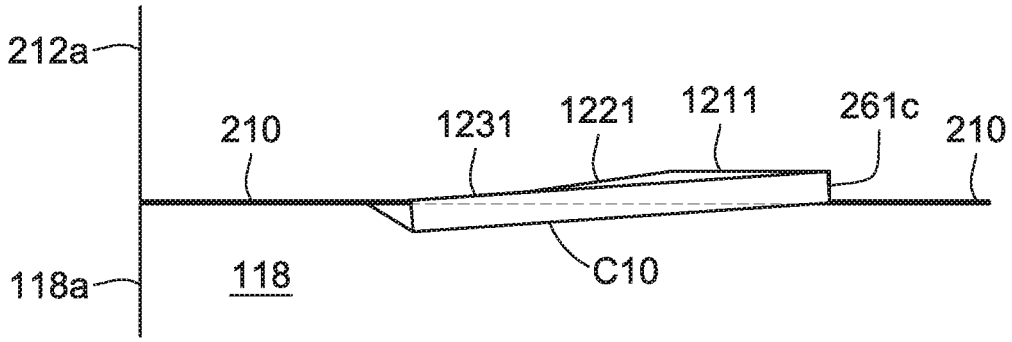
FIG. 13A is a partial cross-sectional view of a first exit slot shown in FIG. 12A.
Figure 13B:
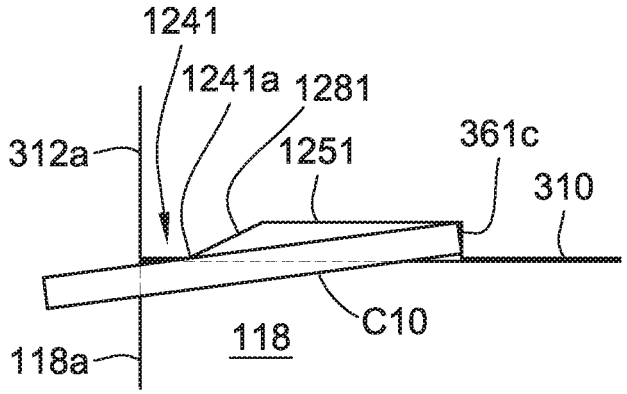
FIG. 13B is a partial cross-sectional view of a first exit slot shown in FIG. 12B.

Turning to exit slot areas 260, 360 of sorting heads 212 and 312, FIGS. 12A and 12B are partial bottom plan views of the exit slot areas illustrating at least the first two exit slots 261-262 and 361-362 of sorting heads 212, 312, respectively. FIGS. 13A and 13B are partial cross-sectional views of the sorting heads 212, 312, respectively, and pad 118 in regions of the first exit slots 261, 361, respectively, along lines 13A-13A and 13B-13B indicated in FIGS. 12A and 12B, respectively. FIG. 12C is an upward perspective view of a first exit slot 361 of sorting head 312.

Turning to exit slot area 260 of sorting head 212 and FIG. 12A, coins approaching the exit slots 261-266 are aligned to a common outer radius 256 which is entirely inboard of the pad edge 118*a*, and fully pressed into the pad surface by surface 210 at level "0".

The exit slots 261-266 are positioned around the perimeter of the sorting disc 212 and spaced apart to provide sufficient area for coins to enter the appropriate exit slots, in which they driven are outwardly along the slot length, out of the slot and off the edge 118*a* of the pad 118.

Exit slot 261 will be described in more detail with the understanding that the remaining exit slots 262-266 have the same configuration. Exit slot 261 has a straight or nearly straight downstream exit wall 261*c* and a parallel upstream exit edge 261*b*. These exit wall 261*c* and edge 261*b* are at an angle relative to the edge 212*a* of the sorting disc 212 and an intersecting radius of rotating pad 118. The upstream ends of exits edge/wall 261*b*, 261*c* are joined by a curved wall 261*d*. The curved wall 261*d* is curved to match the size and shape of the corresponding coins to be exited via the associated exit slot 261. For example, the smallest diameter US coin is a dime and the second smallest diameter US coin is a penny. For a sorting head 212 designed to sort US coins, the first exit slot 261 is sized to permit dimes to enter the exit slot 261 and the second exit slot 262 is sized to permit pennies to enter the exit slot 262. Hence, the curve of curved entry wall 261*d* matches and is slightly larger than the curve of the edges of a dime and the curve of curved entry wall 262*d* matches and is slightly larger than the curve of the edges of a penny, and so on for exit slots 263-266. Within the exit slot 261 are three recessed surfaces 1211, 1221, and 1231 the configurations of which are best seen in FIG. 13A. In FIG. 13A, a partial cross-sectional view of the sorting head 212 and pad 118 in a region of the first exit slot 261 along lines 13A-13A indicated in FIG. 12A is shown. A dime C10 is shown in the exit slot 261 engaging the downstream exit wall 261*c*. The top of the recess is horizontal surface 1211. Surface 1221 is angled from surface 1211 down to shallower surface 1231 which is angled down to level "0" of surface 210.

The innermost edge 261*a*, 262*a*, of the exit slots 261-262 are spaced inboard slightly more than the innermost edge of the associated coin. This provides clearance for a coin of the associated diameter to enter a corresponding exit slot, and provides support for larger coins (coins of larger diameters) to pass the exit slots associated with coins of smaller diameters.

The exit slot is oriented outwardly toward the disc perimeter and has a tapered cross-section which extends from a "0" depth outboard to an inboard depth slightly less than the thickness of the associated coin. This orientation causes the inner portion of the coin to lift up into the slot, engaging the outwardly directing downstream exit wall 261*c*, 262*c*, while the trailing edge remains under greater pad pressure for driving the coin out of the disc and off of the pad.

At the outboard, upstream side 261*b*, 262*b*, of each exit slot 261-262, beyond the common path of the coins, a sensor 271-272 is placed to count coins passing beneath it. These sensors 271-272 count only those coins exiting the associated exit slot 261-262. The exit slot sensors 271-276 are used to verify that a coin has entered and exited a respective exit slot 261-266 and/or for validation of a coin about to exit an exit slot 261-266.

Coins driven against the downstream walls 261*c*, 262*c* of the exit slots 261-262 will slip backward on the pad surface as the pad rotates to drive the coins out of the exit slot 261-262 and off the pad surface. This slippage distance will vary with the evolving conditions of the coins, disc 212, and pad 118.

The size of each exit slot 261-266 (width and length) determines the amount of space required on the disc to encompass all of the exit slots necessary for the largest of coin sets. There are some coin sets with so many coins that the space required for their exit slots cannot be accommodated within the sorting disc 212. In this case, some coins would need to be excluded. In other cases, additional coins or tokens could not be added.

Turning to sorting head 312 and FIG. 12B, the exit slot area 360 addresses these issues by significantly reducing the size of the exit slots, shortening the length of the exit path, and decreasing the pad slip distance. The configuration of the exit slots 361-366 also decreases the wear and tear on the coins, disc 312, and pad 118.

Similar to the design of sorting disc 212, coins approach the exit slots 361-366 aligned to a common outer radius 356, but unlike the design of sorting disc 212, the outer portion of the coins lies beyond the outer edge 118*a* of the coin pad 118 for sorting disc 312. As such, these coins are already "partially exited", require far less exit slot width to affect the coins, and a much shorter length to fully exit the coins from the disc 312 and be completely off the pad surface.

The reduced length of the exit slots 361-366 (only 361-362 shown in FIG. 12B) allows just enough space for the corresponding coins to enter, quickly engage the downstream exit walls 361*c*-362*c*, and be driven out of the disc 312 and off the pad 118.

Each exit slot 361-362 has an outer, upstream rail edge (e.g., edge 1241*a* shown in FIGS. 12C and 13B) of narrow ledge or peninsula 1241, 1242 near the perimeter of the disc 312, just inboard of the outer edge 118*a* of the pad 118, which acts to tightly grip the coin along the pad perimeter. This rail and grip, with no outer constraint on the coin's outer overhanging portion, causes the inner portion of the coin to immediately and firmly lift up into the exit recess 1251, 1252.

Each exit recess 1251, 1252 is defined by straight or nearly straight downstream exit walls 361*c*-362*c*, innermost edges 361*a*, 362*a*, the transition wall 361*b*, and curved inboard entrance ramps 1261, 1262 which are curved to match the size and shape of the corresponding coins to be exited via the associated exit slots 361-362. For example, the smallest diameter US coin is a dime and the second smallest diameter US coin is a penny. For a sorting head 312 designed to sort US coins, the first exit slot 361 is sized to permit dimes to enter the exit slot 361 and the second exit slot 362 is sized to permit pennies to enter the exit slot 362. Hence, the curve of curved inboard entrance ramp 1261 matches and is slightly larger than the curve of the edges of a dime and the curve of curved inboard entrance ramp 1262 matches and is slightly larger than the curve of the edges of a penny, and so on for exit slots 363-366.

Each exit recess 1251, 1252 is further defined by a straight or nearly straight outboard beveled surface 1281, 1282 that extend downstream from cornered beveled transitions 1271, 1272, respectively. The cornered beveled transitions 1271, 1272 transition between inboard entrance ramp 1261 and beveled surface 1281 and between inboard entrance ramp 1262 and beveled surface 1282, respectively. Short upstream exit ramps 1291, 1292 extend from the downstream end of peninsula 1241, 1242 up to surface 1251, 1252 between the downstream ends of outboard beveled surfaces 1281, 1282, respectively, and the outer periphery 312*a* of the sorting disc 312. A narrow ledge or peninsula 1241, 1242 is formed between each of the outboard beveled surfaces 1281, 1282 and the outer periphery 312*a* of the sorting disc 312 and ends at the short upstream exit ramps 1291, 1292.

In FIG. 13B, a partial cross-sectional view of the sorting heads 312 and pad 118 in a region of the first exit slot 361 along lines 13B-13B indicated in FIG. 12B is shown. A dime C10 is shown in the exit slot 361 engaging the downstream exit wall 361*c*. The recess surface 1251 is generally horizontal and positioned above surrounding "0" level surfaces 310 downstream beyond downstream exit wall 361*c* and upstream on peninsula 1241. Surface 1281 is angled downward from surface 1251 to the peninsula 1241 and meets the peninsula at the "0" level at edge 1241*a*. The coin C10 can be seen extending beyond the outer periphery 312*a* of the sorting disc 312 and the outer periphery 118*a* of the pad 118. According to some embodiments, in FIG. 13B, the radially outward downward tilt of the dime is about 7.6°. According to some embodiments, the radially outward downward tilt of the quarter in its corresponding exit slot is about 4.9°, and the radially outward downward tilt of the half dollar in its corresponding exit slot is about 3.6°. According to some embodiments, the radial outward downward tilt of coins in their corresponding exit slots 361-366 is greater than about 7°. According to some embodiments, the radial outward downward tilt of coins in their corresponding exit slots 361-366 is greater than about 6° or 6.5°. According to some embodiments, the radial outward downward tilt of coins in their corresponding exit slots 361-366 is between about 5° and 10°. According to some embodiments, the radial outward downward tilt of coins in their corresponding exit slots

361-366 is greater than about 2°. According to some embodiments, the radial outward downward tilt of coins in their corresponding exit slots 361-366 is greater than about 3° or 3.5°. According to some embodiments, the radial outward downward tilt of coins in their corresponding exit slots 361-366 is between about 3.6° and 9.4°. According to some embodiments, the radial outward downward tilt of coins in their corresponding exit slots 361-366 is between about 2° and 10°.

According to some embodiments, in FIG. 13A, the radially outward downward tilt of the dime in exit slot 261 is about 4.0°.

Once a coin is engaged by the exit recess 1251, 1252, the pad 118 drives the coin against the short exit wall 361*c*, 362*c*. After a brief rotation of the pad 118 the coin exits. This brief rotation produces minimal slippage of the coin relative the pad 118, maintaining a reasonably predictable position of the coin on the pad 118 throughout the exiting process.

Each narrow peninsula 1241, 1242 also acts as a support for the outer portions of passing coins to ensure a flat transition across the length of exit slots 361-362. By the time the trailing edge of a passing coin leaves the narrow peninsula 1241, 1242, the lead edge of the coin is fully supported by surface 310 (downstream of the downstream exit walls 361*c*-362*c*) sufficient to maintain the coin in a flat orientation.

The reduced size of the exit slots 361-366, including the shortened exit walls 361*c*, 362*c*, results in coin exit slots 361-366 that occupies significantly less space on the sorting head 312 than the exit slots 261-266 of sorting head 212 and requires far less area around the disc perimeter. This allows a greater number of coin exit slots to be provided around the disc 312 to accommodate those previously described excluded coin and token exit slots.

According to some embodiments, the exit slots 361-366 comprises exit slots sensors as described above in connection with exit slot sensors 271-276, 371-376.

According to some embodiments employing re-gauging area 350 and exit slots 361-366, exit slot sensors 371-376 may be omitted. A resulting benefit of such embodiments is the elimination of the exit sensor implementation costs including a reduction in parts, related components, dedicated disc space, machining, assembly, service, etc.

With the shortened exit slots 361-366 contributing to minimal (near zero) pad slippage, a coin's location on the pad may be accurately tracked from a sync sensor 1230 or trigger sensor 336 through the exit from the disc 312 and off of the pad 118 surface. According to some embodiments, the sync sensor 1230 is used to re-sync the exact timing when a coin passes sync sensor 1230 to compensate for any delay, due to slipping, dragging, or stalling of the coin passing through the re-gauging area 350 and/or reject region 340. A signal or data from sync sensor 1230 (as in the case for other sync and/or trigger sensors 410*a*, 410*b*, 236, 336) is coupled to the controller 180 so the controller can precisely track the position of coins as they move under the sorting head. Each accepted coin that has been re-gauged by re-gauging wall 352 will be a known coin (as determined by the discrimination sensor 334) within the current coin set the sorting head 312 is configured to sort and at a known location on the coin pad (based on the sync sensor 1230 and an encoder 184). Accordingly, in some embodiments, all coins can be tracked throughout their travel along their exit path. This tracking is used to ensure the delivery of an exact quantity of coins to respective coin containers or receptacles. Once a limit coin has been exited, and as long as no additional limit denomination coins are imminent, a current batch may be processed to its end. A limit coin is a coin of a particular denomination that is or will be the last coin of the corresponding denomination that is to be delivered to a particular coin receptacle. For example, where 1000 dimes constitute a full bag of dimes, the limit dime coin is the $1000^{th}$ dime detected to be delivered to a particular coin bag that is receiving dimes. If limit of another denomination coin is identified within the batch, it too may be exited and the batch processed to its end. Once a limit coin for a particular denomination has exited the sorting head 312 from the appropriate exit slot 361-366, the controller 180 can set a corresponding full coin receptacle flag or "Container Limit" flag in memory 188. Before or after the processing of the batch has ended, any "Container Limit" flags can cause the controller 180 to generate one or more message signals to be sent to the operator interface 182 to cause the display or indication of an appropriate message or error condition (e.g., "25¢ container full") so an operator will know that one or more containers have reached their limit and the operator may exchange any full container with an empty replacement container.

Figure 14:
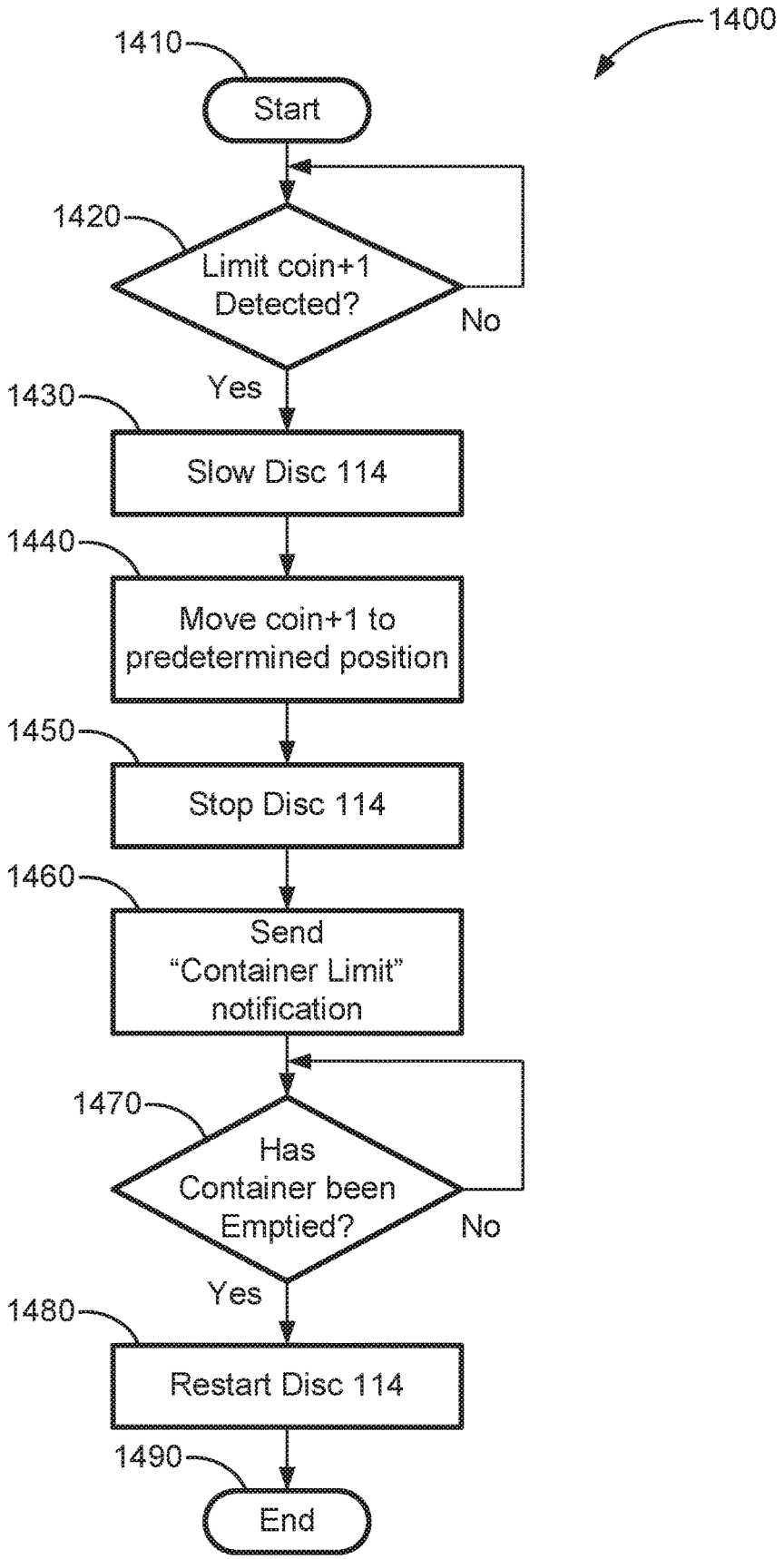
FIG. 14 is a flowchart illustrating a Container Limit Stop Routine according to some embodiments.

FIG. 14 is a flowchart illustrating a Container Limit Stop Routine 1400 according to some embodiments. After a limit coin (n) for a given denomination has been detected, the Container Limit Stop Routine 1400 is started at step 1410. The controller 180 then monitors for the detection of another coin (n+1) of the same denomination at step 1420. If, after reaching a container limit (n), an additional limit denomination coin of the same denomination (n+1) is detected prior to the end of the current batch, the speed of the rotatable disc 114 carrying pad 118 is slowed, in some embodiments being reduced to 50 rpm at step 1430. At step 1440 the rotatable disc 114 is continued to be rotated until the n+1 coin has been driven to a pre-determined position between sorting head 312 and pad 118 and then rotation of the rotatable disc 114 is stopped at step 1450. At step 1460, a "Container Limit" notification is communicated to the operator of the system 100 such as via operator interface 182. At step 1470, the controller 180 monitors whether the container associated with the same denomination as the n+1 coin has been emptied. When that container has been emptied and/or replaced with an empty container, the rotation of the rotatable disc 114 is restarted at step 1480 and the routine ends at step 1490. During the slow speed limit stop process, all coins continue to be tracked and their relative positions on the pad 118 identified for subsequent motion upon restart. According to some embodiments, at step 1480, the rotatable disc 114 is restarted at full speed unless another n+1 coin has been detected in which case the disc 114 is restarted at reduced speed and the process continues from step 1430.

Figure 15A:
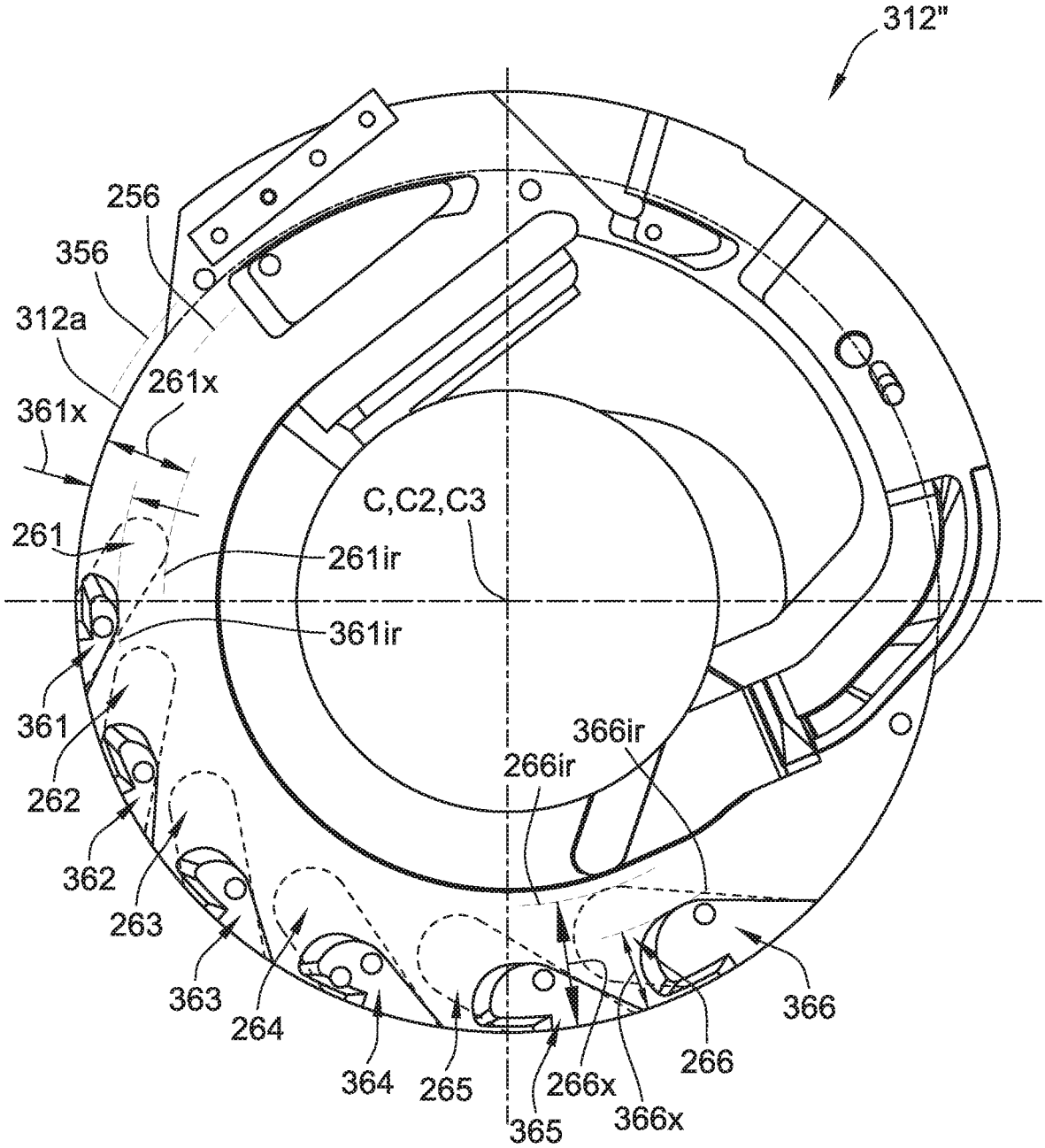
FIG. 15A is a bottom plan view of a variation of the sorting head of FIG. 3 overlaying exit slots of sorting head of FIG. 2 according to some embodiments.

FIG. 15A is a bottom plan view of a variation of sorting head 312 overlaying exit slots 261-266 of sorting head 212 on the exits slots 361-366 of sorting head 312 to graphically illustrate the differences in the amount of space consumed on a sorting head for each type of exit slot. In the illustrated embodiment, sorting head 312" is configured to sort US coins. Exit slot 261, 361 is sized to accommodate and discharge dimes which have a diameter of 0.705 inches, exit slot 262, 362 is sized to accommodate and discharge pennies which have a diameter of 0.75 inches, exit slot 263, 363 is sized to accommodate and discharge nickels which have a diameter of 0.835 inches, exit slot 264, 364 is sized to accommodate and discharge quarters which have a diameter of 0.955 inches, exit slot 265, 365 is sized to accommodate and discharge dollar coins which have a diameter of 1.043 inches, and exit slot 266, 366 is sized to accommodate and discharge half dollar coins which have a diameter of 1.205 inches.

As discussed above, coins approach the exit slots 261-266 being aligned to a common outer radius 256 which is entirely inboard of the pad edge and the outer periphery 312*a* of the sorting head 312" in the area of exit slots 261-266. The inner edges of the exit slots 261-266 are located at an inner radius displaced from the common outer radius 256 by just more than the diameter of the coin denomination to be exited via a given exit slot. For example, according to some embodiments, the sorting head 312" has an outer periphery 312*a* which is circular at least in the area of the exit slots 261-266 which is centered about axis C2. A rotatable circular resilient pad is positioned below the sorting head 312" which is centered about axis C (which is the same axis as C2) and has an outer periphery aligned with the outer periphery 312*a* of the sorting head 312". According to some embodiments, the pad has a radius of 5.5 inches, the outer periphery 312*a* of the sorting head 312" is also at a radius of 5.5 inches in the area of exit slots 261-266 and the common radius 256 is at a radius of 5.1 inches. As a result, the inner edge of the dime exit slot 261 is located at an inner radius displaced from the common outer radius 256 by just more than the diameter of a dime, that is, inner radius $\mathbf{261}_{ir}$ is located at a radius just inside of 4.395 inches and is displaced from the outer periphery 312*a* of the sorting head 312" by a distance 261*x* by just more than 1.105 inches. As another example, the inner edge of the half dollar exit slot 266 is located at an inner radius displaced from the common outer radius 256 by just more than the diameter of a half dollar, that is, inner radius $\mathbf{266}_{ir}$ is located at a radius just inside of 3.895 inches and is displaced from the outer periphery 312*a* of the sorting head 312" by a distance 266*x* by just more than 1.605 inches. Table 3A provides the corresponding information for each denomination of US coins for exit slots 261-266.

TABLE 3A

| US Coins | Diameter (in.) | Pad/Sorting Head Outer Periphery Radius 118a, 312a (in.) | Common Outside Radius 256 (in.) | Exit Slot Inner Radius ($261_{ir}$, $262_{ir}$, etc.) (in.) | Distance from Outer Periphery to Inner Radius (261x, 262x, etc.) (in.) |
|---|---|---|---|---|---|
| 10¢ | 0.705 | 5.500 | 5.100 | 4.395 | 1.105 |
| 1¢ | 0.750 | 5.500 | 5.100 | 4.350 | 1.150 |
| 5¢ | 0.835 | 5.500 | 5.100 | 4.265 | 1.235 |
| 25¢ | 0.955 | 5.500 | 5.100 | 4.145 | 1.355 |
| $1 | 1.043 | 5.500 | 5.100 | 4.057 | 1.443 |
| 50¢ | 1.205 | 5.500 | 5.100 | 3.895 | 1.605 |

As discussed above, coins approach the exit slots 361-366 being aligned to a common outer radius 356 which is entirely outboard of the pad edge and the outer periphery 312*a* of the sorting head 312" in the area of exit slots 361-366. The inner edges of the exit slots 361-366 are located at an inner radius displaced from the common outer radius 356 by just more than the diameter of the coin denomination to be exited via a given exit slot. For example, according to some embodiments, the sorting head 312" has an outer periphery 312*a* which is circular at least in the area of the exit slots 361-366 which is centered about axis C3. A rotatable circular resilient pad is positioned below the sorting head 312" which is centered about axis C (which is the same axis as C3) and has an outer periphery aligned with the outer periphery 312*a* of the sorting head 312". According to some embodiments, the pad has a radius of 5.5 inches, the outer periphery 312*a* of the sorting head 312" is also at a radius of 5.5 inches in the area of exit slots 361-366 and the common radius 356 is at a radius of 5.685 inches (0.185 inches radially outward of the outer periphery of the pad and sorting head 312" in the vicinity of the exit slots). As a result, the inner edge of the dime exit slots 361 is located at an inner radius displaced from the common outer radius 356 by just more than the diameter of a dime, that is, inner radius 361*ir* is located at a radius just inside of 4.98 inches and is displaced from the outer periphery 312*a* of the sorting head 312" by a distance 361*x* by just more than 0.52 inches. As another example, the inner edge of the half dollar exit slots 366 is located at an inner radius displaced from the common outer radius 356 by just more than the diameter of a half dollar, that is, inner radius $\mathbf{366}_{ir}$ is located at a radius just inside of 4.48 inches and is displaced from the outer periphery 312*a* of the sorting head 312" by a distance 366*x* by just more than 1.02 inches. Table 3B provides the corresponding information for each denomination of US coins for exit slots 361-366.

TABLE 3B

| US Coins | Diameter (in.) | Pad/Sorting Head Outer Periphery Radius 118a, 312a (in.) | Common Outside Radius 356 (in.) | Exit Slot Inner Radius ($361_{ir}$, $362_{ir}$, etc) (in.) | Distance from Outer Periphery to Inner Radius (361x, 362x, etc.) (in.) |
|---|---|---|---|---|---|
| 10¢ | 0.705 | 5.500 | 5.685 | 4.980 | 0.520 |
| 1¢ | 0.750 | 5.500 | 5.685 | 4.935 | 0.565 |
| 5¢ | 0.835 | 5.500 | 5.685 | 4.850 | 0.650 |
| 25¢ | 0.955 | 5.500 | 5.685 | 4.730 | 0.770 |
| $1 | 1.043 | 5.500 | 5.685 | 4.642 | 0.858 |
| 50¢ | 1.205 | 5.500 | 5.685 | 4.480 | 1.020 |

As can be seen from FIG. 15A and indicated by the values in Tables 3A and 3B, the exit slots 361-366 consume much less space on the sorting head 312" than the exit slots 261-266.

According to some embodiments and as mentioned above, the common outer radius 356 at which coins approaching the exit slots 361-366 are aligned is entirely outboard of the outer periphery of the resilient pad and the outer periphery 312*a* of the sorting head 312" in the area of exit slots 361-366. According to some embodiments, the common outer radius 356 is positioned at least 0.03 inches beyond the outer periphery of the resilient pad and/or the outer periphery 312*a* of the sorting head 312" in the area of exit slots 361-366. According to some embodiments, the common outer radius 356 is positioned at least 0.18 inches (e.g., 0.185 inches) beyond the outer periphery of the resilient pad and/or the outer periphery 312*a* of the sorting head 312" in the area of exit slots 361-366. According to some embodiments, the common outer radius 356 is positioned at least 0.3 inches (e.g., 0.326 inches) beyond the outer periphery of the resilient pad and/or the outer periphery 312*a* of the sorting head 312" in the area of exit slots 361-366.

According to some embodiments, the common outer radius 356 is positioned at a radius of at least 5.53 inches and the outer periphery of the resilient pad and/or the outer periphery 312*a* of the sorting head 312" in the area of exit slots 361-366 is positioned at a radius of 5.5 inches. According to some embodiments, the common outer radius 356 is positioned at a radius of at least 5.68 inches and the outer periphery of the resilient pad and/or the outer periphery 312*a* of the sorting head 312" in the area of exit slots 361-366 is positioned at a radius of 5.5 inches. According to some embodiments, the common outer radius 356 is positioned at a radius of at least 5.82 inches and the outer periphery of the resilient pad and/or the outer periphery 312*a* of the sorting head 312" in the area of exit slots 361-366 is positioned at a radius of 5.5 inches.

Figure 15B:
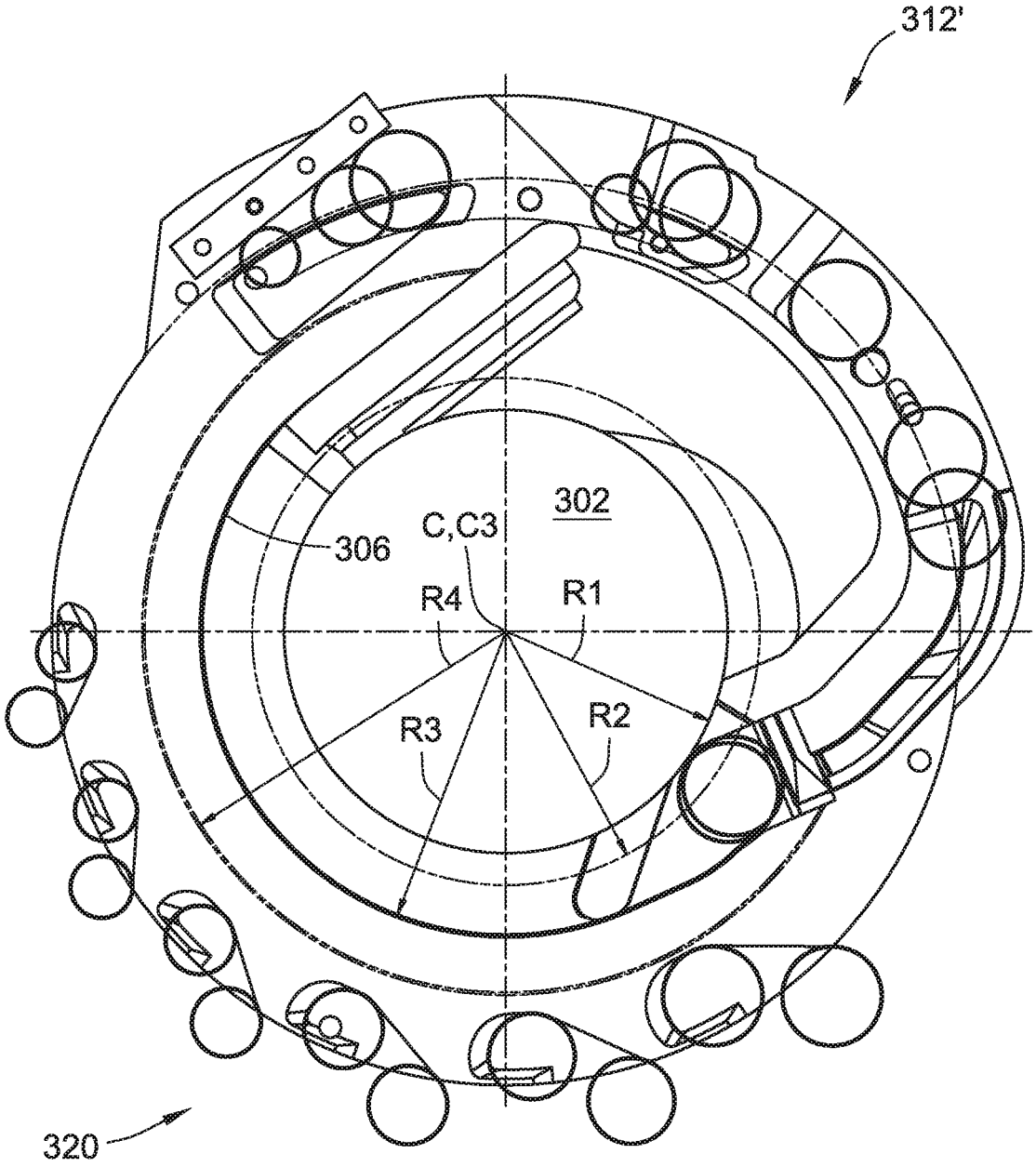
FIG. 15B is a bottom plan view of a variation of sorting head of FIG. 3 according to some embodiments.

FIG. 15B is a bottom plan view of a variation 312' of sorting head 312 useful in explaining some additional benefits of some of the features of sorting head 312. The reduced size of the exit slots 361-366, and their positioning outward toward the perimeter of the disc, leaves more space radially inboard of the area near exit slots 361-366. This additional space allows the central opening 302 and the outer wall 306 of the entry area 304 to expand outward accordingly. For example, the central opening 302 may be increased from having a radius of R1 to a radius of R2 and the outer wall 306 of the entry area 304 may be increased from having a radius of R3 to a radius of R4. According to some embodiments, the central opening 302 may be increased from having a radius of about 2.69 inches (R1) to a radius of about 3.08 inches (R2) and the outer wall 306 of the entry area 304 may be increased from having a radius of about 3.68 inches (R3) to a radius of about 4.38 inches (R4). The increase to the radii of the central opening 302 and the outer wall 306 of the entry area 304 result in dramatic increases to coin volume and centrifugal forces on the coins for a given turntable or rotatable disc 114 rpm (revolutions per minute). The increased coin volume (a greater number of coins per revolution) allows the turntable rpm to be reduced while still achieving greater throughput (coins per minute). These changes can be balanced, or manipulated in either direction, to affect sorting disc performance as desired. The decreased size and complexity of the sorting head's 312 geometry results in reduced machining time, less complex machining paths, and fewer critical tolerances to be maintained and verified, all of which come at a lower cost.

Figure 18:
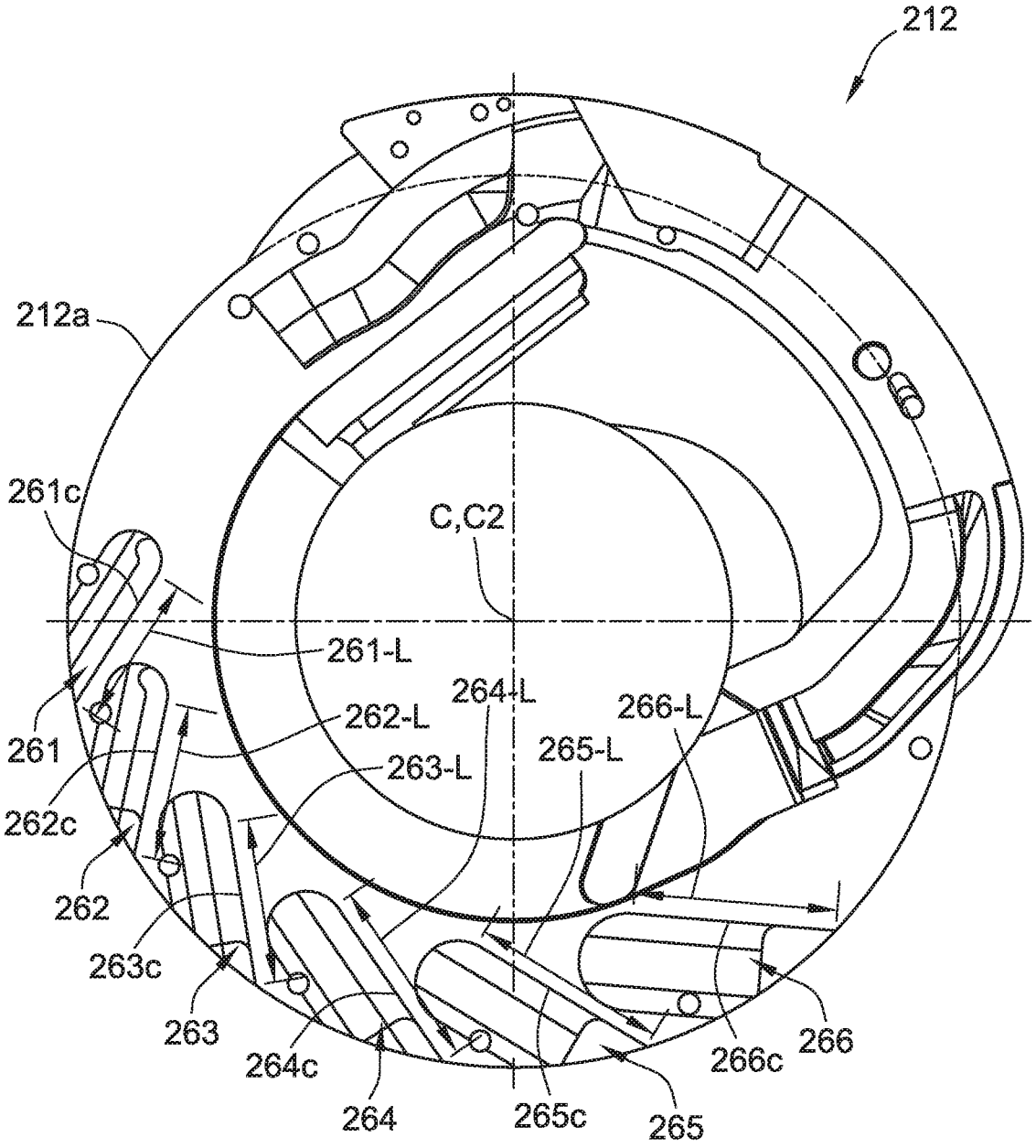
FIG. 18 is a bottom plan view of the first sorting head of FIG. 2 with indications of the coin-driven length of exit slots.
Figure 19:
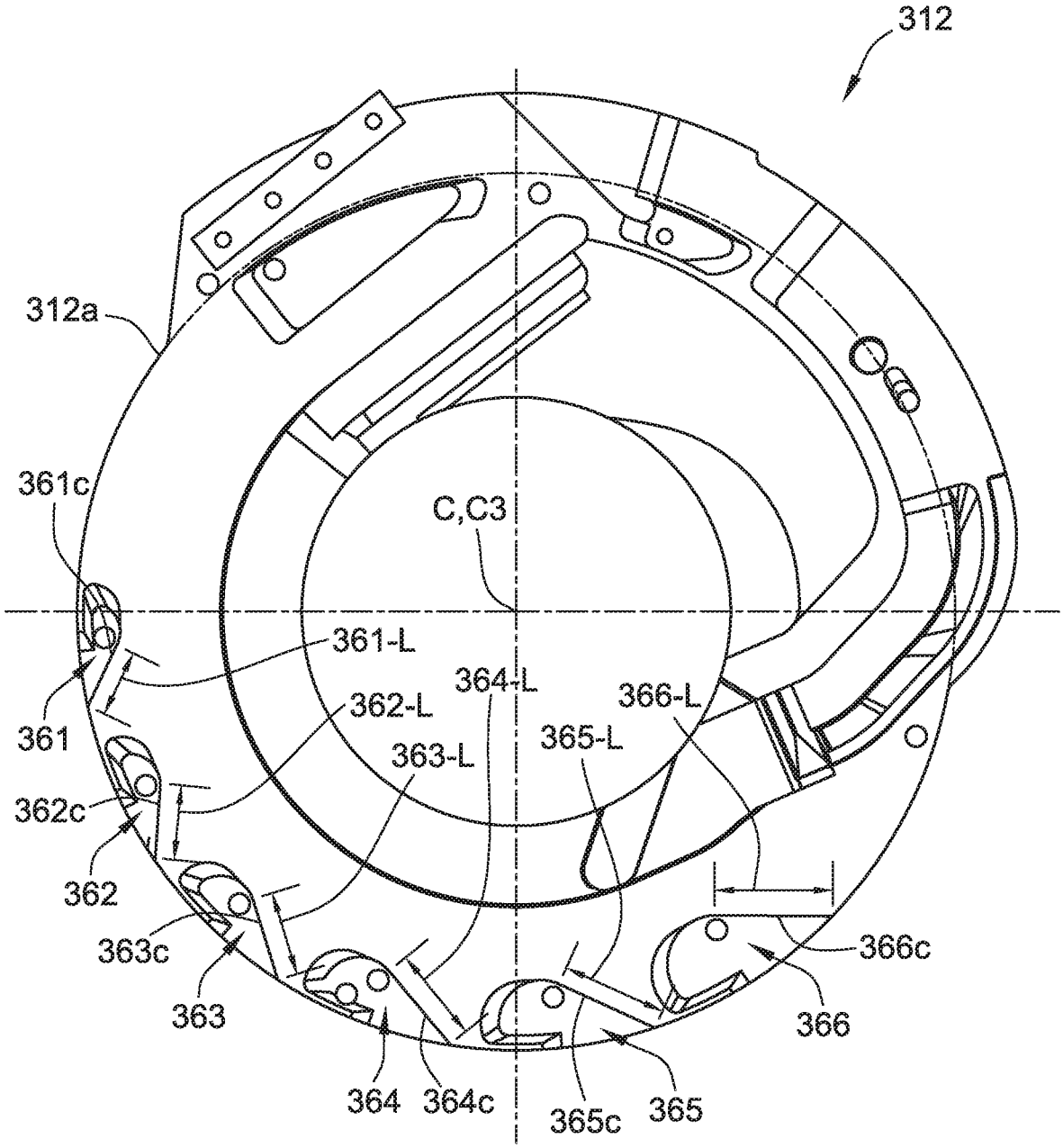
FIG. 19 is a bottom plan view of the second sorting head of FIG. 3 with indications of the coin-driven length of exit slots.

The reduction in the coin-driven lengths of the exit slots will be discussed with reference to FIGS. 18 and 19. FIG. 18 is a bottom plan view of the first sorting head 212 of FIG. 2 with indications of the coin-driven length of exit slots 261-266. FIG. 19 is a bottom plan view of the second sorting head 312 of FIG. 3 with indications of the coin-driven length of exit slots 361-366.

In FIG. 18, the length along which coins are driven out of exit slots 261-266 along downstream exit walls 261*c*-266*c* is illustrated as length 261-L for exit slot 261, length 262-L for exit slot 262, length 263-L for exit slot 263, length 264-L for exit slot 264, length 265-L for exit slot 265, and length 266-L for exit slot 266. The coin-driven length of each exit slot is measured from the first point of coin contact with the inner, downstream exit wall, e.g., downstream exit wall 261*c* for exit slot 261 to the point where the downstream exit wall ends at the outer periphery 212*a* of the sorting head 212.

In FIG. 19, the length along which coins are driven out of exit slots 361-366 along downstream exit walls 361*c*-366*c* is illustrated as length 261-L for exit slot 361, length 362-L for exit slot 362, length 363-L for exit slot 363, length 364-L for exit slot 364, length 365-L for exit slot 365, and length 366-L for exit slot 366. The coin-driven length of each exit slot is measured from the first point of coin contact with the inner, downstream exit wall, e.g., downstream exit wall 361*c* for exit slot 361 to the point where the downstream exit wall ends at the outer periphery 312*a* of the sorting head 312. With respect to FIG. 12C and exit slot 361, this is the distance between locations 361*c*-1 and 361*c*-2.

Table 4 provides the coin-driven length of the exit slots of the first sorting head 212 and the second sorting head 312 and the corresponding reduction in length according to some embodiments.

TABLE 4

| | Denomination | | | | | |
|---|---|---|---|---|---|---|
| | 10 c Driven-Coin Length 261-L, 361-L (in.) | 1 c Driven-Coin Length 262-L, 362-L (in.) | 5 c Driven-Coin Length 263-L, 363-L (in.) | 25 c Driven-Coin Length 264-L, 364-L (in.) | $1 Driven-Coin Length 265-L, 365-L (in.) | 50 c Driven-Coin Length 266-L, 366-L (in.) |
| Sorting Head 212 | 1.914 | 1.970 | 2.064 | 2.243 | 2.293 | 2.455 |
| Sorting Head 312 | 0.868 | 0.932 | 1.050 | 1.210 | 1.321 | 1.445 |
| Reduction in Driven-Coin Length | 1.046 | 1.038 | 1.014 | 1.033 | 0.972 | 1.01 |
| Percentage Reduction in Driven-Coin Length | 55% | 53% | 49% | 46% | 42% | 41% |
| Driven Length in Head 312 as Percentage of Head 212 | 45% | 47% | 51% | 54% | 58% | 59% |

The shorter coin-driven length of the exit slots of the second sorting head 312 provide advantages according to some embodiments. An advantage of shorter coin-driven length of the exit slots is that they reduce the time that a coin is in the exit slot which helps with sorting accuracy. When coins enter an exit slot, they slow relative to the turntable speed due to their change in direction from concentric travel. Coins traveling concentrically behind an exiting coin tend to catch up with an exiting coin. When a collision between a non-exiting downstream coin and an exiting coin occurs, disruption of the direction of travel of one or more of the colliding coins can happen, sending one or more of the colliding coins into another direction and ultimately into the wrong container. The shorter coin-driven length of the exit slots of the second sorting head 312 reduce the possibility of collisions as coins in sorting head 312 exit the sorting head 312 more quickly.

Reject Chute

With sorting head 212, rejected coins must be directed from the reject area 240 downward into a pathway leading to a container for collecting rejected or non-accepted coins. Some of these expelled coins may also be valid coins or tokens, having value, that have no dedicated exit position or cannot be physically separated mechanically by their diameter. As described above, the coins driven out of the reject area 240 may travel in random paths (or less than predictable paths) and in random orientations as they exit. With no guidance after contacting the reject pin 242, the flight pattern of coins lacks directional control. According to some embodiments, the method of redirecting coin flow is a curved reject chute which intercepts the random, substantially horizontal paths of the coins and reorients them to a substantially vertical, downward direction. See, for example, external diverter described in U.S. Pat. No. 7,743,902 and coin chutes described in U.S. Pat. No. 6,039,644, both patents being incorporated herein by reference in their entirety. While such a method may be sufficient for coin streams of a stable, predictable flow, the stream resulting from reject area 240 is neither. The various orientations of the coins and the various speeds at which they travel while exiting allows preceding coins to affect the forward motion of coins which follow. This can cause coins to impact one another within the constrained area of the reject chute and can quickly cause a jam condition as coins pile up inside the chute area. This jamming condition may affect coins passing into the reject surface 243, or worse yet, may back up into the high-speed stream of non-rejected or accepted coins as they attempt to pass through and out of reject area 240.

The configuration of reject area 340 producing a more stable, controlled stream of coins exiting the sorting head 312 can eliminate or reduce the above described jamming problems when used with existing external diverters and/or coin chutes discussed above such as those described in U.S. Pat. Nos. 7,743,902 and 6,039,644.

Figure 16:
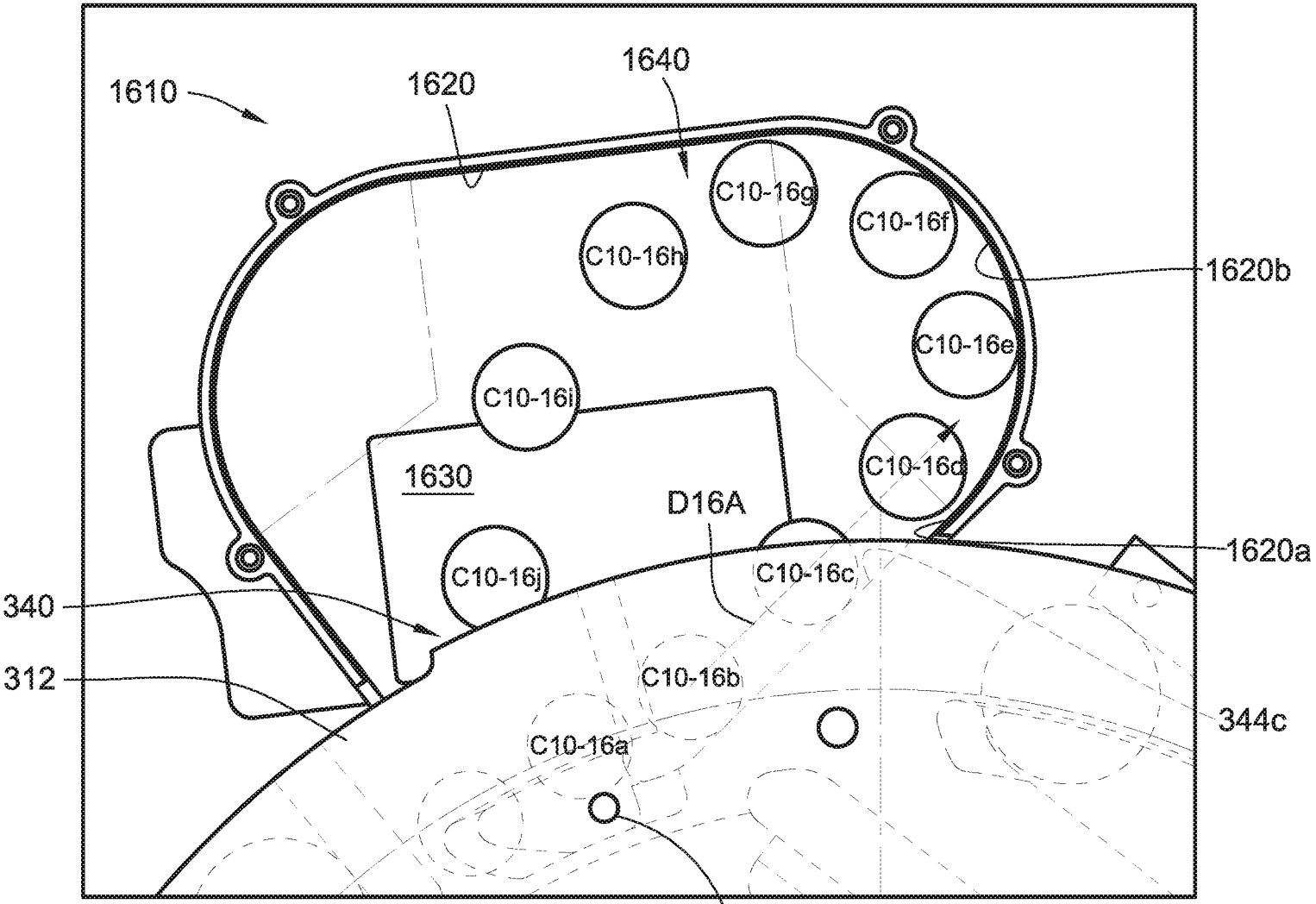
FIG. 16 is a top plan view and FIG. 17 is a downward perspective view of a reject chute according to some embodiments.
Figure 17:
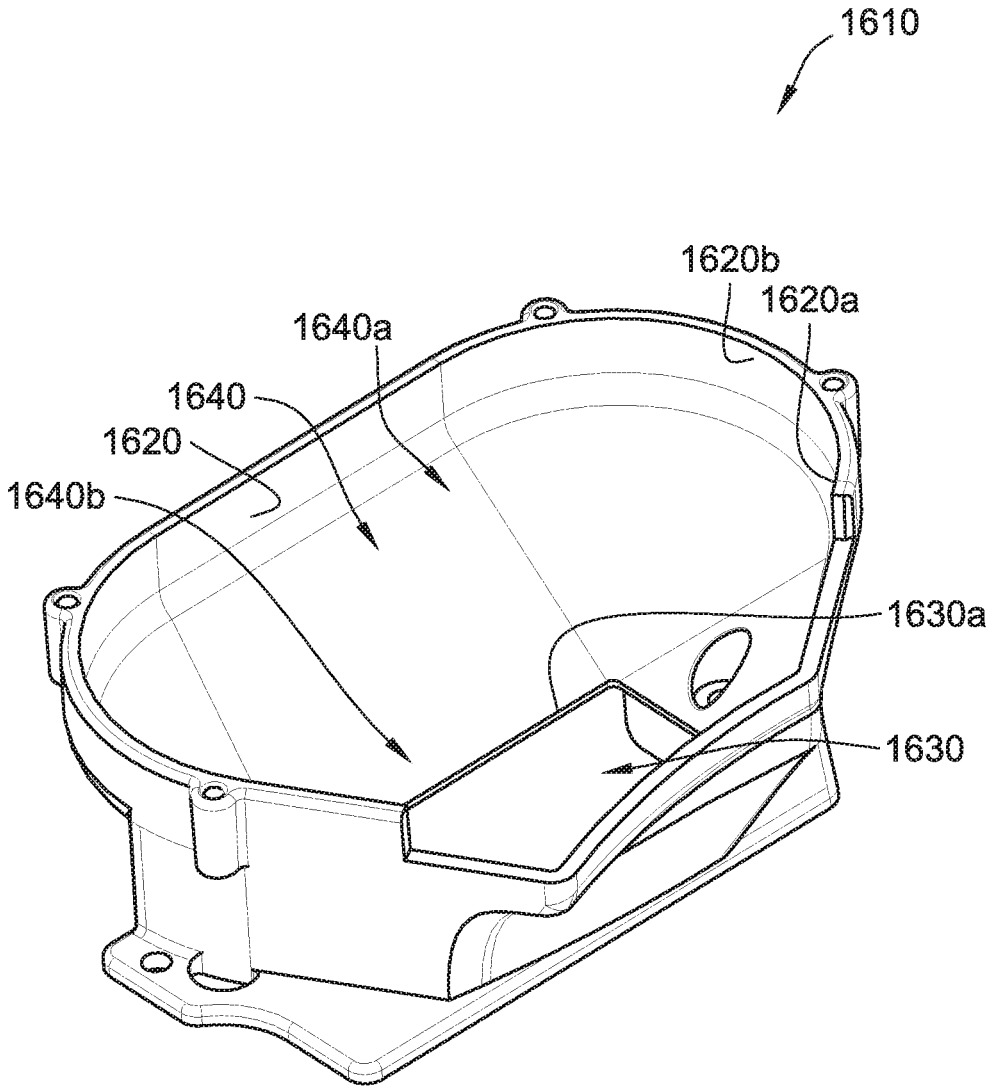

FIG. 16 is a top plan view and FIG. 17 is a downward perspective view of a reject chute 1610. The reject chute 1610, in conjunction with either the reject area 240 or reject area 340, can eliminate or reduce the stalling and jamming conditions of prior reject chutes.

The reject chute 1610 has an upper wall 1620 and a lower tapered surface 1640 and a bottom collection area 1630. The lower tapered surface 1640 extends from the bottom of the upper wall 1620 to the top edges 1630*a* of the bottom collection area 1630. The tapered surface 1640 has a generally funnel shape in that the upper wall 1620 is positioned outside of the top edges 1630*a* of the bottom collection area 1630 and hence the tapered surface narrows from the top of the tapered surface 1640*a* to the bottom of the tapered surface 1640*b*. According to some embodiments, the upper wall 1620 is vertically or near vertically oriented. According to some embodiments, the upper wall 1620 has a lead portion 1620*a* that is linear and when operatively positioned adjacent to reject area 340, the lead portion 1620*a* is parallel or generally parallel with the straight portion 344*c* of reject wall 344. According to some embodiments, the linear lead portion 1620*a* is in line with straight portion 344*c* of reject wall 344. According to some embodiments, the linear lead portion 1620*a* is lined just behind the straight portion 344*c* of reject wall 344 so that should the linear lead portion 1620*a* bend slightly inward, the lead portion 1620*a* will not stick into the path of coins exiting from the reject slot 349 so that coins being fed along straight portion 344*c* of reject wall do not impact the lead portion 1620*a*. The upper wall 1620 has a curved portion 1620*b*. As will be described more below, the curved portion 1620*b* redirects coins engaging upper wall 1620 generally horizontally in a direction differing from the generally horizontal direction coins emerge from reject area 340.

The configuration of the new reject chute 1610 intercepts expelled coins in the substantially horizontal orientation of their stream, whether stable (from the reject area 340) or less than stable (from the reject area 240). But rather than immediately redirecting the coins to a vertical orientation, the design of reject chute 1610 redirects the flow sideways, along a curved portion 1620*b* of upper wall 1620, and away from the direction that coins are fed into reject chute 1610.

This redirection, and the natural deceleration of the coins due to friction and gravity, allows the coin stream to slow down and drop along the tapered surfaces 1640 leading to a bottom exit opening 1630 through which coins may fall into a reject collection area.

As used in connection with reject area 340, FIG. 16 illustrates an exemplary redirection of reject coins. As described above, a reject coin (in the illustrated example a dime C10) is redirected by diverter pin 342 and in a controlled manner engages reject wall 344. From a location C10-16*a* adjacent the diverter pin 342, the coin moves directly or indirectly to location C10-16*b*. The coin then moves parallel to reject wall 344 in direction D16A from location C10-16*b* to location C10-16*c* and then to location C10-16*d*. At location C10-16*e*, the coin engages curved portion 1620*b* of upper wall 1620 of reject chute 1610 at which point it follows along curved wall 1620 to location C10-16*f*. As the coin loses velocity it begins to move away from the curved upper wall 1620 and downward such as at location C10-16*g*. The coin continues to move downward and may engage tapered surface 1640 as it moves from location C10-16*h* to location C10-16*i* and through the bottom exit opening 1630 such as at location C10-16*j*. As can been seen in FIG. 16, after engaging upper curved wall 1620, the flow of the coin does not intersect the flow of coins emerging from reject area along direction D16A. Furthermore, after engaging upper curved wall 1620, the coins are laterally redirected away from direction D16A and the space there below. For example, and with reference to FIG. 16, coins emerging from reject slot along direction D16A, a left vertical plane may be defined by the left edges of emerging coins (viewed direction D16A) such as a plane intersecting downstream straight portion 344*c* of reject wall 344. Similarly, a right vertical plane or planes may be defined by the right edges of emerging coins (viewed direction D16A). A rightmost plane may be defined by the right edges of the largest coins being rejected out of reject slot 349 in a given batch. The curved wall 1620*b* is at an angle from direction D16A at a point where coins traveling in direction D16A initially contact the curved wall 1620*b* and serves to redirect coins from out of the space between the left and right planes. According to some embodiments, the angle of curved wall 1620*b* at the point of initial contact is between about 125° and 145° from direction D16A and/or the downstream straight portion 344*c* of the reject wall 344. Accordingly, rather than being initially redirected downward below the path coins emerge from a reject slot, the coins are initially redirected in a lateral direction relative to the the path coins emerge from a reject slot.

According to some embodiments, a metal strip such as a stainless-steel strip is coupled to upper wall 1620 or at least curved portion 1620*b* of upper wall 1620 to serve as a wear liner.

According to some embodiments, a horizontally linear surface such as a vertical wall may be used to move the coins laterally out of the flow of coins emerging from reject area along direction D16A. According to such embodiments, the linear surface is disposed at an angle other than 90° from the direction D16A from which coins are emerging from the reject slot 249, 349. For example, according to some embodiments, a laterally displacing linear surface or wall is oriented about 135° from the direction D16A from which coins are emerging from the reject slot 349 and/or the downstream portion 344*c* of the reject wall 344. According to some embodiments, this angle is between 125° and 145°.

With this new orientation path provided by reject chute 1610, coin flow of various volumes and feed rates may travel unobstructed to the bottom exit opening 1630. This is especially beneficial if the "reject area" is being used for mass coin elimination when many coins in a row will be directed into the reject chute 1610. For example, to remove an old version coin upon introduction of a new version, as will be the case with the upcoming new UK £1 Coin, the reject area 240,340 can be used to separate the old version coins en masse by routing them to the reject chute 1610.

Comparing sorting head 312 to sorting head 212, the sorting head 312 takes much less time to mill and manufacture, resulting in lower production costs. For example, according to some embodiments, it takes at least about 83% less time to machine exit slots 361-366 as compared to exit slots 261-266. Likewise, according to some embodiments, it takes at least about 69% less time to machine re-gauging area 350 as compared to re-gauging area 250. While according to some embodiments, it takes more time to machine reject area 340 as compared to reject area 240, overall it takes at least about 76% less time to machine exit slots 361-366, re-gauging area 350, and reject area 340 as compared to exit slots 261-266, re-gauging area 250, and reject area 240. According to some embodiments, over 50 minutes of machining time are saved in machining exit slots 361-366, re-gauging area 350, and reject area 340 as compared to exit slots 261-266, re-gauging area 250, and reject area 240.

While the disclosure is susceptible to various modifications and alternative forms, specific embodiments have been shown by way of example in the drawings and described in detail herein. It should be understood, however, that the disclosure is not intended to be limited to the particular forms disclosed. Rather, the disclosure is to cover all modifications, equivalents and alternatives falling within the spirit and scope of the inventions as defined by the appended claims.

What is claimed is:

1. A coin chute for receiving coins exiting from a coin sorting system comprising a rotatable disc including a resilient pad coupled thereto for imparting motion to the coins, a stationary sorting head having a lower surface generally parallel to and spaced slightly away from the resilient pad, the lower surface forming a coin path for directing movement of each of the coins, and a reject slot, wherein the coins exiting the reject slot travel in a first generally horizontal direction, the coin chute comprising:

an upper wall including a lead portion connected to the reject slot and a curved portion; and a lower tapered surface having a generally funnel shape having a larger perimeter at a top portion of the lower tapered surface than at a bottom portion of the lower tapered surface, wherein the upper wall is generally vertical and at least a first portion of the upper wall extends generally vertically from the top portion of the lower tapered surface, wherein the coins exiting the reject slot in the first generally horizontal direction travel along the lead portion and contact the curved portion at an angle from the first generally horizontal direction as the coins exit the reject slot, the curved portion directing the coins in a second generally horizontal direction along an inside perimeter of the curved portion to transfer the coins from the curved portion to the lower tapered surface, which leads to a collection area at the bottom portion of the lower tapered surface.

2. The coin chute of claim 1 wherein the coins directed in the second generally horizontal direction descend due to a gravitational force and contact the lower tapered surface.

3. The coin chute of claim 2 further comprising an exit opening in a lower portion of the lower tapered surface and wherein the coins, after contacting the lower tapered surface, proceed out of the coin chute via the exit opening.

4. The coin chute of claim 1 wherein the lead portion is generally parallel to the first generally horizontal direction in which the coins exit the reject slot.

5. The coin chute of claim 1 wherein at least a second portion of the upper wall where the coins contact the upper wall comprises a metal strip, the metal strip inhibiting wear of the upper wall.

6. The coin chute of claim 1 wherein the lower tapered surface and an exterior portion of the upper wall are made of a polymer material and wherein at least an interior portion of the upper wall where the coins contact the upper wall comprises a metal strip, the metal strip inhibiting wear of the upper wall.

7. The coin chute of claim 6 wherein the metal strip is stainless steel.

8. The coin chute of claim 1 wherein the angle of the curved portion is between about 125° and 145° from the first generally horizontal direction.

9. The coin chute of claim 8 wherein the angle of the curved portion is about 135° from the first generally horizontal direction.

10. A method of receiving coins exiting from a coin sorting system in a coin chute, the coin sorting system comprising a rotatable disc including a resilient pad coupled thereto for imparting motion to the coins, a stationary sorting head having a lower surface generally parallel to and spaced slightly away from the resilient pad, the lower surface forming a coin path for directing movement of each of the coins, and a reject slot, the coin chute comprising an upper wall and a lower tapered surface having a generally funnel shape having a larger perimeter at a top portion of the lower tapered surface than at a bottom portion of the lower tapered surface, wherein the upper wall is generally vertical and at least a portion of the upper wall extends generally vertically from the top portion of the lower tapered surface, and wherein the upper wall includes a lead portion connected to the reject slot and a curved portion at an angle from a first generally horizontal direction that the coins exit the reject slot, the method comprising the coins:

entering in the coin chute from the reject slot while traveling in the first generally horizontal direction and traveling along the lead portion;

contacting the curved portion of the upper wall of the coin chute; and traveling in a second generally horizontal direction along an inside perimeter of the curved portion of the upper wall to transfer the coins from the curved portion to the lower tapered surface, which leads to a collection area at the bottom portion of the lower tapered surface.

11. The method of claim 10 wherein the angle of the curved portion is other than 90° from the first generally horizontal direction.

12. The method of claim 10 further comprising the coins directed in the second generally horizontal direction descending due to a gravitational force and contacting the lower tapered surface.

13. The method of claim 12 wherein the coin chute further comprises an exit opening in a lower portion of the lower tapered surface and wherein the method further comprises the coins after contacting the lower tapered surface proceeding out of the coin chute via the exit opening.

14. The method of claim 10 wherein the lead portion is generally parallel to the first generally horizontal direction in which the coins exit the reject slot.

15. The method of claim 10 wherein at least a second portion of the upper wall where the coins contact the upper wall comprises a metal strip, the metal strip inhibiting wear of the upper wall.

16. The method of claim 10 wherein the lower tapered surface and an exterior portion of the upper wall are made of a polymer material and wherein at least an interior portion of the upper wall where the coins contact the upper wall comprises a metal strip, the metal strip inhibiting wear of the upper wall.

17. The method of claim 16 wherein the metal strip is stainless steel.

18. The method of claim 10 wherein the angle of the curved portion is between about 125° and 145° from the first generally horizontal direction.

19. The method of claim 18 wherein the angle of the curved portion is about 135° from the first generally horizontal direction.

* * * * *